US007121430B2

(12) United States Patent
Mink et al.

(10) Patent No.: US 7,121,430 B2
(45) Date of Patent: Oct. 17, 2006

(54) FLUID AND HAIR-DYE DISPENSERS

(75) Inventors: Johannes Hendrikus Mink, Noordwijkerwhout (NL); Wilhelmus Quirinus Laurentinus van Westerop, Noordwijk (NL); Renautus Petrus Cornelis Meeuwisse, Leidschendam (NL); Leen Hellenberg, Warmond (NL); Eric Beuning, Rossum (NL); Ad Kuljpers, Goirle (NL)

(73) Assignee: Lentep, LP, Northbrook, IL (US)

( * ) Notice: Subject to any disclaimer, the term of this patent is extended or adjusted under 35 U.S.C. 154(b) by 0 days.

(21) Appl. No.: 11/065,915

(22) Filed: Feb. 25, 2005

(65) Prior Publication Data

US 2005/0194403 A1 Sep. 8, 2005

Related U.S. Application Data

(60) Provisional application No. 60/548,682, filed on Feb. 27, 2004.

(51) Int. Cl.
*B67D 5/52* (2006.01)

(52) U.S. Cl. ..... 222/135; 222/144; 222/235

(58) Field of Classification Search ..... 222/135, 222/144, 235

See application file for complete search history.

(56) References Cited

U.S. PATENT DOCUMENTS 3,015,415 A * 1/1962 Marsh et al. ..... 222/135
3,122,272 A * 2/1964 Marsh ..... 222/144
4,705,083 A 11/1987 Rossetti
4,792,236 A 12/1988 Heinis et al.
5,328,057 A 7/1994 Hellenberg et al.
5,368,196 A 11/1994 Hellenberg et al.
5,480,288 A 1/1996 Hellenberg et al.
5,507,575 A 4/1996 Rosetti
5,511,695 A 4/1996 Chia et al.
5,558,251 A 9/1996 Neri
5,632,314 A 5/1997 Koppe et al.
5,697,527 A 12/1997 Altieri et al.
5,784,854 A 7/1998 Mazzalveri
6,360,961 B1 3/2002 Marazzi

OTHER PUBLICATIONS

H.E.R.O. 2000 Series Colorant Dispensers H.E.R.O. Industries, a Division of Middlefield Bancorp Limited.
H.E.R.O. 18 PR Colorant Dispenser 12 or 16 Positions "Rotary" Models—Counter Top or Floorstand.

* cited by examiner

*Primary Examiner*—Philippe Derakshani
(74) *Attorney, Agent, or Firm*—Adam K. Sacharoff; Marvin Benn; Much Shelist

(57) ABSTRACT

In accordance with the present invention there is provided novel and unique automatic and manual colorant and hair dye dispensers that are easy to operate and provides precision mixing of a large number of colorants and hair dye to make an almost infinite number of colors. The machines are relatively light in weight, easy to operate and maintain and the various components can be readily and easily replaced. In the colorant dispenser this is principally due to the fact that the colorant canisters are supported by a central column and the conventional use of a massive turntable supporting the canisters have been eliminated. In both the automatic and manual illustrated embodiments there is shown six (6) pie-shaped triangular canister units (dispensing units) each including three (3) separate colorant receptacles. There can be more or less dispensing units as desired.

19 Claims, 67 Drawing Sheets

SECTION B-B

SECTION A-A

SECTION B-B

DETAIL C
SCALE 2 : 1

SECTION A-A

DETAIL A
SCALE 1 : 5

DETAIL B

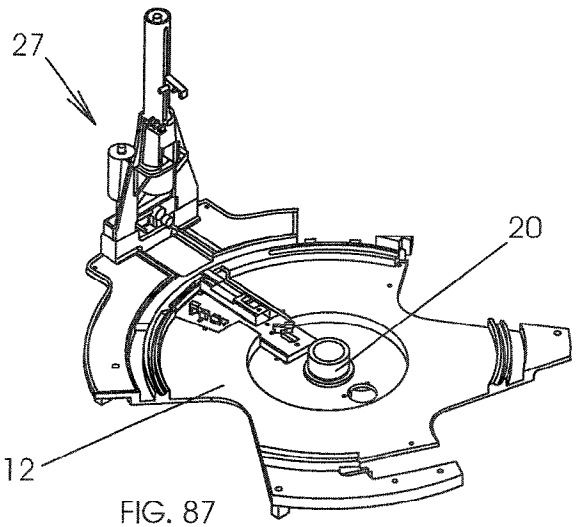
FIG. 87
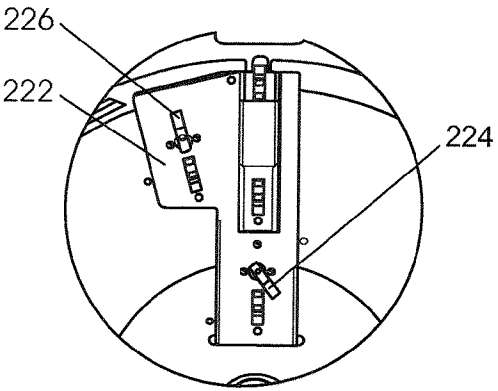
FIG. 89 DETAIL A
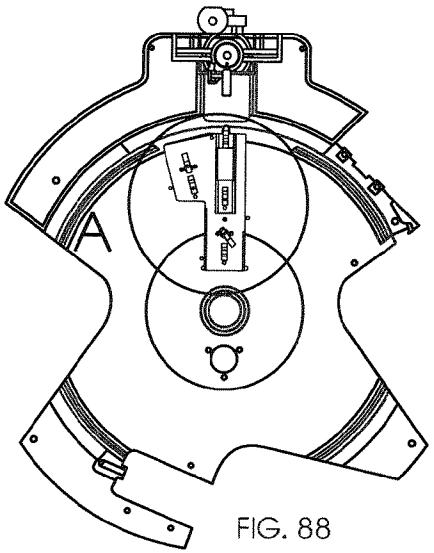
FIG. 88
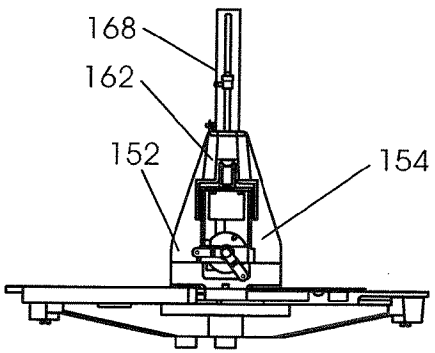
FIG. 90

FLUID AND HAIR-DYE DISPENSERS

This application claims the benefit of U.S. Provisional Application No. 60/548,682 filed Feb. 27, 2004.

BACKGROUND OF THE INVENTION

Fluid dispensers wherein various fluids such as paint colorants have been mixed to obtain a desired color have been available for a number of years. These have regularly required laborious arrangements to insure that a desired color is arrived at from a paint card listing the ingredients that have to be combined in prescribed amounts. The available machines have been very costly, slow acting, relatively difficult to operate and their construction has made repair and/or replacement cumbersome and complicated.

In the case of hair dye coloring, while there have been some types of dispensing systems available, they have for the most part been relatively primitive and not very effective or efficient.

There has been long the desire of retail paint sellers to have fast acting, relatively inexpensive, automatic or manually operated fluid dispensers that can readily and efficiently mix a variety of colorants to obtain and reproduce whatever paint color the customer desires. There has also been a need for beauty shops to have available fast, efficient and inexpensive hair dye dispensers so that a customer can have available a wide variety of colors to quickly select from.

SUMMARY OF THE INVENTION

In accordance with the present invention there is provided novel and unique automatic and manual colorant and hair dye dispensers that are easy to operate and provides precision mixing of a large number of colorants and hair dye to make an almost infinite number of colors. The machines are relatively light in weight, easy to operate and maintain and the various components can be readily and easily replaced. In the colorant dispenser this is principally due to the fact that the colorant canisters are supported by a central column and the conventional use of a massive turntable supporting the canisters have been eliminated. In both the automatic and manual illustrated embodiments there is shown six (6) pie-shaped triangular canister units (dispensing units) each including three (3) separate colorant receptacles. There can be more or less dispensing units as desired.

The pump means preferably comprises a valve mechanism, said valve mechanism comprising a rotatable valve element with a sealing surface, said sealing surface lying in a substantially flat plane. Due to such flat sealing surface a small deviation in the fabrication of the rotating valve element, for instance in the thickness of the valve discs does not lead to difficulties in keeping the valve sealed.

In a preferred embodiment the valve mechanism is designed so that the pressure obtained by pressurizing the liquid in the pump promotes the sealing between the two valve elements, i.e. the pressure of the fluid presses the flat sealing surface of the valve element on a corresponding sealing surface of another part of the valve mechanism (e.g. another valve element).

Preferably the valve mechanism comprises two discs as valve elements which provides for a small dispensing path which prevents clogging of the path and a smaller height of the total pump means.

In a preferred embodiment the sealing surface of the rotatable valve element and/or the corresponding sealing surface of another part of the valve mechanism (e.g. another valve element) are made out of ceramic material.

Each of the canister units include passageways leading from each of the separate colorant receptacles to individual pumps connected to the front of its respective canister. The triangular canister units are supported on a central movable column that is located in a support secured to a fixed base plate about which the canisters rotate. This simple constructions allows the canister units to be removed and replaced with ease.

In the fully automatic colorant and hair dye dispensing systems the individual pump systems secured to the front of their respective canisters are programmed to extract the required amount of a given colorant or tint from its respective receptacle. Then by means of an automatic valve control system the prescribed quantity of fluid from the receptacles is directed into a receiving container located below an outlet orifice.

At the dispensing station where the container collecting the colorant and hair dye is located the automatic or manual valve control systems are located to control the flow of colorant or hair dye from the pumps to the container.

In the automatic colorant versions the system for rotating the canister assemblies into position for emptying the contents of the individual pumps consists of a simple motor driven worm drive mechanism that rotates a canister unit and thus the movable column that carries with it all of the canister assemblies connected thereto. To accomplish this the bottom of each canister unit includes a pin that engages and is driven by the worm to accurately move the canister units through a predetermined angle along with the other canisters secured to the central column to which they are connected about a column support secured to a stationary base plate. The travel of the worm is programmed to sequentially move a complete canister assembly through 3 separate increments to place each of the receptacles of a single canister assembly into the dispensing station position where its respective pump and automatic valve control means are actuated to dispense its contents.

The worm and containers are designed so that a pin depending from its respective canister unit engages the worm so the complete canister assembly is moved to place the pumps connected to a second canister assembly into position to be actuated by the automatic valve control system, etc. until the colorants selected to provide a specific color that has been dispensed. By way of example, if there are six (6) canisters each providing three (3) colorants to be mixed, the worm, when driven, will move the entire canister assembly 20° each time it is actuated. The program for operating the various motors for the worm, pumps and valve control mechanism will be set to operate the canisters, pumps and valve control mechanism for the requisite time periods.

There remains to be described two (2) additional major assemblies that are essential to fluid dispenser systems. These include a stirring mechanism and a cleaning system. A cleaning system for a colorant dispenser is generally conventional in nature and thus has only generally been illustrated in the colorant dispenser device forming the subject of applicant's new and novel designs.

Stirring systems for mixing the colorants to maintain a readily flowable consistent mixture are employed in the systems to insure uniformity.

It remains to note that the automatic and manual operated colorant dispensers forming applicant's invention are identical in many respects and mainly differ in that (a) in the automatic version the dispenser actuator system for dispensing the colorant is automatically controlled by a program and in the manual system a handle is operated to regulate the flow from the pump which has been filled by a motor operated filling system and (b) the worm drive has been eliminated and the canisters are turned by hand.

In the automatic hair dye dispensing system the valve operating and actuation control systems are identical to those found in the automatic colorant dispenser. However, in the hair dye system the adaptors containing the hair dye containers are, preferably via a dispensing unit, mounted on a turntable driven by a worm drive mounted on a support plate. The adaptors include pins that are engaged by the worm drive to rotate the adaptors and the turntable to which they are connected. The dispenser also includes peroxide containers that are fixed in position and are motor operated to dispense the requisite amount of peroxide along with the hair dye at the dispensing station.

There is also provided a semi-automatic hair dye system that is essentially identical to the fully automatic system except (1) that the worm drive has been eliminated and the turntable is turned by hand, and (2) in the area of the dispenser actuator system the automatic version of the dispenser actuating system has been replaced by the same semi-automatic manually operated system used with the semi-automatic/manual colorant dispenser system.

It remains to note that in a third hair dye version the dispenser actuating system is similar to that used in the semi-automatic system except that whereas in the semi-automatic/manual system the setting of the dye quantity to be dispensed is manually determined by the weight of the dye dispensed instead of a programmed stepping motor adjusting a limit control plate.

Other features and advantages will be clear from the following drawings in which:

FIG. 87 is a perspective view of the base plate, stirring mechanism and bridge assembly;

FIG. 88 is a plan view of the assembly shown in FIG. 87;

FIG. 89 is an enlarged partial top view of the encircled portion of FIG. 88;

FIG. 90 is a side elevation of the assembly of FIG. 88;

DETAILED DESCRIPTION OF THE INVENTION

Figure 1:
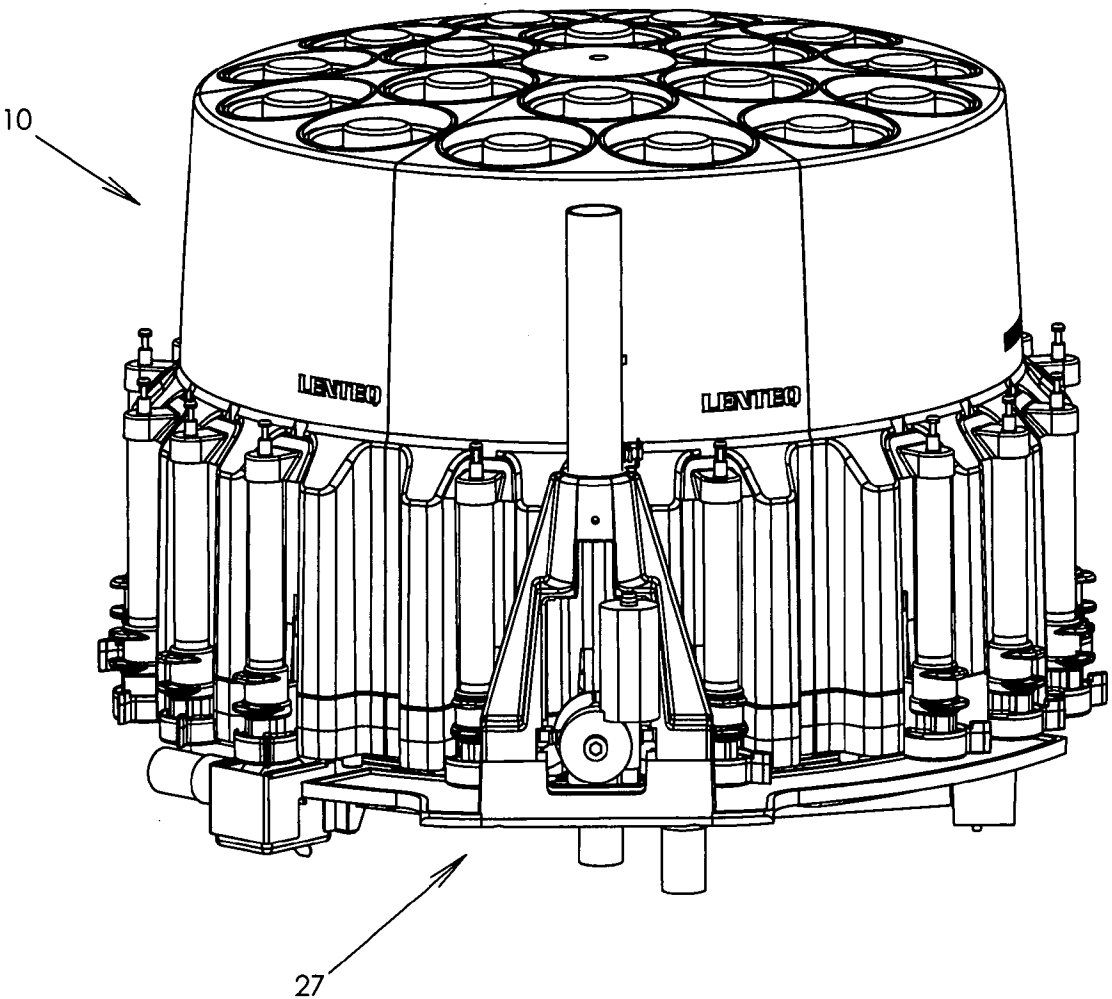
FIG. 1 is a perspective view of an automatic fluid dispenser.

Referring now to the drawings there is shown in FIGS. 1–5 perspective and orthographic views of the automatic colorant dispensing apparatus of the invention which apparatus in its entirety is indicated generally by reference numeral 10. The automatic colorant dispensing apparatus 10 is comprised of a series of canisters that are centrally mounted and rotated to be positioned in front of a dispensing station where preselected quantities of colorant materials are dispensed from the canisters at a dispensing station. It is understood that other types of fluids or materials besides colorants can be dispensed such as inks, or food, or other liquids as may be required. Each of the canisters have pumps connected thereto. At the dispensing station an actuating assembly is located and programmed to set the quantity the pump is to dispense and includes various control mechanisms to operate the pumps and associated valves to dispense the precise amount to be dispensed. For the input and output of data a touch-screen may be used.

Each of the aforementioned components will be described in detail hereinafter beginning with the basic support and canister supply portion of the novel automatic fluid dispensing apparatus.

Figure 6:
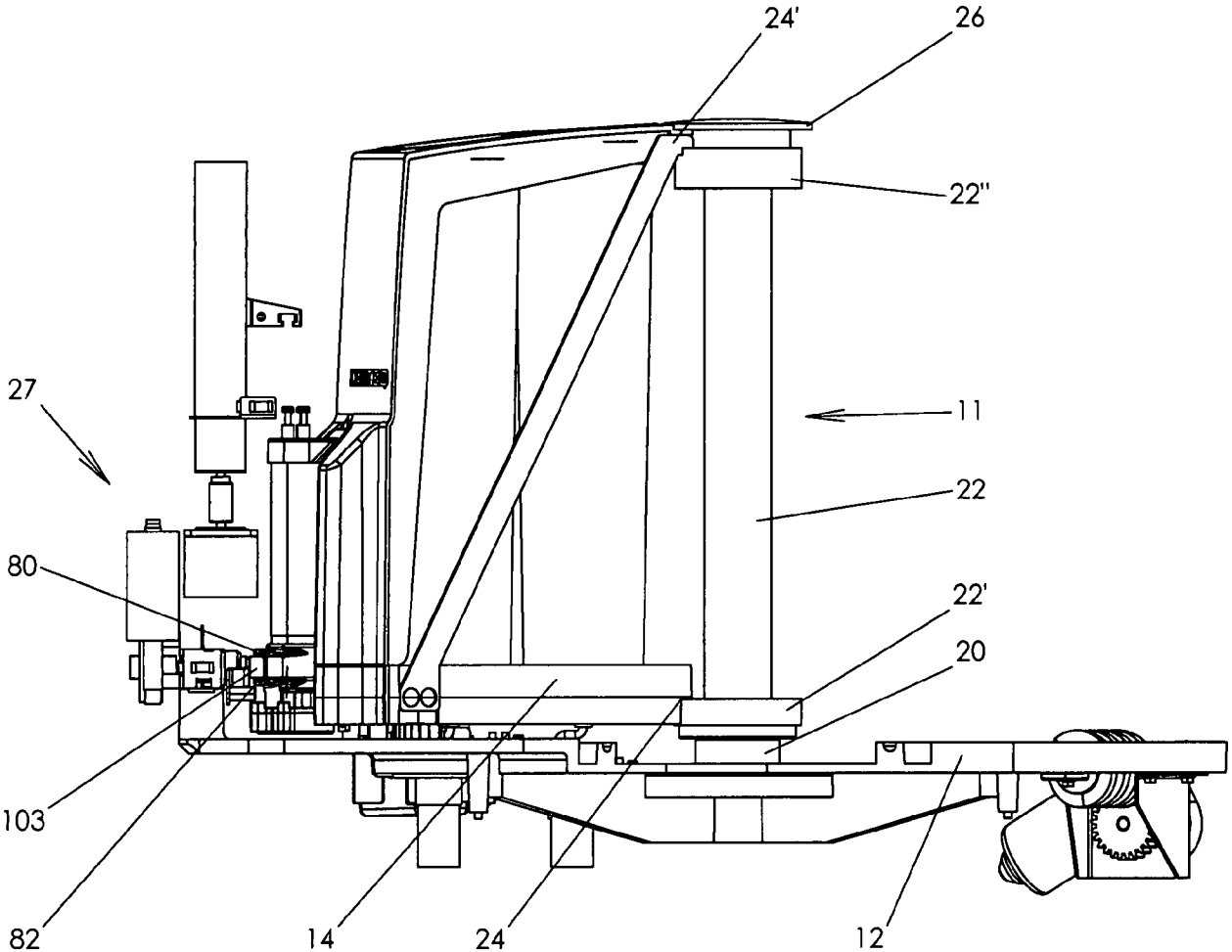
FIG. 6 is a partial cross-sectional view illustrating a canister segment supported on a central movable column that is in turn supported on a base plate, pumps mounted on the canister, a motor operated valve control mechanism for operating the pumps and controlling the flow therefrom and a motor operated worm for rotating the canister assemblies relative to the base plate.

The basic support structure includes as shown in FIG. 6 an upstanding, vertical mounting column assembly 11 and an aluminum-die-cast, support base plate 12 that supports the vertical mounting column assembly 11. The containers for the colorants to be mixed consists of a series of identical, individual, separable, independently-mounted, wedge-shaped canister-segments 14 (see FIG. 7) that are cantilever-mounted to the vertical mounting column assembly 11. Each canister-segment 14, in the preferred embodiment, is made of a one-piece molded plastic to form three cylindrical openings or canister-receptacles. The three canister-receptacles include one interior, or radially-inward, canister-receptacle 15, and two exterior, or radially-outward, canister-receptacles 16A, 16B, with each canister-receptacle conventionally storing a specific colorant to be dispensed when formulating a particular color.

Figure 2:
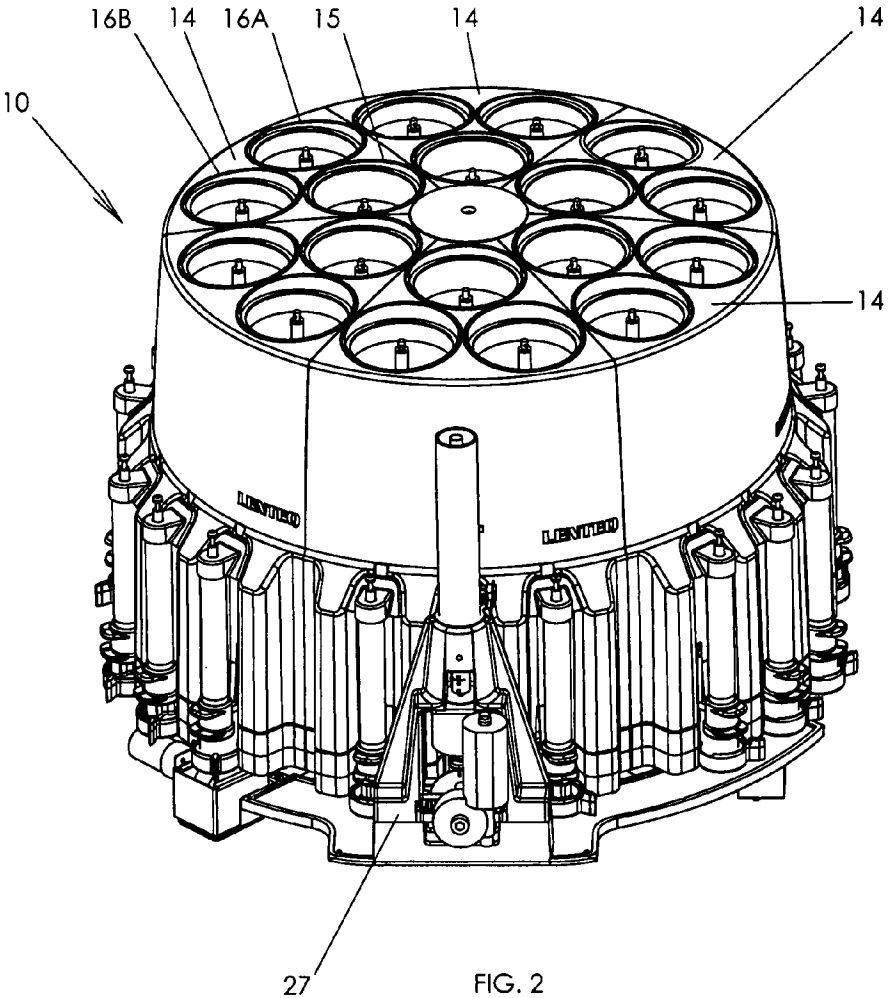
FIG. 2 is a perspective view of an automatic fluid dispenser in a slightly tilted forward position from that shown in FIG. 1.
Figure 3:
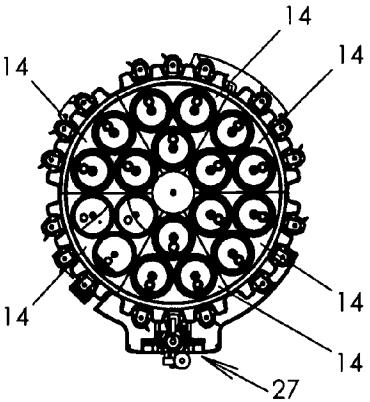
FIG. 3 is a top view of the fluid dispenser shown in FIG. 1.
Figure 4:
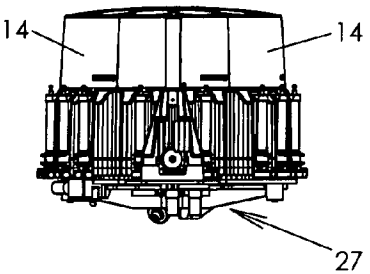
FIG. 4 is a front view of the fluid dispenser of FIG. 1.
Figure 5:
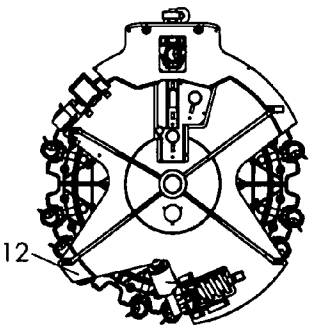
FIG. 5 is a bottom view of the fluid dispenser of FIG. 1.

In the preferred embodiment, there are provided a total of six canister-segments 14, to thus provide a total of six interior canister-receptacles 15, and a total of twelve exterior canister-receptacles 16A, 16B. The three canister-receptacles 15, 16A, 16B of each canister-segment 14 form a triangular pattern or layout when viewed from the top. As seen in FIGS. 1–3, the imaginary centers of the canister-receptacles preferably, but not requisitely, forming the vertices of an equilateral triangle. Since each canister-segment 14 is made of a one-piece molded thermoplastic resin material, it is not only relatively inexpensive to make and replace, but it is also relatively lightweight. This allows for its cantilevered-type of support by the central, upstanding, vertical mounting column assembly 11, and, therefore, ease of removal from the apparatus 10 for refilling of the canister-receptacles with colorant, for cleaning, or for replacement when worn or broken.

Referring again to FIG. 6, the upstanding, vertical mounting column assembly 11 is shown in greater detail supporting a canister-segment 14. The upstanding, vertical mounting column assembly 11 consists, firstly, of an upstanding hub 20 that is formed integrally with the mounting base plate 12. Preferably, the base plate 12 with hub 20 is formed by an aluminum casting process, to form a one-piece unit. Rotatably mounted in the upstanding hub 20 is a support column 22 with an enlarged, concentric lower flange 22', and an enlarged, concentric upper flange 22". The flanges 22', 22" provide an interior, annular open volume which allows lower mounting hooks or brackets 24, and upper mounting hooks or brackets 24' provided on each canister-segment 14 to be received and supported. Thus, each canister-segment 14 is supported or suspended at its upper and lower ends in a cantilever-like fashion, wherein the series of canister-segments 14 are arranged circularly about the support column 22. Such a mounting arrangement is possible because of the lightweight construction of each canister-segment 14, and such mounting arrangement allows for an easy and quick removal of any canister-segment 14 and replacement thereof. A top cover plate 26 closes off the upper end of the support column 22. Moreover, this mounting arrangement allows for a daisy-wheel type of operation of the apparatus where any canister-receptacle of any canister-segment 14 may be located at a dispensing station 27 for measured or metered dispensing of its contents, as described hereinbelow.

Figure 7:
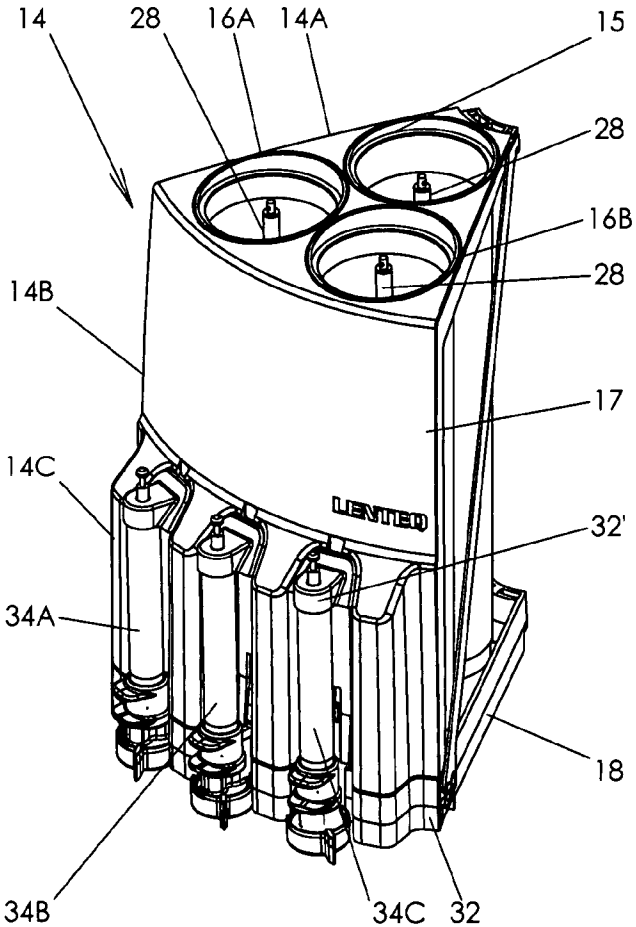
FIG. 7 is a front perspective view of a canister segment with three (3) pumps mounted thereon for dispensing paint tints from its respective receptacle.
Figure 8:
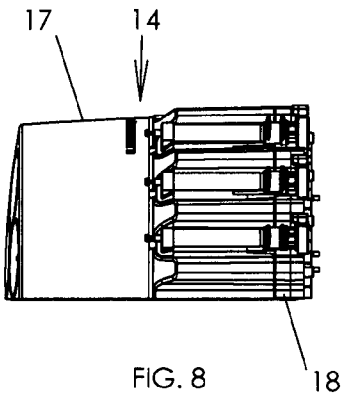
FIG. 8 is a front view of the canister segment of FIG. 7 laid on its side.
Figure 9:
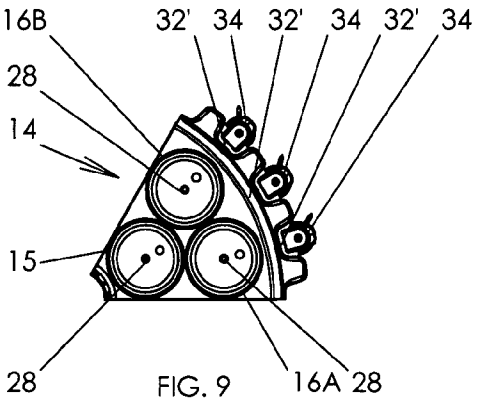
FIG. 9 is a top view of the canister segment of FIG. 7.
Figure 10:
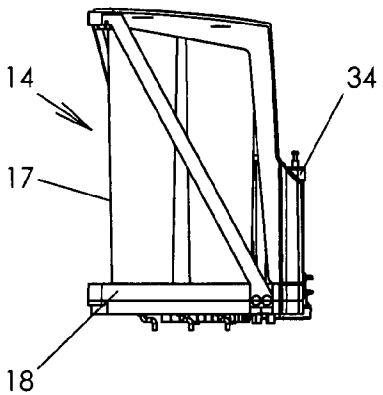
FIG. 10 is a side view of the canister segment of FIG. 7.
Figure 12:
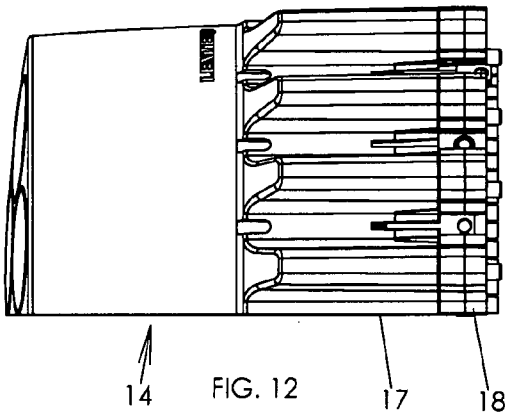
FIG. 12 is an elevational view of the canister segment of FIG. 11 shown on its side.
Figure 11:
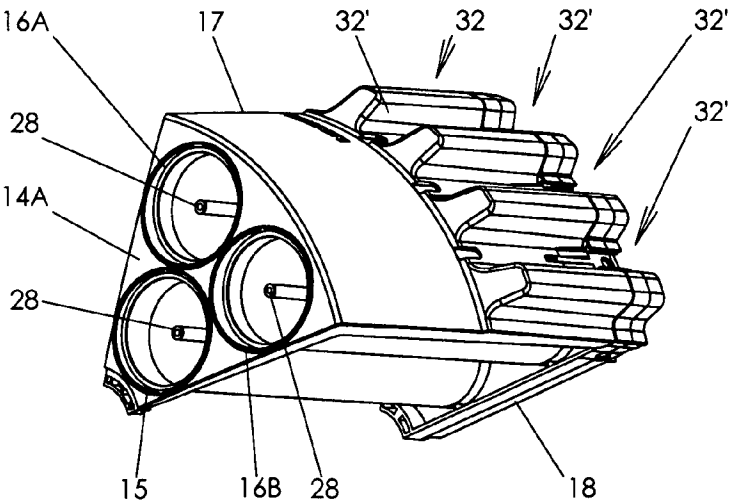
FIG. 11 is a tilted perspective view of the canister segment of FIG. 7.
Figure 14:
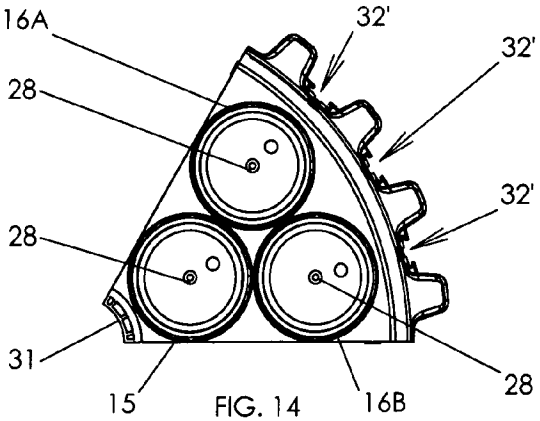
FIG. 14 is a bottom view of the canister segment of FIG. 11.
Figure 13:
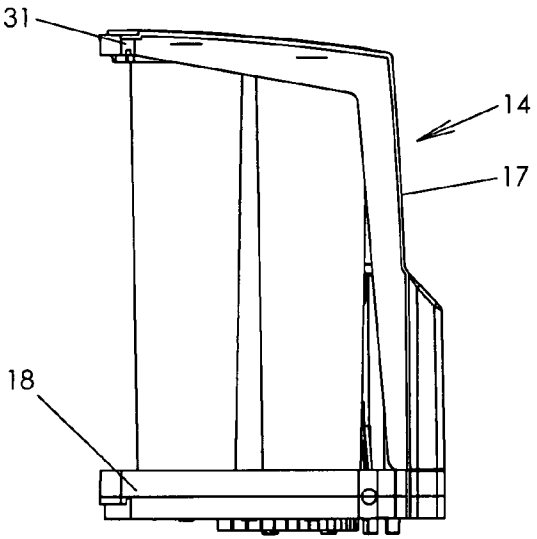
FIG. 13 is an elevational view of the canister segment of FIG. 11 shown in the upside-down position.
Figure 16:
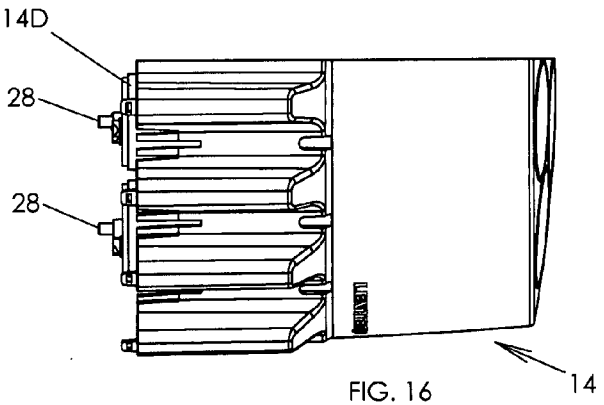
FIG. 16 is a side elevational view of the canister module of FIG. 15 placed on its side.
Figure 15:
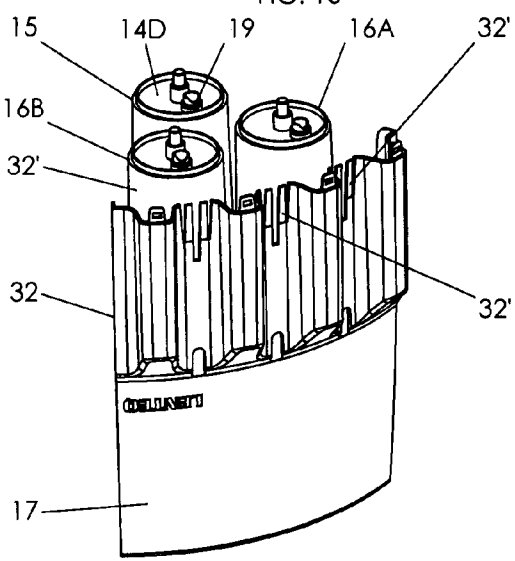
FIG. 15 is a perspective view of the top canister module in an upside-down position.
Figure 18:
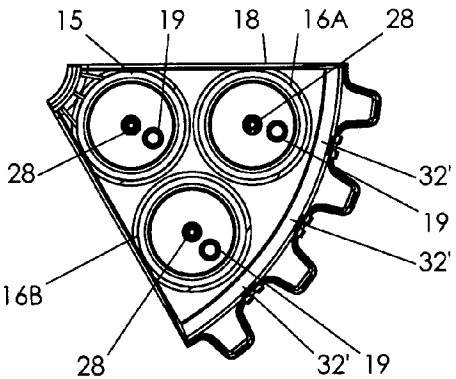
FIG. 18 is a bottom view of the canister module of FIG. 15.
Figure 17:
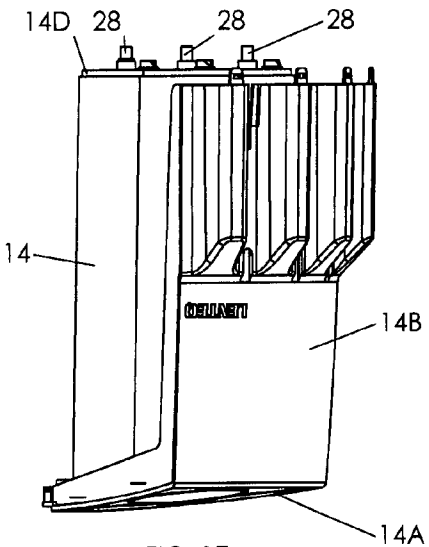
FIG. 17 is a side elevational view of the canister module of FIG. 15 in an upside-down position.
Figure 20:
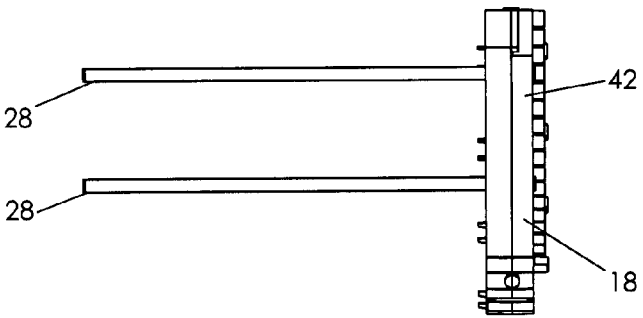
FIG. 20 is an elevational view on its side of the bottom canister module.
Figure 19:
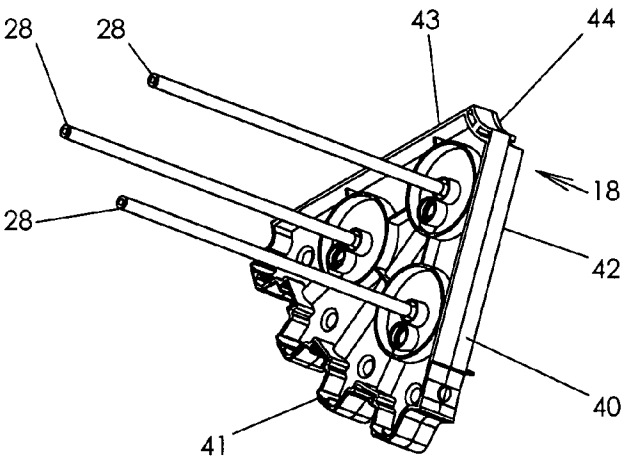
FIG. 19 is a perspective view of the bottom canister module.
Figure 22:
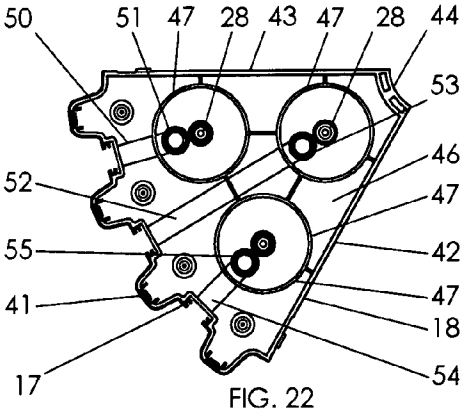
FIG. 22 is a top view of the bottom canister module.
Figure 21:
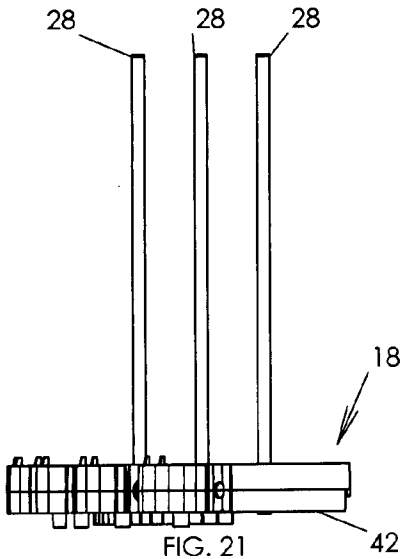
FIG. 21 is an elevational view of the bottom canister module including stirring rods.

Referring now to FIGS. 7–24, there is shown the above-mentioned canister-segment 14, it being understood that each such canister-segment 14 is identical in construction. The canister-segment 14 is made up of two separate parts: A top, one-piece molded main body part 17, best seen in FIGS. 11–18, and a one-piece molded bottom part or portion 18, best seen in FIGS. 19–22, with the two parts 17, 18 being snap-fitted together. Each part is preferably a one-piece injection-molded part made of POM having 0–40% glass-filling. The top main body part 17 consists of the above-mentioned three canister-receptacles 15, 16A, 16B suspended from the top surface 14A of canister segment 14. Within each canister-receptacle 15, 16A, 16B there is provided a central tube 28, which tube 28 projects or protrudes downwardly and outwardly beyond the bottom surface 14D of the canister receptacles 15, 16A and 16B, as best seen in FIG. 15. The bottom surface 14D is also provided with an outlet tube-opening or orifice 19, as best seen in FIG. 18, through which the contents of the respective canister-receptacle 15, 16A, 16B are dispensed. Each tube 28 is provided with a substantially hollow core in which is received an agitation or stirring drive rod or shaft projecting downwardly through holes in the bottom wall of the receptacles, as discussed in detail hereinbelow. The upper, one-piece molded main body part 17 is provided in its front, forward-facing, exterior surface 14B with an exteriorly-projecting, lower stepped section 32 in which are formed three channels 32' in which are snap-fitted in place three dispensing piston/cylinder pump arrangements 34, as best seen in FIG. 7.

In another embodiment the canister-segment 14 is made up of five separate parts: A top, one-piece molded main body part 17, three separate canister-receptacles 15, 16A, 16B, best seen in FIGS. 11–18, and a one-piece molded bottom part or portion 18, best seen in FIGS. 19–22, with the five parts 15, 16A, 16B, 17, 18, being snap-fitted together. Each part is preferably a one-piece injection-molded part made of POM having 0–40% glass-filling. In both described embodiments each tube 28 may be an integral or a separate part that is made from the same or a different material, such as for instance metal.

Referring to FIGS. 19–24, there is shown bottom part 18 associated with a canister segment 14. Bottom part 18 is a one-piece molded part made of a suitable thermoplastic resin, and consists of a main body portion 40 having a front wall 41, side walls 42, 43, and concave end wall 44. Wall 44 is similar to concave end wall 31 of the upper part 17 for abutting juxtaposition against a respective curved portion of the upstanding, vertical mounting column assembly 11. Molded into the interior surface of the bottom wall 46 of bottom part 18 are three raised circular rings or ribs 47 that snap fit around, or otherwise cooperate with, the bottoms of the three canister-receptacle 15, 16A, 16B. In addition, raised upwardly from the interior surface of the bottom wall 46, are three horizontal hollow ribs or conduits 50, 52, and 54, which terminate in their respective vertically-oriented hole or opening 50', 52' and 54' in front wall 41. The conduit 50 is fluidly connected to the orifice 51, the conduit 52 is fluidly connected to the orifice 53, while the conduit 54 is fluidly connected to the orifice 55, through which there is fluid connection of the contents of three canister-receptacle 15, 16A, 16B with the interior of the respective three dispensing piston/cylinder pump arrangements 34A, 34B and 34C is achieved.

Also projecting upwardly through the bottom wall 46 are the above-mentioned three tubes 28, which pass through the bottom wall 46 via holes formed at the center points of the circular raised ribs. The bottom ends of the tubes 28 project downwardly beyond the lower surface of the bottom wall 46, whereby a stirring rod may be inserted therethrough, to which stirring rod is secured a stirring mechanism for stirring the contents of a canister-receptacle, as discussed below in detail when discussing the stirring procedure. The exterior edge-surface of the main body portion 40 is also provided with three channels or grooves 58 that are in alignment with the three channels 32' of the upper part 17 in which are mounted the piston/cylinder pump arrangements 34A, 34B and 34C. One of the vertical-oriented holes 50', 52' and 54' is located centrally of a respective channel 58.

Figure 24:
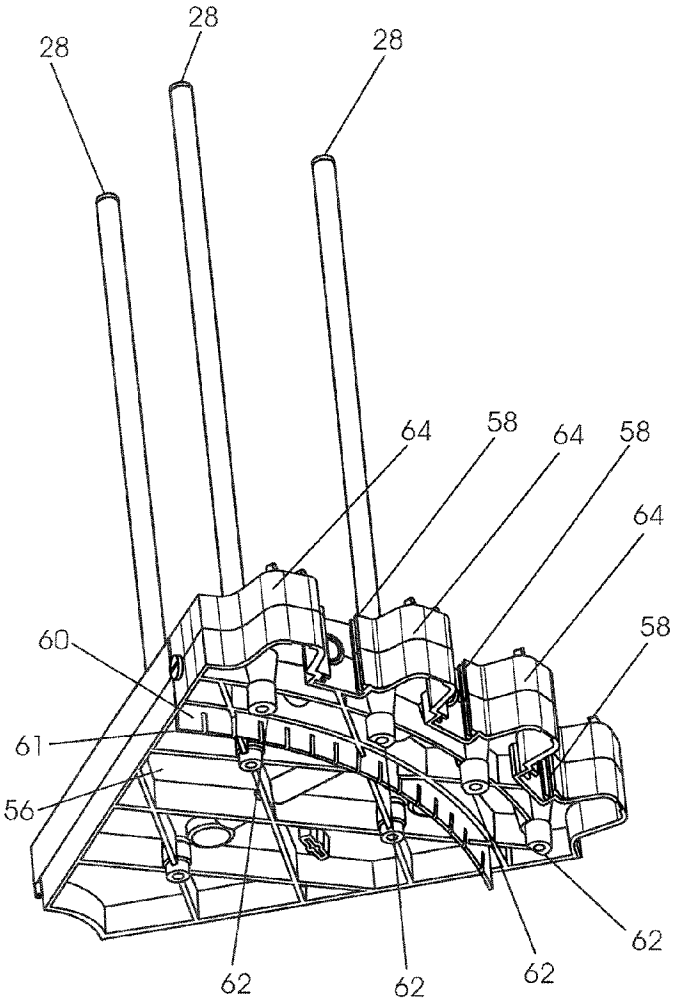
FIG. 24 is a perspective view of the bottom canister module looking at the underside thereof.
Figure 23:
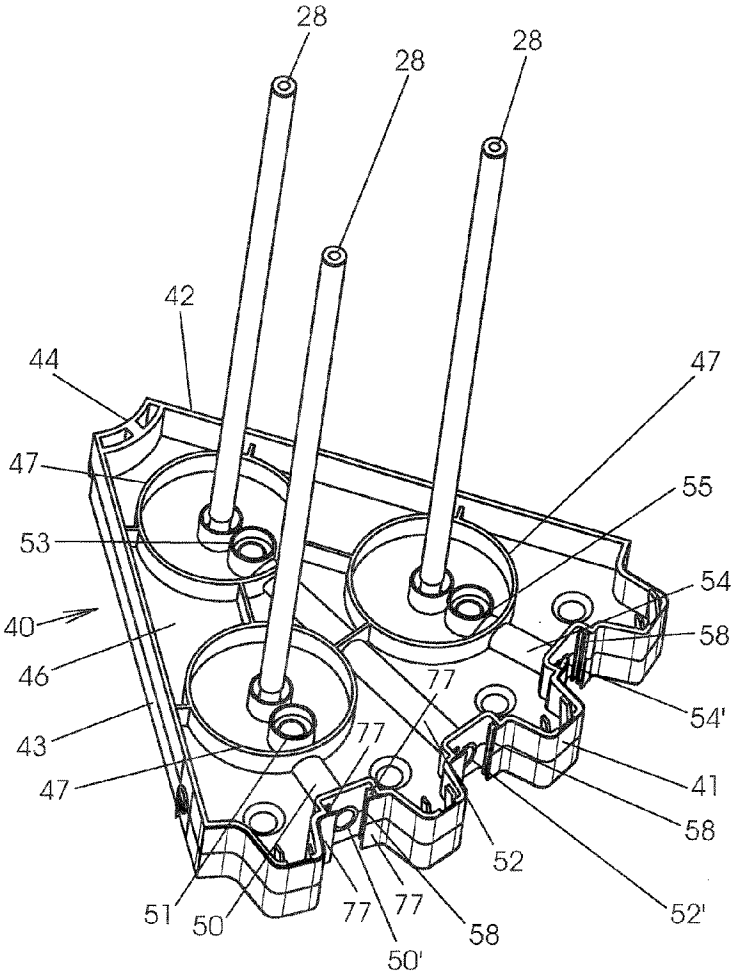
FIG. 23 is a top perspective view of the bottom canister module similar to FIG. 19.
Figure 26:
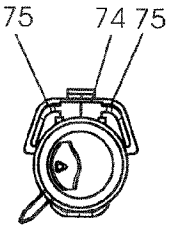
FIG. 26 is a bottom view of the pump valve unit.

Referring to FIG. 24, the exterior or bottom area 56 of the bottom wall 46 of the bottom one piece receptacle 18 is shown. As can be seen, this exterior bottom area 56 is of an open, grid-like construction in order to provide a light weight module, which bottom surface defines a series of grid-squares, from which projects an arcuate plate 60 having a series of notches 61 used in a conventional infrared sensing system for controlling an indexing stepping motor for rotating or indexing the carousel of canister-segments 14 via a worm-gear assembly described hereinbelow. Any other conventional indexing system besides IR may be used, as would be apparent to one of ordinary skill in the art. Also projecting vertically downwardly from the bottom of the bottom receptacle part 18, and through respective grid-squares, are four guide pins or cams 62, which pins 62 are formed on the underside of four convex-shaped protuberances 64 between which are formed the above-mentioned channels 58, as best seen in FIG. 24. The pins 62 are receivable in a worm gear which forms part of a drive mechanism used for indexing, or rotating, the carousel of canister-segments 14, as described hereinbelow. As can be seen in FIG. 24, the hollow bottom end-portions 28' of the tubes 28 in the canister receptacle 15, 16A, 16B project downwardly.

Figure 25:
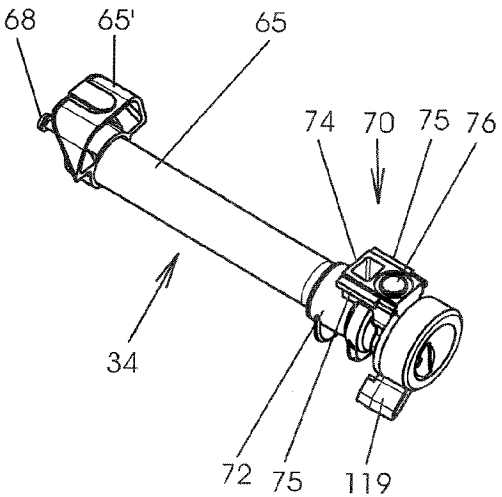
FIG. 25 is a perspective view of a single pump valve unit.
Figure 27A:
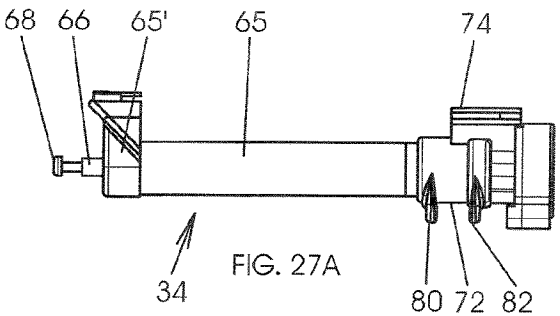
FIGS. 27A, 27B and 27C are front, rear and side elevational views of the pump-valve unit.
Figure 27B:
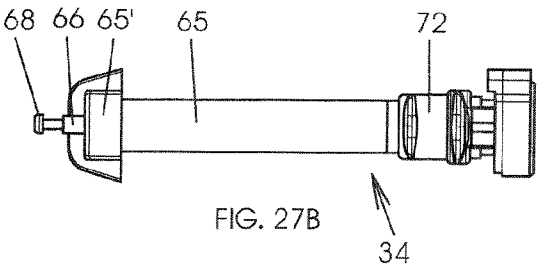
Figure 27C:
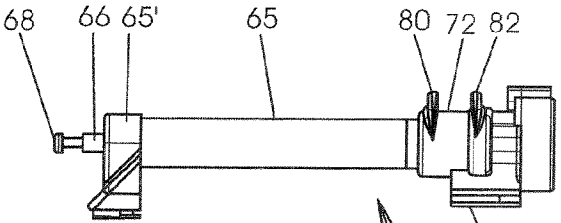
Figure 28:
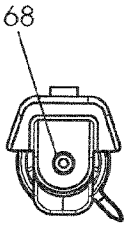
FIG. 28 is a top view of the pump-valve unit.
Figure 29:
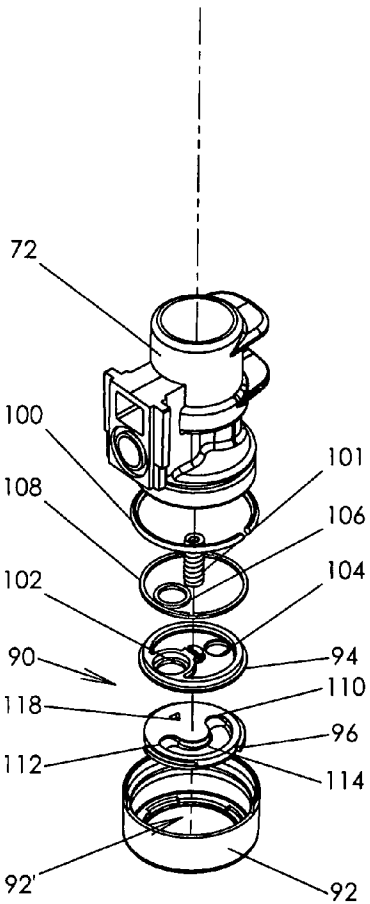
FIG. 29 is an exploded perspective view of the bottom assembly of the pump-valve unit.
Figure 30:
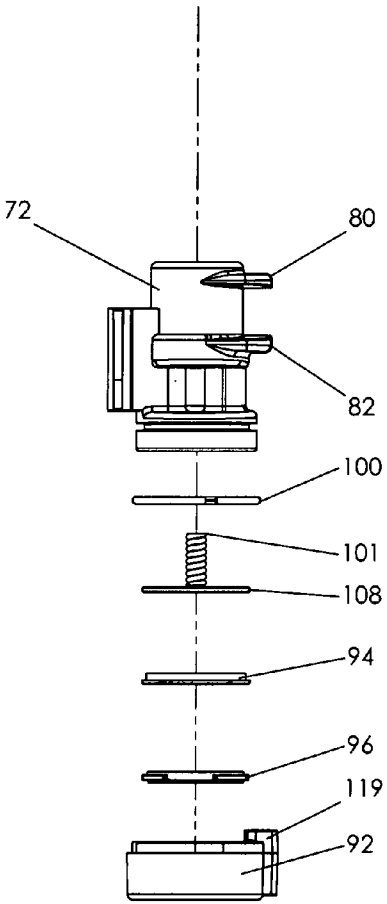
FIG. 30 is an exploded front view of the bottom assembly of the pump-valve unit.
Figure 31:
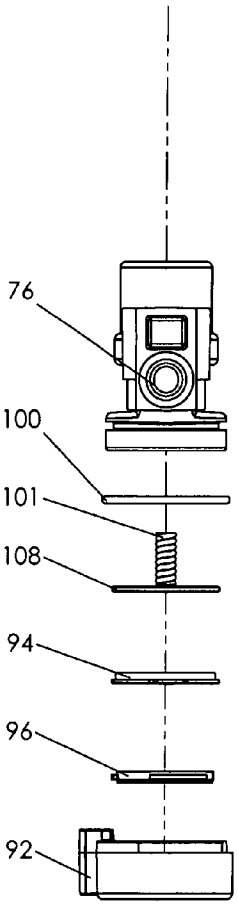
FIG. 31 is an exploded side view of the bottom assembly of the pump-valve unit.
Figure 33B:
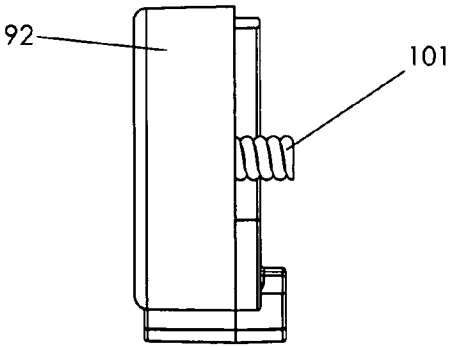
FIGS. 33A, 33B and 33C are top, right and left side views of the valve body.
Figure 32:
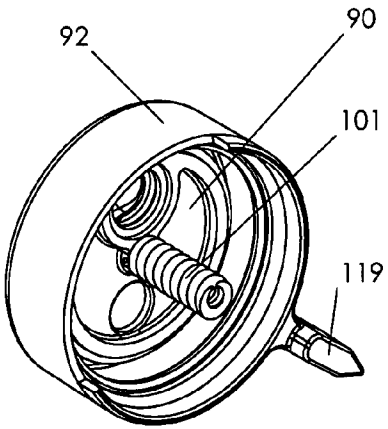
FIG. 32 is a bottom perspective view of the sectional valve body.
Figure 33A:
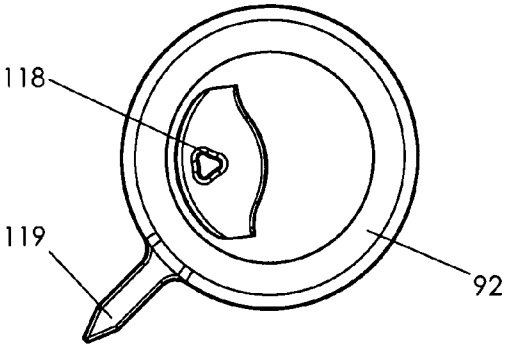
Figure 33C:
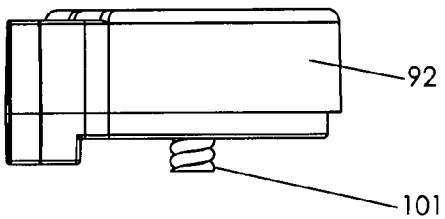
Figure 35:
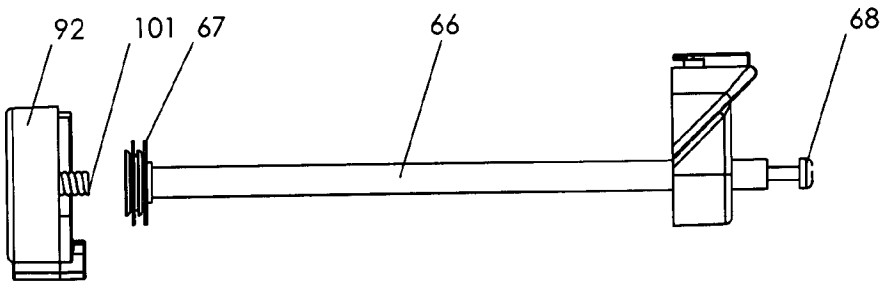
FIG. 35 is a separated view of the pump and valve unit.
Figure 34:
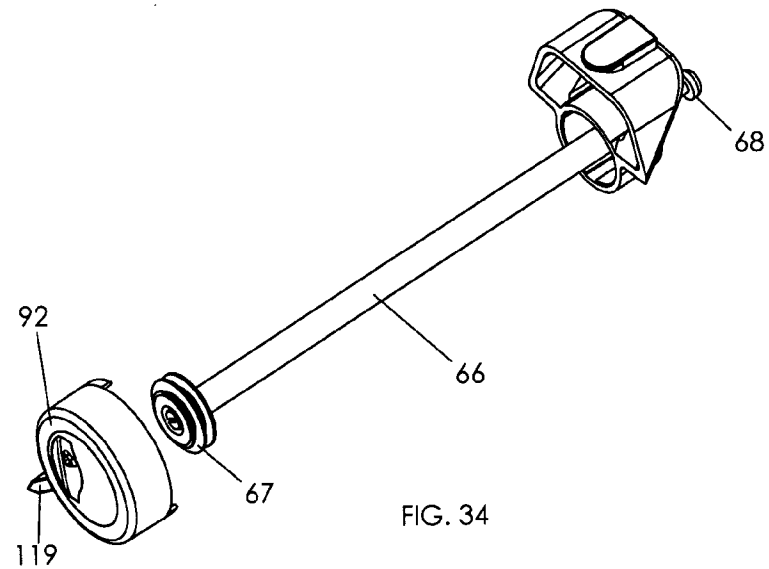
FIG. 34 is an exploded perspective view of the pump-valve unit
Figure 36:
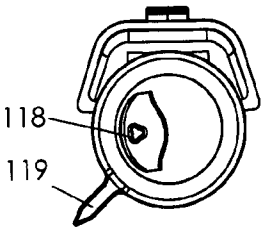
FIG. 36 is a bottom view of the pump-valve unit.
Figure 37:
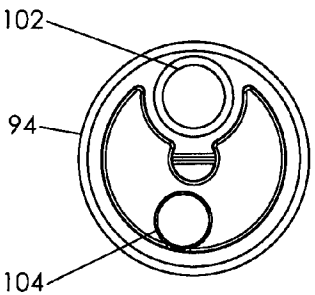
FIG. 37 is a top view of the top valve disc.
Figure 38:
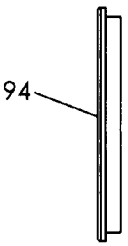
FIG. 38 is a side view of the top valve disc.
Figure 41:
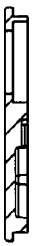
FIG. 41 is a sectional view taken along line B—B of FIG. 39.
Figure 39:
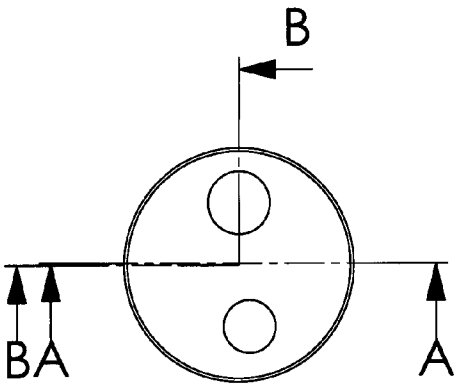
FIG. 39 is a bottom view of the top valve disc.
Figure 40:
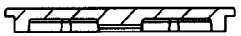
FIG. 40 is a sectional view taken along line A—A of FIG. 39.
Figure 42:
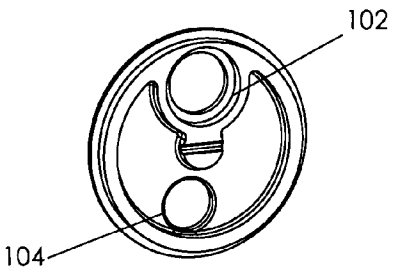
FIG. 42 is a top perspective view of the top valve disc.
Figure 43:
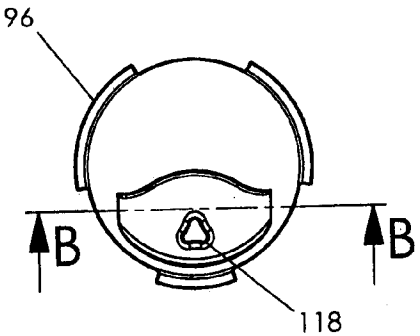
FIG. 43 is the bottom view of the bottom valve disc.
Figure 44:
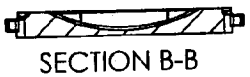
FIG. 44 is a sectional view taken along line B—B of FIG. 43.
Figure 48:
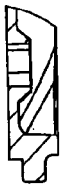
FIG. 48 is an enlarged view of the circled c portion of FIG. 47.
Figure 47:
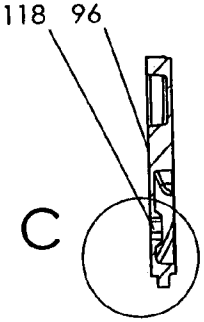
FIG. 47 is a view taken along line A—A of FIG. 45.
Figure 46:
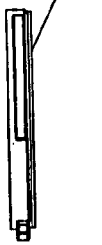
FIG. 46 is a side view of the bottom valve disc.
Figure 50:
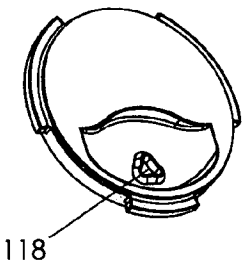
FIG. 50 is a perspective view looking at the bottom of the bottom valve disc.
Figure 45:
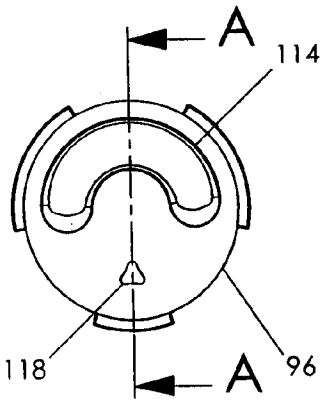
FIG. 45 is the top view of the bottom valve disc.
Figure 49:
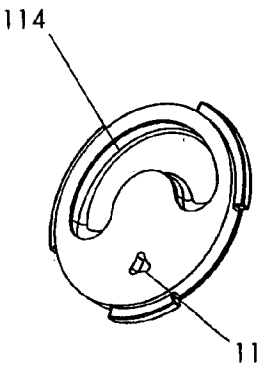
FIG. 49 is a perspective view looking at the top of the bottom valve disc.
Figure 51:
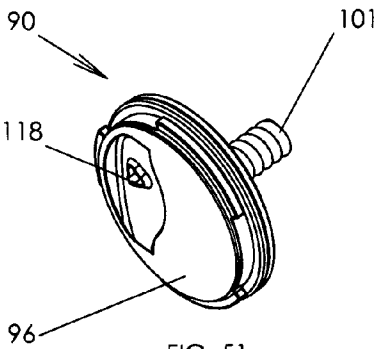
FIG. 51 is a bottom perspective view of the assembled ceramic discs.
Figure 52:
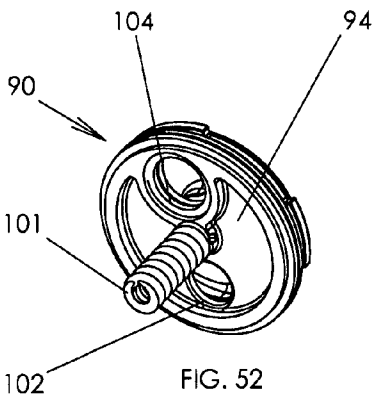
FIG. 52 is a top perspective view of the assembled ceramic discs.
Figure 53:
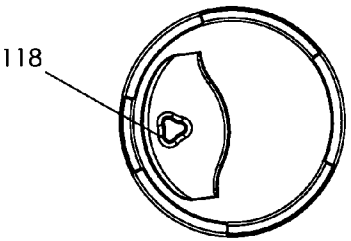
FIG. 53 is a bottom view of the assembled ceramic discs.
Figure 54:
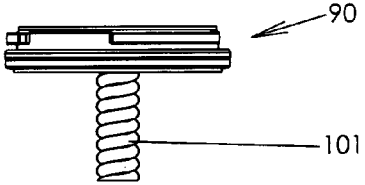
FIG. 54 is a side view of the assembled ceramic discs.
Figure 55:
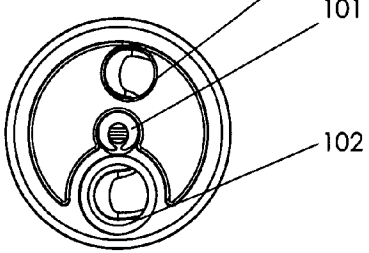
FIG. 55 is a top view of the assembled ceramic discs.
Figure 56:
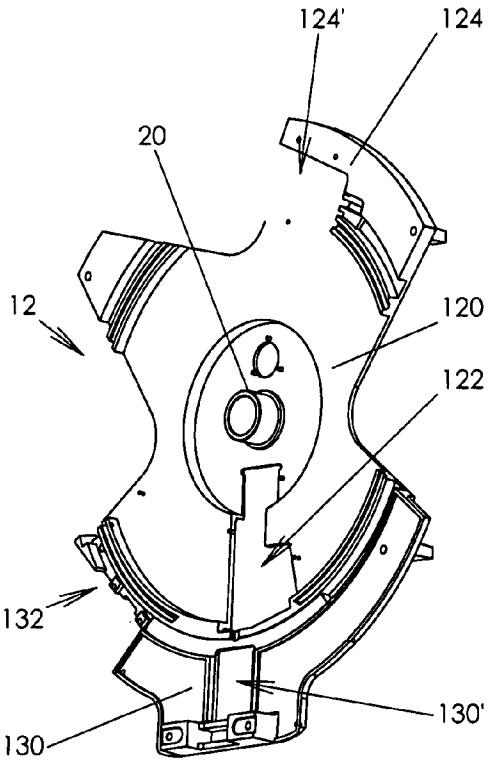
FIG. 56 is a perspective view of the bottom base plate.
Figure 57:
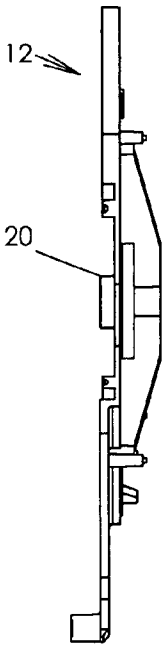
FIG. 57 is a side view of the bottom base plate.
Figure 58:
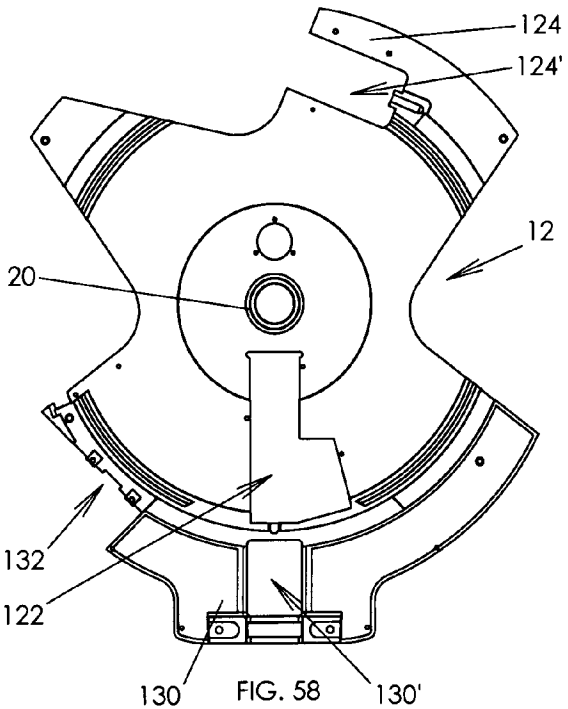
FIG. 58 is a top view of the bottom base plate.
Figure 59:
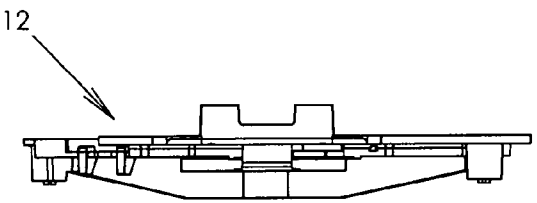
FIG. 59 is a front view of the bottom base plate.

Referring to FIGS. 25–35, there is shown one of the identical above-discussed dispensing piston/cylinder pump arrangements 34. Each dispensing piston/cylinder pump arrangement 34 is used for drawing out the required measurement or amount of colorant from the interior of a canister-receptacle 15, 16A, 16B with which it is associated. This measuring, or metering, process is achieved by pumping out a metered amount of colorant from its respective receptacle and then dispensing it. As in prior-art colorant dispensing apparatuses, a valve is used to first connect the interior of the dispensing piston/cylinder pump arrangement 34 with an above-discussed respective vertically-oriented hole or opening 50', 52' and 54' in bottom module 18. Referring to FIG. 25, there is shown a dispensing piston/cylinder pump arrangement 34, that consists of a main cylinder housing 65 in which reciprocates a piston rod 66 with attached piston 67 in the conventional manner. The upper end of the piston rod 66 extends outwardly of the upper end cap 65' of the main cylinder and is provided with an enlarged head 68 in order to provide a gripping section to be gripped by a gripping actuator mechanism described hereinbelow, for first lifting the piston to suck the required and metered amount of colorant content from the respective canister-receptacles 15, 16A, 16B, and for lowering the piston 67 for dispensing that metered amount, as discussed below.

For simplicity a single pump connected to an individual receptacle will be described. The lower end of the dispensing piston/cylinder pump arrangement 34 is provided with the novel valve mechanism of the present invention indicated generally by reference numeral 70. The valve mechanism 70 comprises a main housing or hollow-interior sleeve 72 best seen in FIGS. 25 and 29, which is preferably made of a one-piece, injection-molded, thermoplastic resin material. This sleeve 72 has a rearwardly-extending box-shaped section 74 in which is formed a horizontal orifice or passageway 76 defining an interior or radially-inwardly facing vertically-oriented hole that is aligned and in fluid communication with a respective vertically-oriented hole or opening 50' of an associated canister-receptacle 16A described above. The horizontal orifice or passageway 76 communicates at its other end with an interior vertical passageway or orifice in the lower end of the main cylinder 65, whereby colorant from the respective canister-receptacle 16A is in fluid communication with interior vertical passageway or orifice in the lower end of the main cylinder 65. This interior vertical passageway or orifice in the lower end of the main cylinder 65, at its other end, is also in fluid communication with, or exits into, a first hole or opening of dispensing control valve mechanism described hereinbelow.

The rearwardly-extending box-shaped section 74 is appropriately shaped with horizontally-projecting side flanges 75 that are received in a snap-fit type of connection between a pair of vertical retaining camming elements 77 associated with a respective channel 58 of a bottom part 18 of a canister-segment 14 described above, and as best seen in FIG. 23. The main housing or hollow-interior sleeve 72 also is provided with a pair of vertically-spaced apart, radially-outwardly, externally-facing flanges or plates 80, 82 between which is guided and received a retaining element of the dispensing-actuator discussed hereinbelow, so that, when the actuator mechanism lifts the piston rod 66 via the head 68, the entire canister-segment 14 is not lifted up therewith, which would otherwise occur owing to the above-described cantilevered-mounting of the canister-segments 14. Thus, when the actuator mechanism lifts the piston rod 66 to suck in a metered amount of colorant, the reaction between retaining element of the dispensing-actuator and the lower flange 82 prevents such lifting of the canister-segment 14.

Mounted to and below the main housing or hollow-interior sleeve 72 is a two-way rotatable valve indicated generally by reference numeral 90. The valve 90 includes a main housing 92 defining an interior hollow volume and an open circular bottom opening 92'. Mounted within the hollow volume of housing 92 are two circular ceramic valve-plates, an upper one 94 and a lower one 96. The interior annular surface of the main housing 92 is provided with a suitable circular ridge for mounting the plates with o-ring 108 sealing the lower ceramic plate 96 therein. The lower ceramic plate 96 is rotatable relative to the upper ceramic plate 94, as described herein. The housing 92 is mounted to the lower end of the main housing 72 by telescoping the main housing 92 over the lower end of the main housing 72 and securing them tightly in place via an o-ring 100 between the interior annular surface of the main housing 92 and the exterior annular surface of the juxtapositioned main housing 72. The upper and lower ceramic plates are resiliently held in abutting relationship by the spring 101. The upper ceramic plate 94 is provided with a first raised opening or hole 102 and a second lower opening or hole 104. Another O-ring 106 sealingly connects the raised opening 102 with the bottom hole of the interior vertical passageway or orifice in the lower end of the main cylinder 65, as described above, whereby fluid communication is established between the raised opening or hole 102 and the dispensing orifice of the respective canister-receptacle 16A and whereby rotation of the upper disc or plate 94 is prevented relative to the main housing 72. The second opening or hole 104 is in fluid communication with an opening or orifice formed in the bottom of main cylinder 65 which provides fluid communication with the interior of the main cylinder.

The bottom plate 96 is provided with a pair of diametrically-opposed holes or openings 110, 112 interconnected by an arcuate, or banana-shaped, trough or depressed channel 114. Another, triangular-shaped hole or opening 118 is provided arcuately between the holes 110, 112 and opposite the arcuate channel 114; this triangular-shaped hole or opening 118 is used to actually dispense the liquid colorant to a container there below when this triangular-shaped hole or opening 118 is rotated into alignment with the unraised or unelevated opening or hole 104 formed in the upper plate 94, as discussed below.

In using the two ceramic valve plates or discs, one first rotates the lower plate 96 such that the opening 112 is in alignment and fluid communication with the opening 102 of the upper plate which simultaneously aligns opening 110 of the lower plate with opening 104 of the upper plate. This positioning means that the output orifice of the respective canister-receptacle 16A is in fluid communication with the interior of the main cylinder 65, openings 102 and 112, arcuate trough 114, opening 110 in the lower valve disc 86, and finally opening 104 in the upper valve disc 94. In this position, the actuator mechanism described hereinbelow may then lift the piston rod 66 the requisite distance to suck up the desired or metered amount of colorant into the interior of the main cylinder 65. After the proper amount has been metered, the lower disc 96 is then rotated in an opposite direction by the below-discussed actuator mechanism via exteriorly-projecting handle 119 of the lower housing 92, where the opening 110 of the lower valve disc is brought out of alignment with the opening 104 in the upper valve disc, thereby disconnecting the fluid communication between the interior of the main cylinder 65 with the exit orifice of the respective canister-receptacle 16A. Further rotation of the lower valve plate 96 aligns the triangular-shaped hole or opening 118 thereof with the opening 104 of the upper valve plate, whereupon the actuator mechanism lowers the piston rod 66 to force out the stored, metered volume of liquid through aligned openings 104, 118, for dispensing into a container.

The disc valve as described has a number of advantages. The disc shaped valve element provides for a flat sealing surface so that small deviation in the fabrication of the valve discs, for instance in the thickness of the valve discs does not lead to difficulties in keeping the valve sealed. Further, the pressure obtained by pressurizing the liquid in the pump promotes the sealing between the two valve elements. Further the use of discs provides for a small dispensing path which prevents clogging of the path and provides for a smaller height of the total pump means.

Referring to FIGS. 56–59, there is shown the support base plate 12 mentioned above, which base plate 12 mounts various operational elements, such as the assembly for effecting rotation or indexing of the carousel-type canister-segments arrangement, the assembly for stirring the contents of a selected canister-receptacles, drive and sensing components necessary for the proper indexing, and the actuating bridge-assembly for actuating the dispensing piston/cylinder pump arrangement 34 of a selectively-positioned canister-receptacle 15, 16A and 16B, as described in detail hereinbelow.

The base plate 12 is made of a one-piece, cast aluminum, and includes a main mounting frame 120 from which projects centrally thereof the above-mentioned hub 20 used for mounting the upstanding, vertical mounting column assembly 11, as described above in detail. The main mounting frame 120 is provided with a number of cutouts and brackets in which various structural and operational components are mounted. Cutout 122 is used for mounting the stirring actuating mechanism described in detail hereinbelow, which stirring actuating mechanism is used to rotate a selected a stirring rod 30 of a respective canister-receptacle 15, 16A and 16B positioned thereat. Mounting bracket 124 is used for the worm-drive assembly, also discussed in detail hereinbelow, which worm-drive assembly is used to rotate or index the carousel-type canister-segments arrangement by engaging with the downwardly-projecting guide pins or cams 62, which pins 62 are formed on the underside of the four convex-shaped protuberances 64 between which are formed the above-mentioned channels 58, as described above with reference to FIG. 24. Bracket 124 has an opening 124' through which projects the actual worm-gear for engagement with these guide pins 62. Bracket 130 is used for mounting the upstanding dispensing and actuating station 27 described herein below in detail, and has an opening or cutout 130' in which the bridge and other operational components thereof of the actuating station 27 are located. The bracket 130 also has a portion 132 thereof which mounts a conventional cleaning or spraying mechanism.

Referring now to FIGS. 60–63, there is shown worm-drive indexing assembly 140 for rotating or indexing the carousel-type canister-segments arrangement. The worm-drive indexing assembly 140 includes a drive motor 142 that drives drive gear assembly 144, which, in turn, rotates worm gear 146. As mentioned above and illustrated in FIG. 60A, downwardly-projecting guide pins or cams 62, which pins 62 are formed on the underside of the four convex-shaped protuberances 64 between which are formed the above-mentioned channels 58, are guided in the groove 146' of the worm gear for indexing, or rotating, the carousel of canister-segments 14, as described above. The length and pitch of the groove 146' of worm gear 146 is such that there is always at least one pin or cam 62 riding therein, where at least one cam or pin 62 from a first canister receptacle and at least one cam or pin 62 of another, directly-adjacent canister receptacle are positioned and guided in the groove 146' in order to ensure that the worm gear is continuously engaged with a canister-segment 14 to achieve the necessary indexing. The worm drive is not only used for rotating the carousel of canister-segments 14 in a first direction in order to position a selected canister receptacle at the dispensing station 27, but is also used for indexing or rotating the carousel of canister-segments 14 in either the clockwise or counterclockwise direction for locating and positioning a selected canister-segment 14 at the dispensing station for purposes of agitating a selected one or two of the canister-receptacles 15, 16A, or 16B of that selected canister-segment 14, even when no dispensing of fluid from a canister-receptacle 15, 16A or 16B is occurring. This agitation occurs at the agitating station mounted in cutout 122 of the base plate 12, as described in detail hereinbelow.

Figure 64:
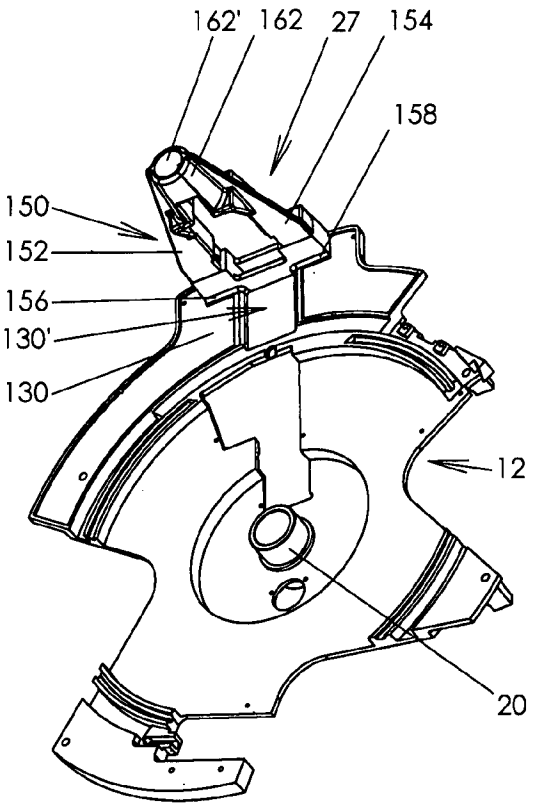
FIG. 64 is a perspective view of the base plate and attached bridge assembly.
Figure 65:
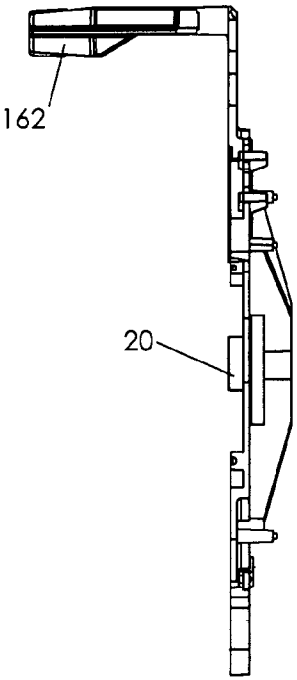
FIG. 65 is a side elevational view of the assembly shown in FIG. 64.
Figure 66:
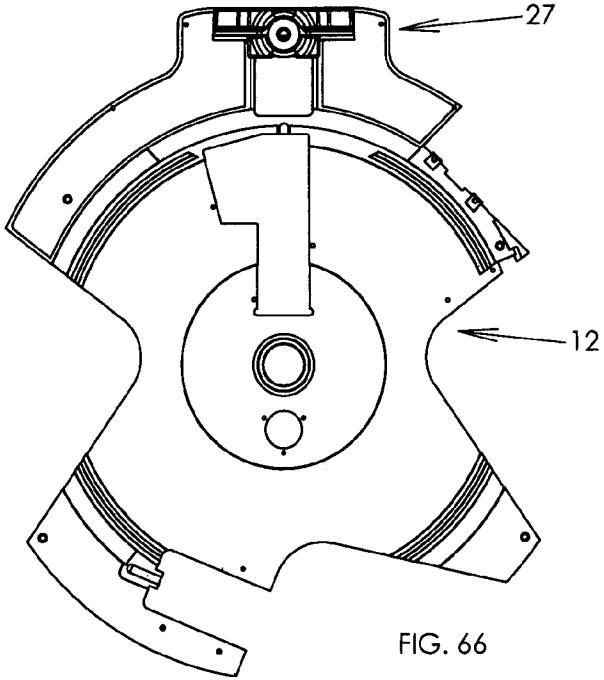
FIG. 66 is a plan view of the assembly shown in FIG. 65.
Figure 67:
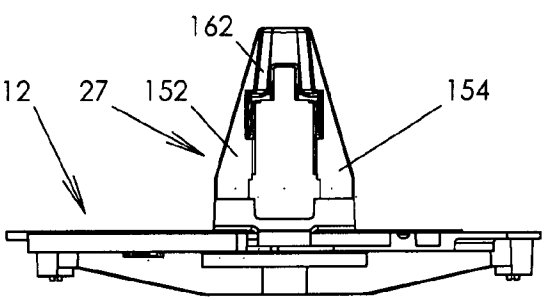
FIG. 67 is a front view of the bridge and plate assembly.
Figure 68:
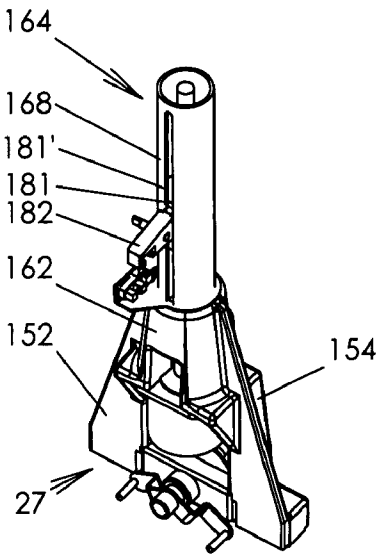
FIG. 68 is a perspective view of the bridge and pump and valve actuating assembly.
Figure 71:
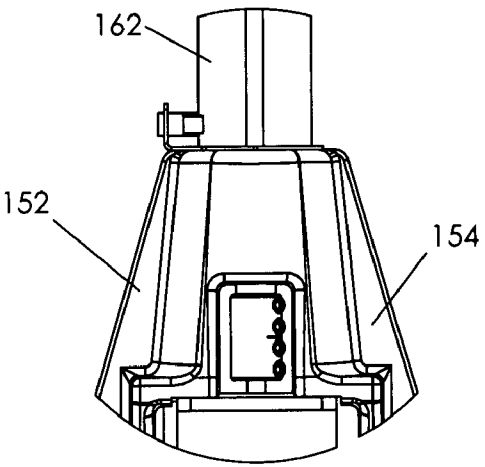
FIG. 71 is an enlarged front view of the portion encircled in FIG. 70.
Figure 69:
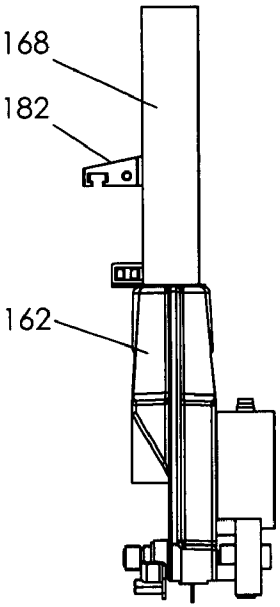
FIG. 69 is a side view of the assembly shown in FIG. 68.
Figure 70:
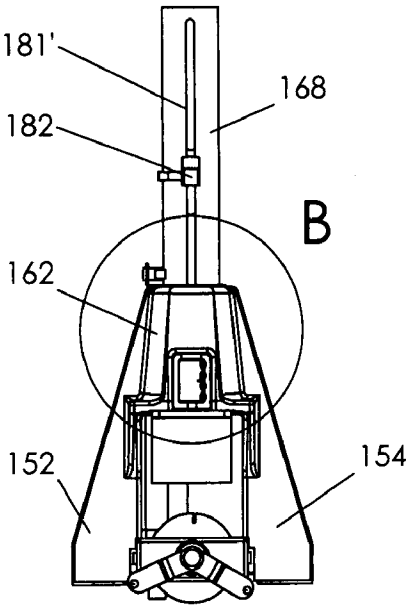
FIG. 70 is a front view of the assembly shown in FIG. 68.
Figure 72:
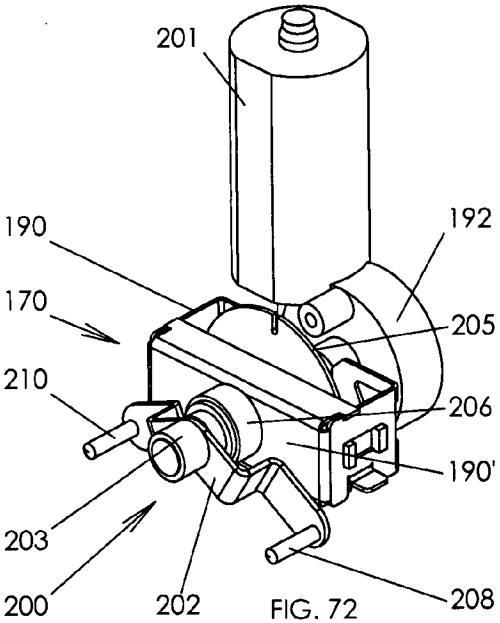
FIG. 72 is a perspective view of the motor operated valve actuating means.
Figure 73:
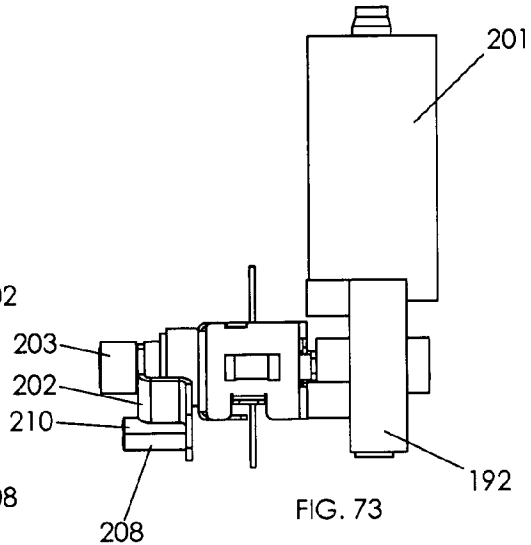
FIG. 73 is a side view of the assembly shown in FIG. 72.
Figure 74:
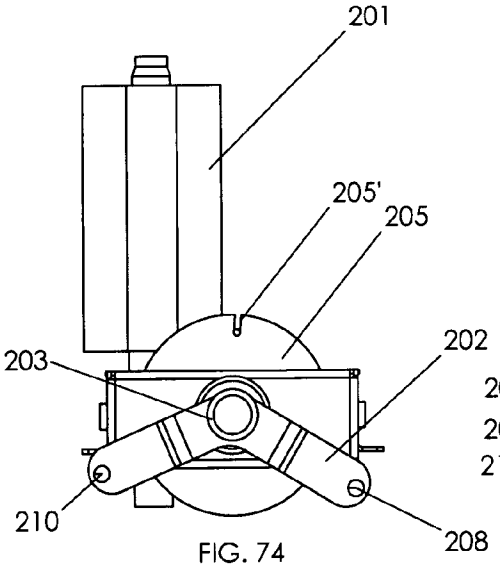
FIG. 74 is a front view of the assembly shown in FIG. 72.
Figure 75:
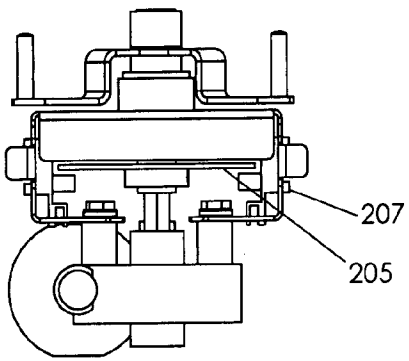
FIG. 75 is a plan view of the assembly shown in FIG. 72.
Figure 76:
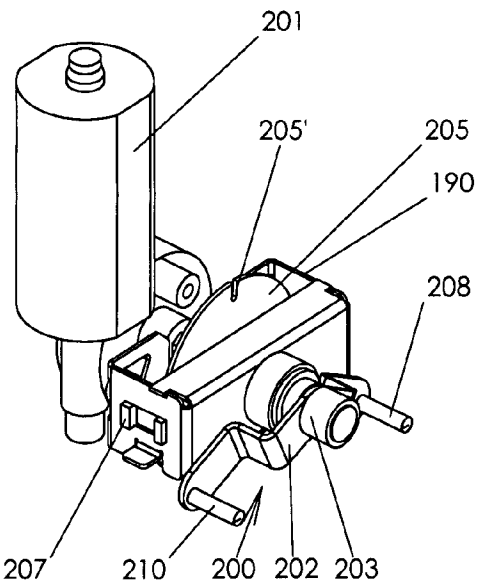
FIG. 76 is a view similar to FIG. 72 but turned 90° with respect thereto.
Figure 77:
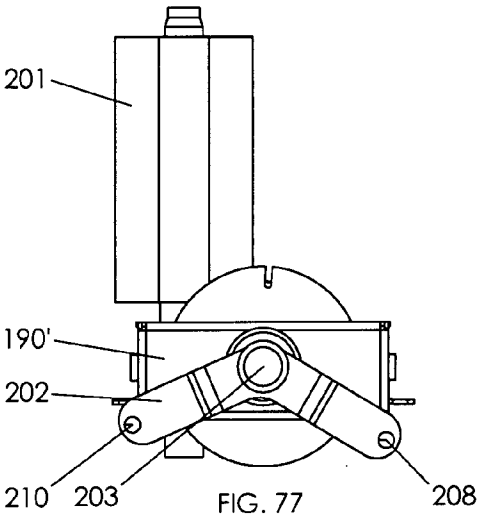
FIG. 77 is a view of the assembly shown in FIG. 76.
Figure 78:
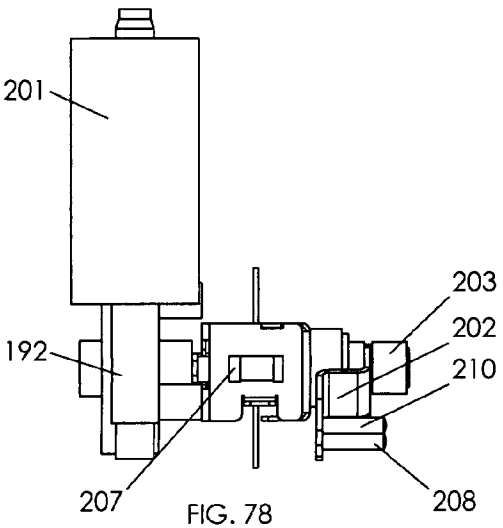
FIG. 78 is a side view of the assembly shown in FIG. 76.
Figure 79:
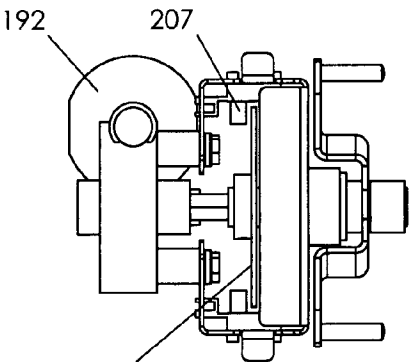
FIG. 79 is a plan view of the assembly shown in FIG. 76.
Figure 81:
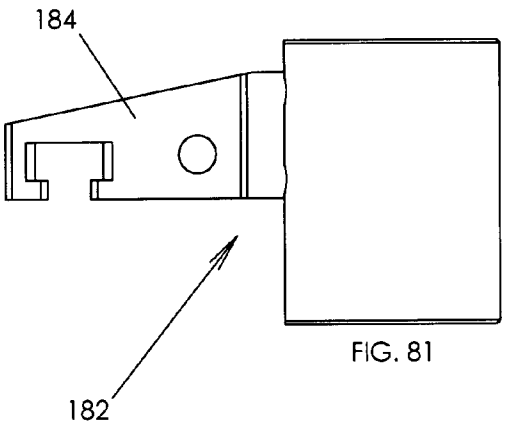
FIG. 81 is a side view of the actuator pump gripper.

Referring now FIGS. 64–79, there is shown the above-mentioned actuating/dispensing station 27. The actuating/dispensing station 27 includes an upstanding, bifurcated mounting column or bridge 150 which is mounted to the above-mentioned flange 130 of the base plate 12 so as to straddle the above-mentioned cutout 130', as best seen in FIG. 64. The column 150 has a pair of upstanding legs 152, 154 to form bifurcation, and horizontal mounting brackets 156, 158 extending radially inwardly from the ends of the legs 152, 154, which brackets 156, 158 are mounted to the underside surface of the base plate 12, whereby the void or space formed between the legs 152, 154 is in juxtapositioned alignment with the cutout or opening 130' of the base plate 12, in order to mount the valve-actuating mechanism described hereinbelow.

Figure 80:
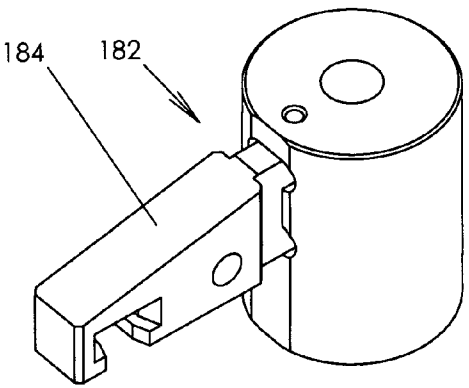
FIG. 80 is a perspective view of the actuator pump gripper.
Figure 82:
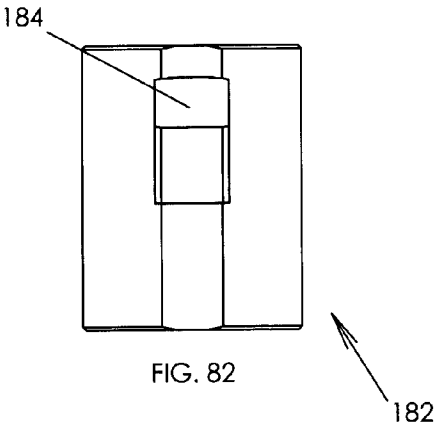
FIG. 82 is a front view of the actuator pump gripper.
Figure 83:
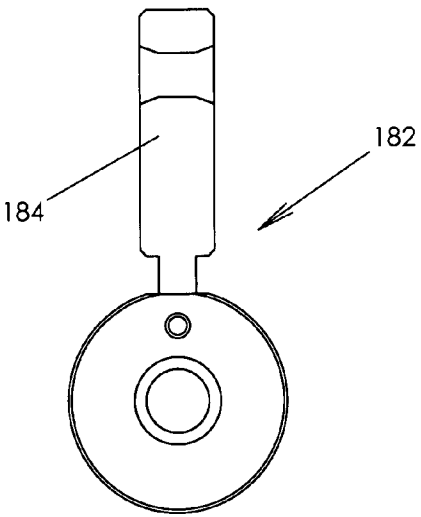
FIG. 83 is a plan view of the actuator pump gripper.

The mounting column or bridge 150 has a substantially-cylindrical, main body portion 162 in which is mounted a piston-lifting device 164, which includes a cylindrical member or housing 168 which is telescopingly received in cylindrical opening 162' of main body portion 162. The cylindrical member 168 interiorly mounts a rotatable threaded screw rod 181 by which a gripper 182 is reciprocated in a vertical direction, which gripper protrudes outwardly from the cylinder 168 through an elongated vertical channel or slot 181'. The gripper 182 is mounted to the threaded rod 181 via a nut in a conventional manner. As shown in FIG. 80 the gripper 182 has a notch or catch 184 in which is received a respective enlarged head or flange 68 of a respective piston of a respective canister-receptacle 15, 16A or 16B positioned at the dispensing station 27. As the array of canister-segments 14 are rotated, the gripper 182 is located at an elevation which allows an enlarged head 68 to slide into the catch 184. The gripper is used to lift the respective head 68 an amount that is dependent upon the amount of fluid contained in the respective canister-receptacle 15, 16A, or 16B that is to be dispensed. As the head 68 is lifted and draws up the piston rod 66 and piston 67 thereof, a vacuum is created in the main cylinder 65 to suck up the requisite amount of fluid associated with the respective pump-actuator assembly 34, in the conventional manner. However, prior to this lifting of the head 68, the above-described two ceramic valve plates 94, 96 are oriented such that the exit or discharge opening of the associated canister-receptacle 16 is in fluid communication with the inlet of the cylinder of the piston-cylinder arrangement 34, as described above in detail.

This relative, rotational orientation between the two ceramic valve-disc plates 94, 96 is controlled by a valve-actuating device 170, for dispensing the metered or measured fluid contained in the dispensing cylinder of the piston-cylinder arrangement 34, as described in detail hereinbelow. Referring to FIGS. 68–71 and 80–83, the gripper device 182 is better seen, and which is preferably a one-piece, injection-molded, thermoplastic-resin material. The gripper device includes a hollow, main cylindrical-shaped portion 176 having enlarged upper and lower threaded nuts 176', 176", which cooperate with the threaded traverse drive rod 181 above-described.

Referring to FIGS. 72–79, the valve-actuating device 170 may best be seen. The valve-actuating device 170 includes a main frame 190 which is affixed to a mounting bracket 192. The mounting bracket 192 is affixed to the bottom or lower surface of the main body portion 162 of mounting column or bridge 150, and between the legs 154, 156 forming the bifurcated structure of the bridge 150. Thus, the main frame 190 projects or protrudes radially inwardly toward the carousel of canister-segments 14, and is received in above-mentioned cutout or opening 130' of bracket 130 of the base plate 12. The main frame 190 mounts a rotatable valve-actuating lever mechanism 200. This valve-actuating lever mechanism 200 has a lever arm 202 that is rotatably or pivotally mounted by pivot shaft 204, which pivot shaft 204 is rotatably mounted by ball-bearings of a ball-bearing housing 206 affixed to the radially-inwardly facing, or rear surface 190' of the main housing 190. Projecting rearwardly, or radially inwardly, are a pair of pins or cam members, an upper pin or cam member 208 mounted at one end of the lever arm 202, and a lower pin or cam member 210 mounted at other end of the lever arm 202. The upper and lower pin or cam members 208, 210 cooperate with a respective exteriorly-projecting handle 119 of the lower housing 92 of the valve-assembly with ceramic plates 94, 96 of a respective piston-cylinder arrangement 34 positioned at the dispensing station 27. When the lever arm 202 is rotated 180 degrees in a first direction, the lower pin or cam member 210 contacts against the respective exteriorly-projecting handle 119 of the lower housing 92 of the valve-assembly with ceramic plates 94, 96 of a respective piston-cylinder arrangement 34, which causes the lower housing 92, and entrained lower ceramic valve plate 96, to be rotated 180 degrees in the first direction. This rotation of the lower valve plate causes fluid communication of the openings or holes 102, 112 and 110, 104 of the upper and lower valve plates 94, 96 whereby the interior contents of the respective canister-receptacle 15, 16A or 16B is in fluid communication with the interior of main cylinder 65 of the respective dispensing piston/cylinder pump arrangement 34 via arcuate channel 114, as described above in detail. Upon completion of such rotation, the above-described piston-lifting device or gripper 182 is actuated to lift the piston head, after which the lever arm 202 is rotated 180 degrees in the opposite direction, whereupon the other upper pin or cam member 208 contacts against the same respective exteriorly-projecting handle or lever 119 of the lower housing 92 of the valve-assembly with ceramic plates 94, 96 of the respective piston-cylinder arrangement 34, which causes the lower housing 92, and entrained lower ceramic valve plate 96, to be rotated 180 degrees in the second, opposite direction, to align exit opening 104 of the upper valve plate with the triangular-shaped dispensing opening 118 of the lower valve plate 96, as discussed above in detail. Thereafter, the piston-lifting device 164 is actuated to lower the piston head of the respective dispensing piston/cylinder pump arrangement 34 via gripper 182 in order to dispense the metered or measured contents of the dispensing piston/cylinder pump.

In an alternative embodiment the arms of the lever arm 202 are arranged at an angle smaller than 180 degrees, preferably 120–130 degrees, for instance 126 degrees so that the rotation angle needed between opening and closing the valve is smaller, resulting in a reduction of time needed for opening and closing the valve and therewith a reduction in total dispensing time. The angle should be big enough, typically larger than 45 degrees, preferably larger than 90 degrees to allow a free rotational movement of the respective cylinder piston arrangements 34.

Projecting radially inwardly from the lever arm 202 is a ball bearing construction 203 which is used for a tight-fitting, sliding or riding in the space in between the two stops or flanges 80, 82 of a dispensing cylinder of the piston-cylinder arrangement 34. The ball bearing 203 slides in a respective pair of flanges 80, 82 as the carousel of canister-segments 14 is rotated or indexed. This arrangement is necessary owing to the above-mentioned and above-described cantilever-type, suspended mounting of each canister-segment 14. The ball bearing structure 203 in conjunction with its contact between stops or flanges 80, 82 of a dispensing cylinder of the piston-cylinder arrangement 34 (see FIG. 6), provides the necessary counter-reactive force to the above-described piston-lifting device 164. Since the piston-lifting device 164 exerts an upward force against the enlarged head 68 of a respective piston-cylinder arrangement 34, such upward force would also tend to raise or lift up the respective canister-segment 14 from its cantilevered mounting by support column 22 and enlarged, concentric lower flanges 22', 22', as described above in detail. Thus, the mutual contact between the structure 203 and the lower stop or flange 82 provides the necessary counterbalancing, or opposing force to this canister-segment, disassembling lifting force.

Mounted within the main housing 190 is a disc 205 having a plurality of notches 205'. The disc 205 is used for stopping the rotation of the lever arm 200 at the two precise locations of the valve-discs described above for first filling the dispensing cylinder with liquid to be dispensed and then for dispensing it, as described above in detail. The notches 205' are used to allow an IR beam to pass through, which infrared beam is part of a conventional IR sensing system 207 well-known in the art. At the dispensing station the motor 201 is operated to rotate the lever arm to operate the valve to the correct location for proper alignment of the holes of the two ceramic valve plates for dispensing to take place. When the lever arm 200 breaks the beam the drive motor 201 rotating the lever 200 stops. The motor is then reversed to return the lever arm to its original position. Other conventional sensing structure besides IR may be used.

The disk 205 preferably comprises three notches 205' and two sensors, whereby each of the two sensors can sense each of the three notches 205' so that at least four positions of the disk 205 can be identified by the sensing system 207, namely "valve opened", "valve closed", "canister-segments free to rotate", and "undefined position". The position of the notches 205' is dependent on the shape of the lever arm 202 and the position of the sensors. In the embodiment shown in FIG. 72 the notches 205' are provided at angles of 90 degrees around the periphery of the disc 205, while the sensors are arranged at an angle of 180 degrees with respect to the axis of rotation of the disc 205.

Figure 84:
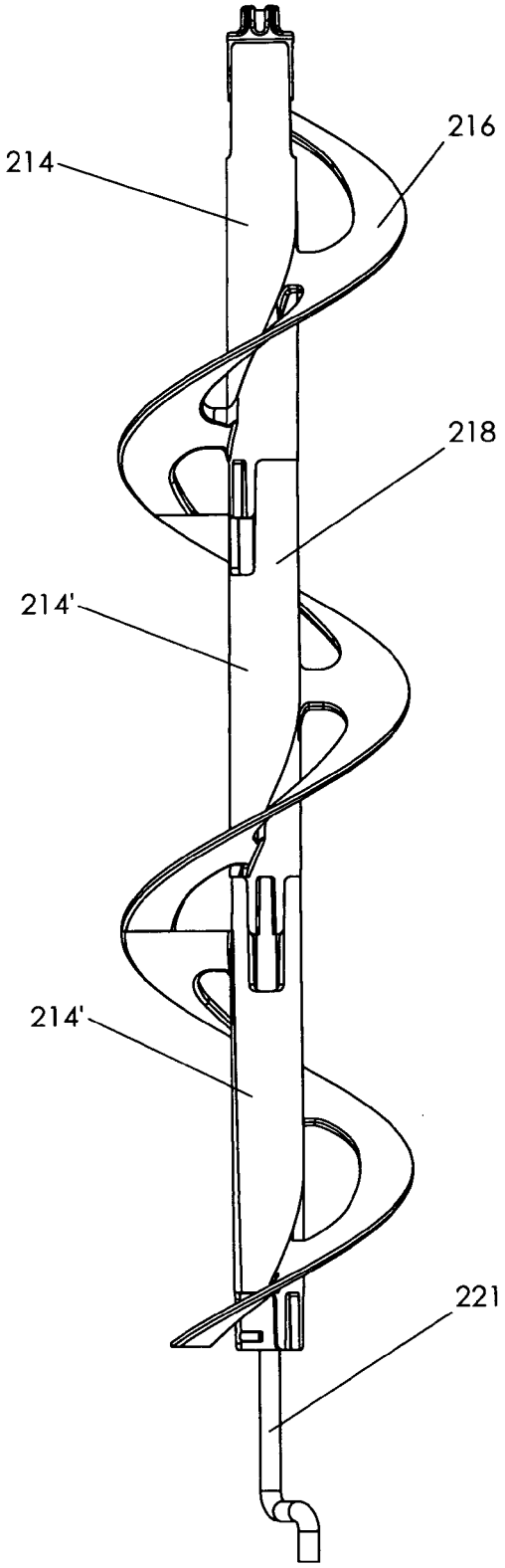
FIG. 84 is an elevation view of a stirring assembly.
Figure 85:
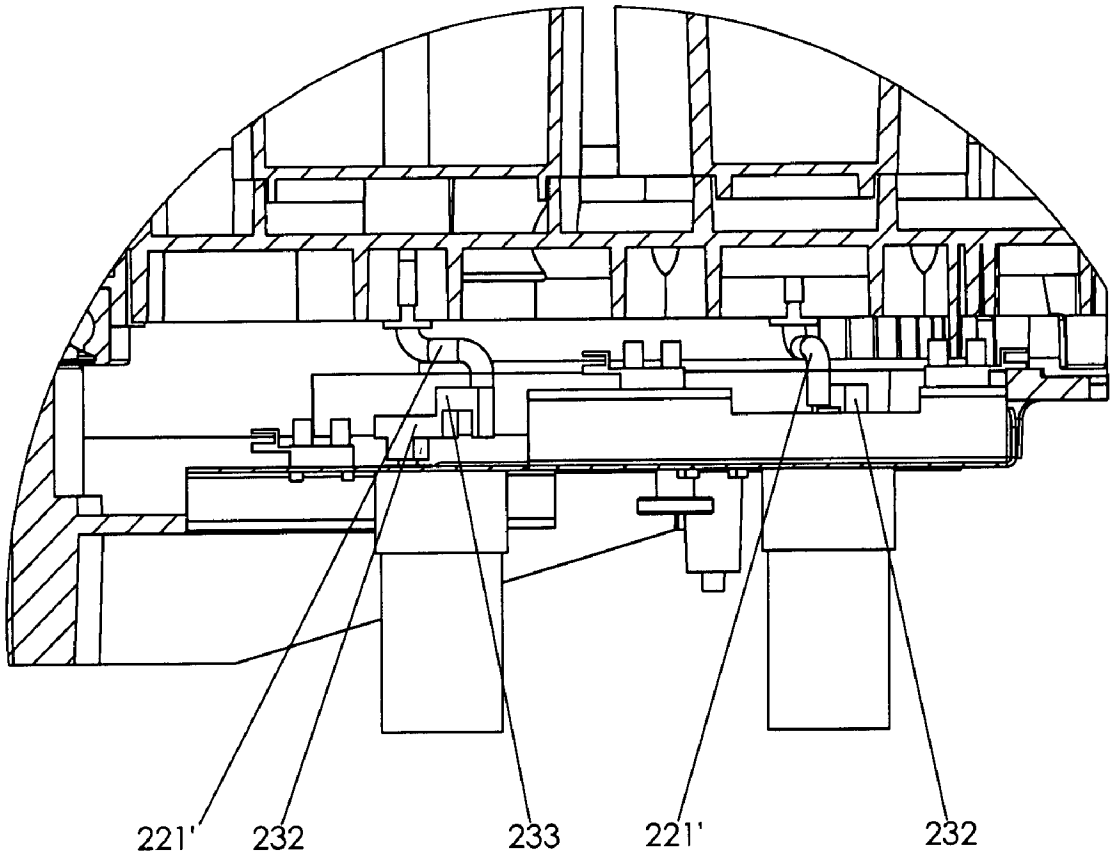
FIG. 85 is a partial bottom perspective view of the stirring mechanism.
Figure 86:
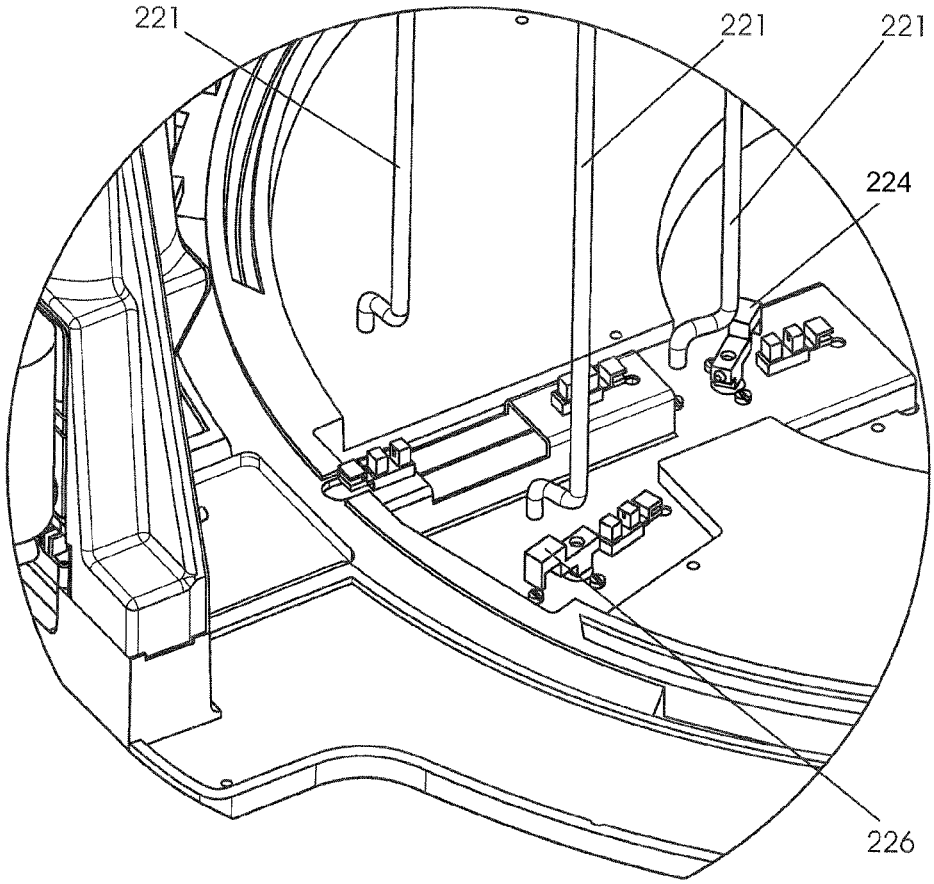
FIG. 86 is a partial top perspective view of the base plate and stirring components.
Figure 91:
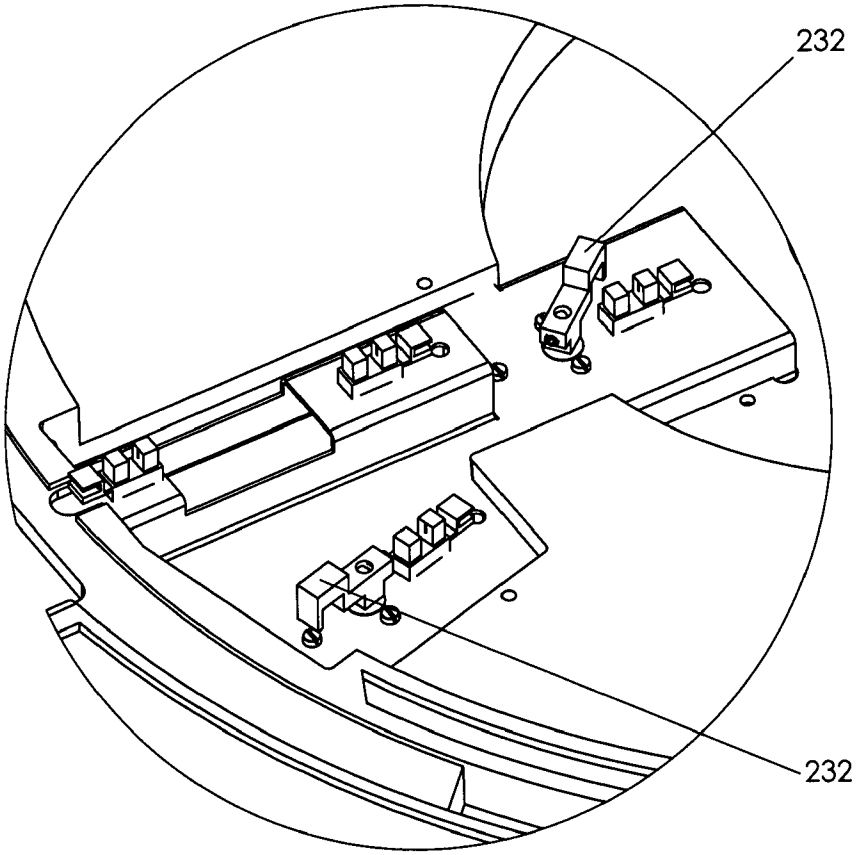
FIG. 91 is a perspective view of a portion of the motor operated stirring mechanism.
Figure 92:
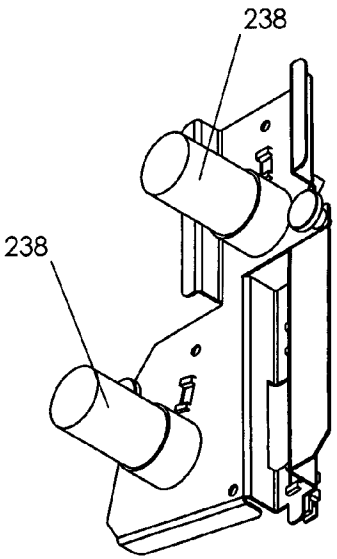
FIG. 92 is a bottom perspective view of the motor assembly for operating the stirring mechanism.
Figure 93:
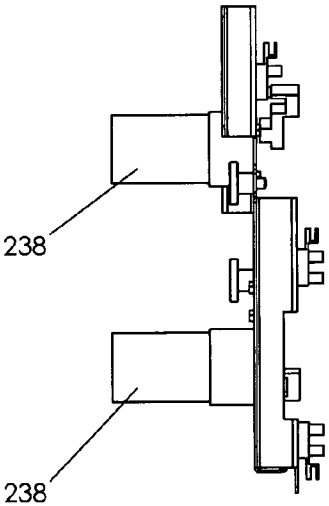
FIG. 93 is a side elevation view of the assembly of FIG. 92.
Figure 94:
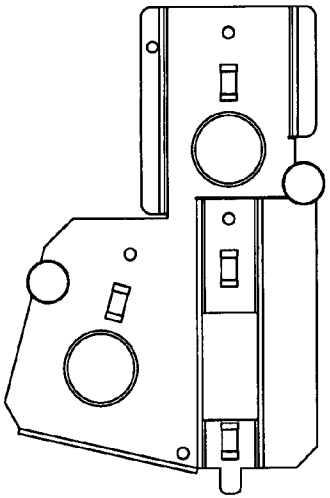
FIG. 94 is a plan view of the assembly shown in FIG. 93.
Figure 95:
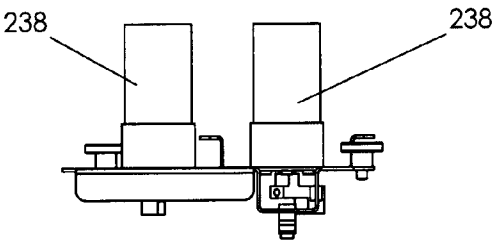
FIG. 95 is a side view of that shown in FIG. 94.

As mentioned above, each receptacle of each canister-segment 14 must be periodically stirred or agitated in order to properly mix the contents. Unlike prior-art colorant dispensing machines, the apparatus 10 utilizes just one stirring or agitating device to which are brought the selected canister segments to be mixed. The agitating device 220 (see FIG. 89) of the invention is mounted in opening 122 of the base plate 12 and is shown in FIGS. 85–95. However, before describing the stirring or agitation device 220, reference is had to FIGS. 84 and 85 where for illustrative purposes there is described a stirring of a single receptacle 16A where there is shown a stirring rod or shaft 221 that extends upwardly into the interior of a respective canister receptacle. For illustrative purposes there is described a stirring of a single receptacle 16A. The stirring shaft 221 is telescopingly received in central tube 28 of a respective canister receptacle 16A, and passes entirely through the tube all the way to the top of the upper canister-receptacle 16A. To the top or upper end of this stirring shaft 221 is mounted a stirring mechanism 214 with fins or blades 216 provided circumferentially about a central cylinder 218, as best seen in FIG. 84, which central cylinder surrounds the above-detailed central tube 28 of a respective canister-segment 16A, and which is rotatable about such central tube 28. It is noted that for purposes of clarity, the tube 28 through which passes the stirring rod or shaft 221 is not shown. The stirring mechanism is preferably, as shown in FIG. 84, assembled from a number of segments 214' of which more preferably at least two are identical. In the stirring mechanism of FIG. 84 the bottom three segments 214' are identical, while the top segment 214' is adapted to cooperate with the top of the canister-receptacle 16A. The use of smaller (i.e. smaller parts than the whole stirring mechanism 214) and in particular identical stirring mechanism segments 214' provides lower manufacturing costs for the stirring mechanism 214, while the use of stirring mechanism segments 214, in particular different stirring mechanism segments 214 makes it possible to adapt the size and shape of the stirring mechanism 214 to the fluid that is to be held in the respective canister-receptacle. In this way the stirring mechanism 214 can be easily optimized for the respective fluid. The blades or fins 221 may be of any conventional type and shape, such as straight, helical, and the like, as is well-known. Moreover, as is best seen in FIG. 85, each stirring or agitation rod or shaft 221 has a lower or bottom projecting end 221' that is bent or at an angle with respect to the longitudinal axis of the shaft 221. The angle is preferably ninety degrees, as seen in FIG. 85. This transversely-extending end 221 cooperates with the stirring or agitating device 220, as described hereinbelow.

Referring to FIGS. 85–95, the stirring or agitating device 220 is shown, and consists of a mounting plate 222 to which are mounted an inner agitation drive mechanism 224 for an inner receptacle, and outer agitation drive mechanism 226 for an outer receptacle. Each of the inner and outer agitation drive mechanisms has a driven eccentric arm 232 at one end of which projects upstanding pin 233 that is contacts or cams against a respective transverse end 221' of a stirring rod 221 of a respective canister-receptacle 16A. Each eccentric lever 232 is driven by a drive motor 238. It is noted that during rotation or indexing of the carousel of canister-segments 14, the camming pins 233 are positioned by the motors 238 so as to allow clearance of the lower transverse ends 221'. After the carousel is stopped, then the canister-receptacle positioned over the stirring station or device 220 is stirred by rotating the eccentric lever 232 to cause contact between the camming pin 233 thereof and the respective transverse end 221' of stirring rod 221 of the canister-receptacle to be stirred. The motors 238 are controlled, in a conventional manner, by a software module of the overall control software of the apparatus 10.

Instead of the camming pin 233 mounted on the eccentric arm 232 there also may be provided an extension on the projecting end 221' which extension directly cooperates with the eccentric arm 232. This extension extends preferably in a downward direction and may be an integral part of the stirring rod 221.

Figure 96:
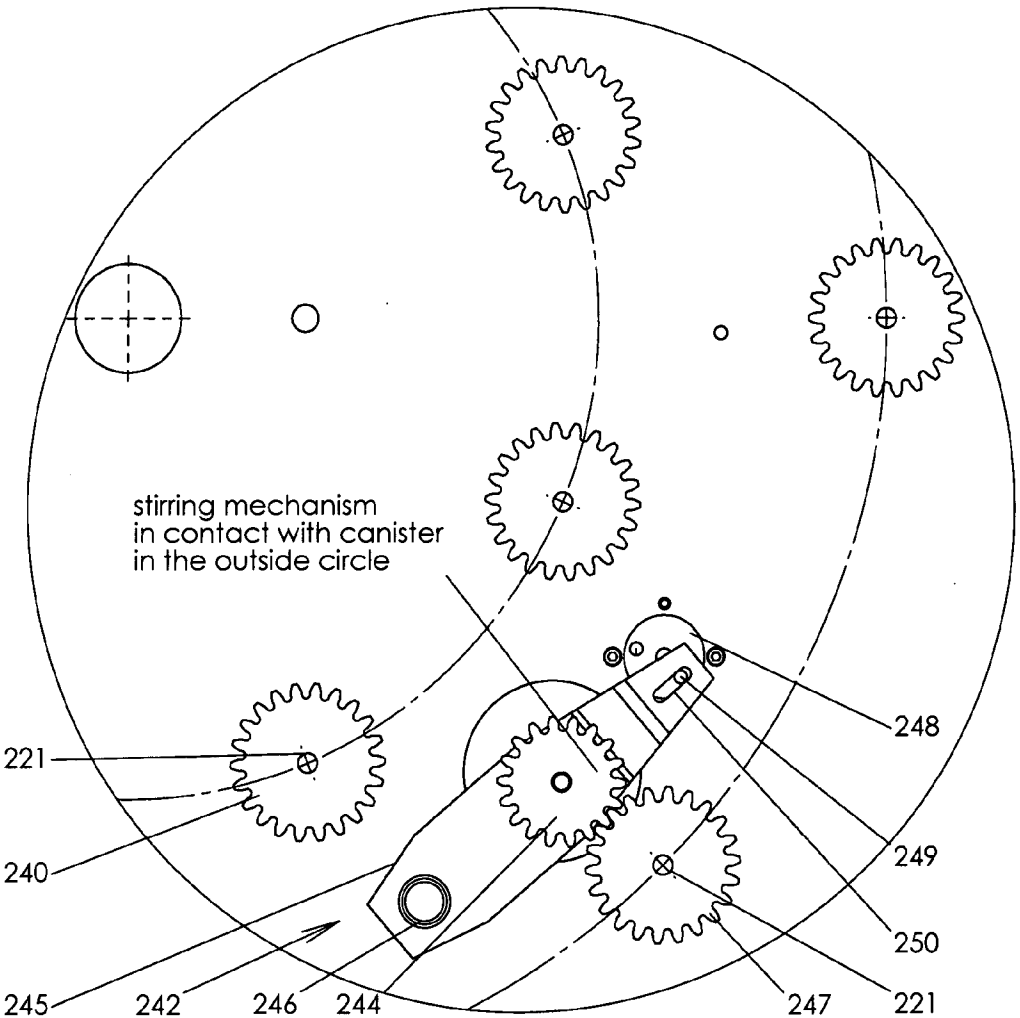
FIG. 96 is a view of a modified stirring arrangement.

In a variation of the stirring process of a canister-receptacle there is shown in FIG. 96 an alternative stirring device. Instead of the bent or transverse lower or bottom end of each stirring rod 221 associated with a canister-receptacle gears 240, 247 are mounted to the bottom of a given stirring rod 221 that projects downwardly from a respective bottom part or module 18. In this modification, the stirring station or device 242 has a drive gear 244 rotatably mounted on a lever arm 245 pivotally mounted at one end by pivot shaft 246. The drive gear 244 may be alternatively brought into engagement with either of the two of the three bottom driven gears 240, 247 of a canister-segment 14 located at the stirring or agitation station; that is, the lever arm 245 is rotated in a first direction to bring the drive gear 244 into meshing engagement with the one inner driven gear 240, or rotated in the opposite direction to bring into meshing engagement with the one outer driven gear 247 of one of the outer canister-receptacles 16A or 16B. Thus the driven gear 240 and the drive gear 244 are able to engage to control the rotation or indexing of the carousel of canister-segments 14 preferably by the overall drive-control software of the invention in the complete automatic version of the apparatus 10. The lever arm 245 may be rotated, for example, by means of bidirectional rotary disc 248 having guide pin 249 that rides in guide slot 250 at the free end 251 of the lever arm 245, in the well-known manner.

As discussed above, each dispensing piston/cylinder pump arrangements 34 associated with a respective canister-receptacle 15, 16A or 16B is removably attached, so that it may removed for cleaning and/or repair. When such canister-receptacle 15, 16A or 16B is removed, it is necessary to prevent leakage of the colorant from the respective, associated canister-receptacle through the thus-exposed, respective exit or discharge tube or opening 50', 52' or 54' seen in FIG. 23, for example.

Figure 97:
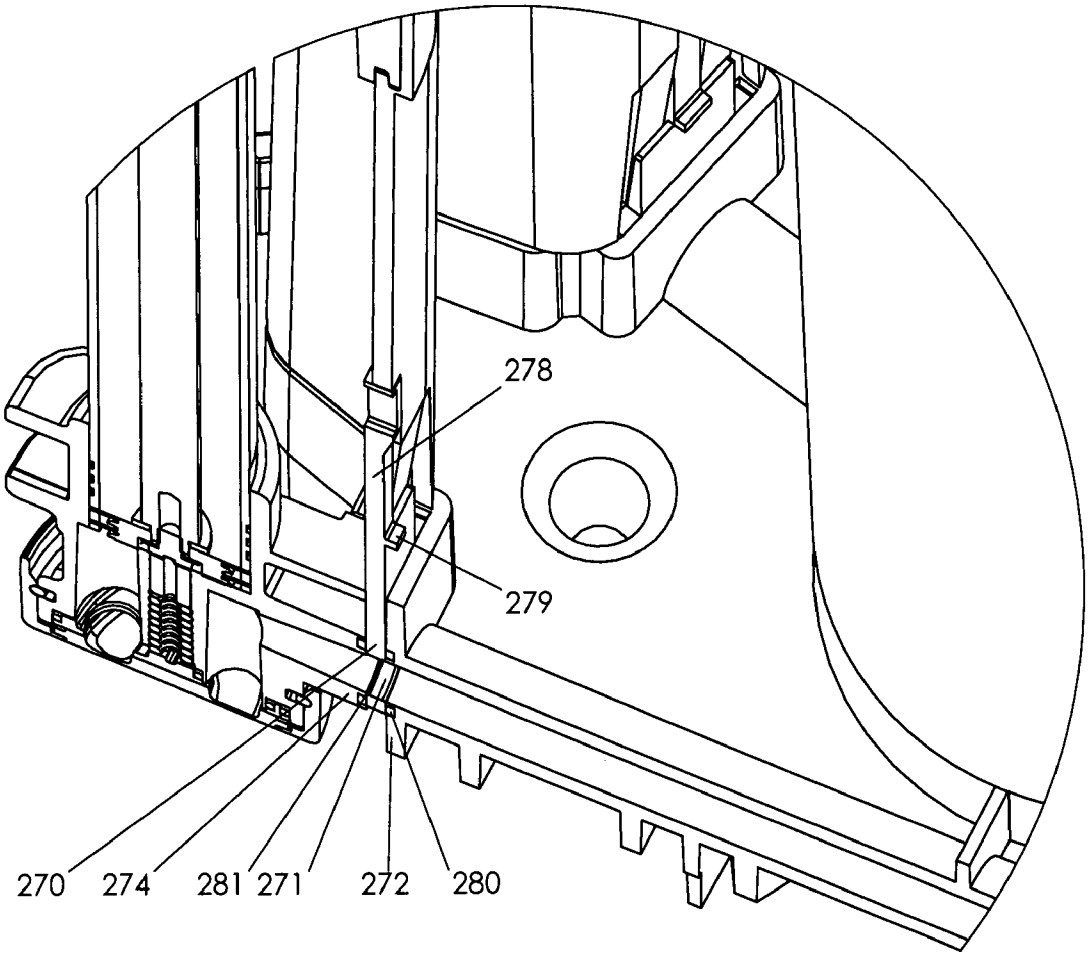
FIG. 97 is a perspective view partially broken away to show the shut-off for cutting of the flow from a canister receptacle.
Figure 98:
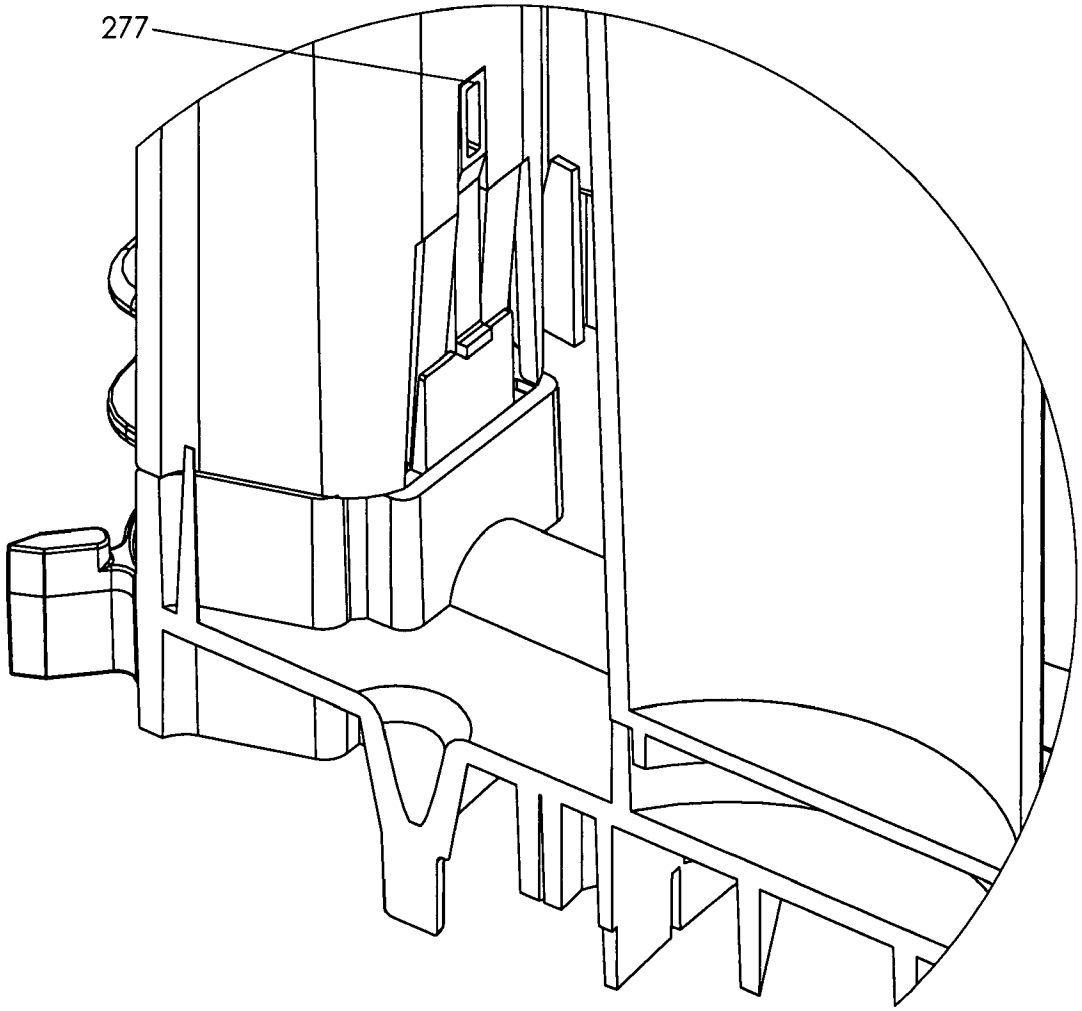
FIG. 98 is a perspective view partially broken away illustrating a stirrer in a receptacle of a canister.
Figure 99:
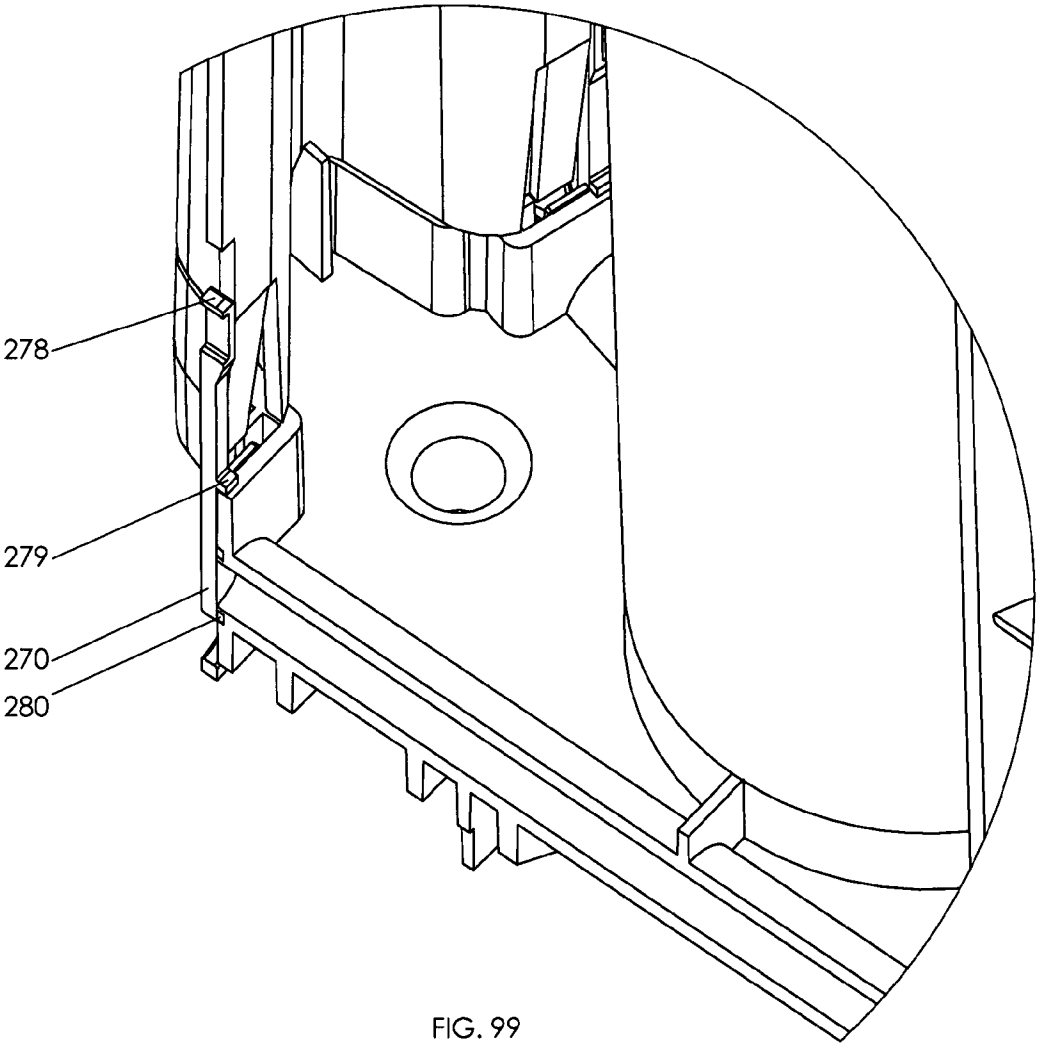
FIG. 99 is a view similar to FIG. 97 showing a valve in position to cut-off flow from a container.

Toward this end, a manually movable, vertically-reciprocal, closure lever or plate 270 is mounted between exit or discharge tube or opening 50' for a representative canister receptacle and the ceramic valve-plate assembly 94, 96. This manually movable, vertically-reciprocal, closure lever or plate 270 is seen in FIG. 97, and is mounted for sliding movement between downwardly-projecting plates or mounting flanges 272, 274 of each canister receptacle segment. As seen in FIGS. 97 and 98, when the closure lever or plate 270 is manually lifted or slid upwardly via gripping portion 276, a medial opening 271 is in flow-alignment between the exit or discharge tube or opening 50' and the associated, respective outlet opening 102 of the upper disc plate 94 of the valve assembly associated with the respective, associated dispensing piston/cylinder pump arrangements 34, to thereby allow operation at the dispensing station for the canister receptacle. The gripping portion 276 defines a lip or step 277 which serves as a stop to limit the upward movement of the vertically-reciprocal, closure lever or plate 270, as best seen in FIG. 99. The vertically-reciprocal, closure lever or plate 270 has an upper portion 278 which extends into a interior of the respective canister-receptacle and defines an upper lip 279 which, when the vertically-reciprocal, closure lever or plate 270 is moved downwardly to close off the respective exit discharge tube 50', will limit such vertical movement to a point where it is assured that the exit discharge tube is closed off, as can be seen in FIG. 99. This vertically-reciprocal, closure lever or plate 270 is held frictionally in place in its upper, normally-opened dispensing position, as seen in FIG. 97, for example, by opposing O-rings 280, 281.

Figure 100:
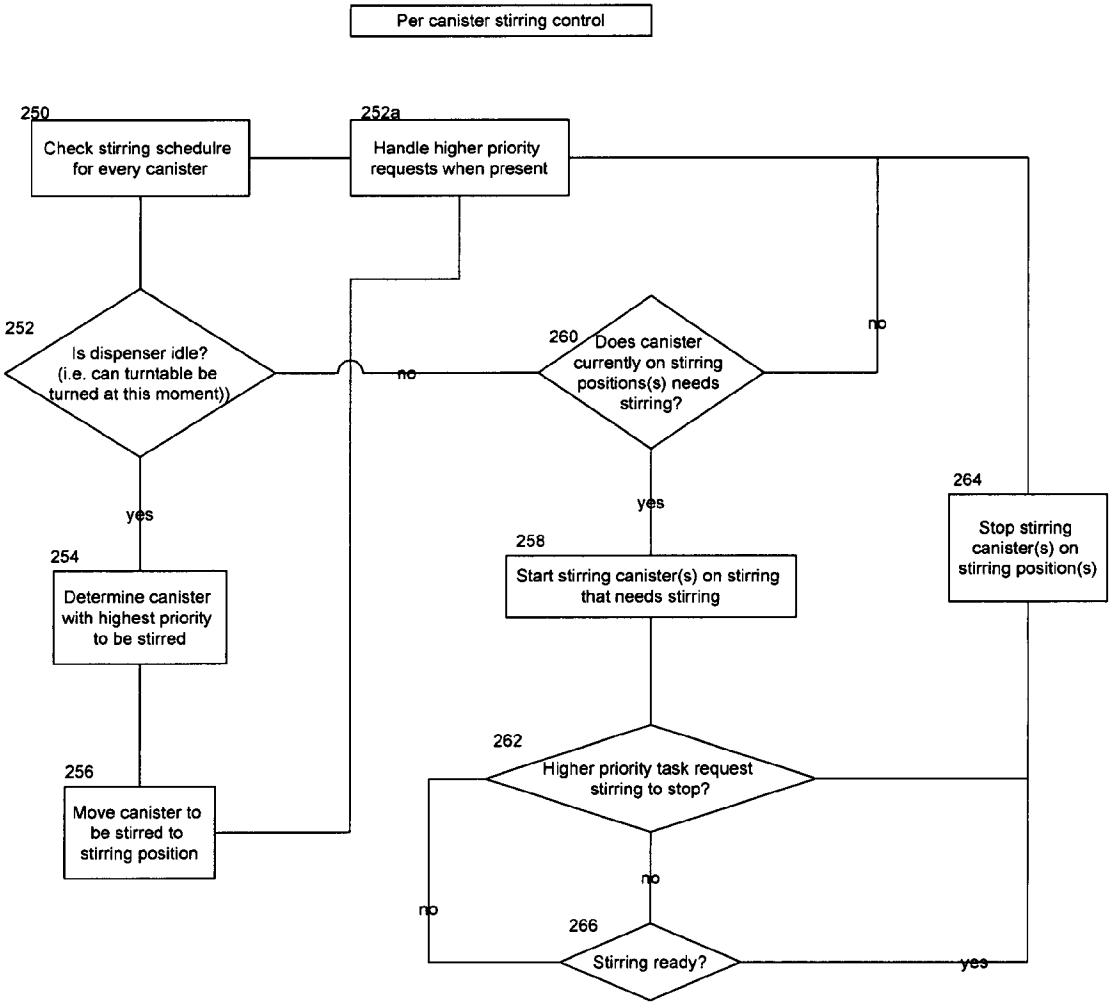
FIG. 100 is a schematic program control of the stirring assemblies.

Referring now to FIG. 100, there is shown a flow chart for the stirring/agitation operation of the apparatus 10. The software of the invention first checks for a predetermined, preprogrammed order-sequence of canister-receptacles 15, 16A or 16B to be stirred (block 250). This order-sequence includes the idle-interval between which each specific canister-receptacle 15, 16A, 16B is stirred, the length of time each specific canister-receptacle is to be stirred or agitated and the nature of the stirring. The stirring may be at a constant speed for the entire time-period of the stirring/agitation, or may be a variable speed during such time-period. The speed of stirring/agitation may differ during the time-period of stirring/agitation, which variable speed may be infinitely adjustable during such time period. The software of the apparatus then decides if the apparatus is presently involved in a dispensing operation at the dispensing station (decision block 252). If idle ("YES" to decision block 252), then the program determines which canister-receptacle 15, 16A or 16B is of the highest priority, meaning which one is next to be stirred according to the above-mentioned, predetermined, preprogrammed order-sequence (block 254). Then, the carousel of canister-segments 27 is indexed or rotated by the above-described worm drive 140 to the stirring position, which, as described above, is also located at the dispensing station 14' (block 256). After positioning the selected canister-receptacle is stirred (block 258). If the answer to decision block 252 was "NO", meaning that the apparatus is busy already dispensing. After that or during that higher priority requests, if existing, are handled (block 252*a*) the program determines which canister-receptacle is being dispensed and if this canister-receptacle does in fact itself need stirring (decision block 260), and if "YES", then the program proceeds to previously-mentioned block 258, where that canister-receptacle being dispensed is also, simultaneously with the dispensing, stirred. If during the stirring of a canister-receptacle during the step of block 258 the program receives an input indicative of a high-priority task request, such as, for example, the necessity for dispensing from one of canister-receptacles, then the stirring of the currently-stirred canister-receptacle will be stopped (block 264), upon which the program returns to START (block 250), and determines which, different canister-receptacle has been requested to be dispensed, with the above-described process being repeated. If the answer to decision block 262 is "NO", meaning no high-priority message was initiated, then decision block 266 decides when the stirring operation of that canister-receptacle which is unique to it has been completed. If it has not been completed ("NO" to decision block 266), the program loops back to block 262 until either a higher-priority task request has been initiated ("YES" to decision block 262), or until the stirring operation for the specific canister-receptacle has been completed ("YES" to decision block 266), at which point the program stops stirring the canister-receptacle (block 264) and loops back to START (block 250).

We now turn to the automatic hair dye dispensing machine illustrated in FIGS. 101–125.

The function of this machine is to automatically dispense selected amounts of various hair dye colors into a container to provide the desired color. The illustrated automatic machine 310 contains 30 different colors of hair dye that can be automatically dispensed by a program controller including a digital read-out viewing screen 312, possibly a touch-screen which can also be used for input of data. Mixed with the selected amounts of hair dye is peroxide located in containers 314 in the center of the machine the amounts of which are similarly automatically controlled and dispensed by a program controller.

The automatic hair dye machine 310 is identical in many respects to the automatic colorant dispenser and to avoid unnecessary duplication the components of the hair dye machine that are identical to the colorant dispenser will be so indicated. When it is necessary to the understanding of the hair dye system to identify certain parts, the numbers and figures from the colorant dispensing machine will be referred to. Thus, attention in this portion of this application will be directed to those components that are different to those in the automatic colorant dispenser. For the details of the hair dye machine that are identical to the automatic colorant dispenser reference is made to the detailed description thereof described with respect to the automatic fluid dispenser 10.

The differences between the automatic colorant dispensing system and the hair dye systems mainly lie in the container construction for the hair dye, the support therefore and the drive system for the adaptors holding the hair dye containers.

Referring first to the support system it is to be noted that the containers 316 for the hair dye are located in canister units/adapters 318 (see FIG. 111) that are removably connected to a ring shaped turntable 320 (see FIGS. 112–115) that is rotatably mounted on a fixed support plate 12 as used in the paint machine. The containers 316 for the individual hair dye components are supported in individual adaptors 318 that are releasably connected to the turntable 320. In the illustrated embodiment the 30 adaptors 318 are secured to and located in a circular pattern about the turntable 320. Located in the center portion of the turntable and ring of adaptors are containers 314 for peroxide that is fed into the receiving container at the dispensing station 27 that is identical to the one used in the colorant dispenser 10.

In an alternative, preferred embodiment of the hair-dye dispenser apparatus, the dispenser apparatus comprises one or more canister units/adaptors, each canister unit/adaptor being designed to hold two or more containers 316 containing the hair-dye components. Such canister unit/adaptor is releasably attached to the turntable. Preferably a pump is releasably connected to the canister unit/adaptor for each container being placeable on said canister unit/adaptor.

Figure 106:
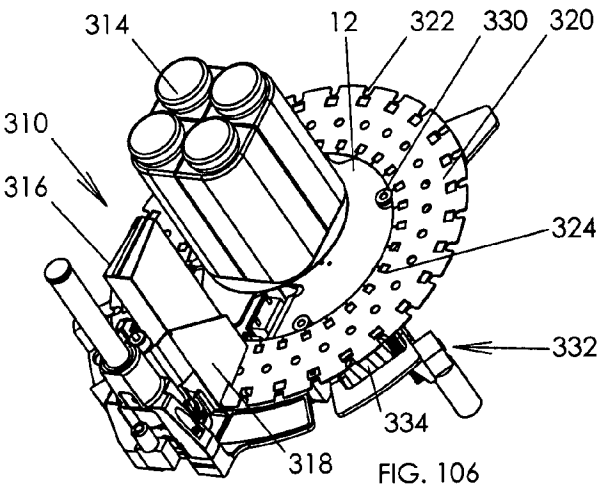
FIG. 106 is a partial perspective view of the hair dye dispenser showing an adaptor and container assembly mounted at the dispensing station and the stationery peroxide bottles.
Figure 108:
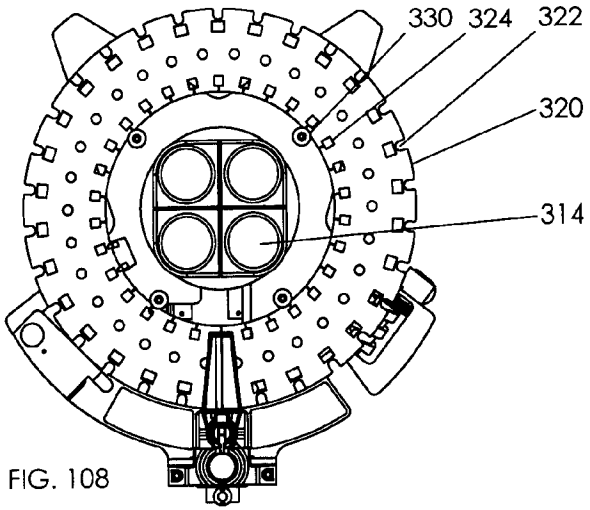
FIG. 108 is a plan view of the apparatus shown in FIG. 109.
Figure 109:
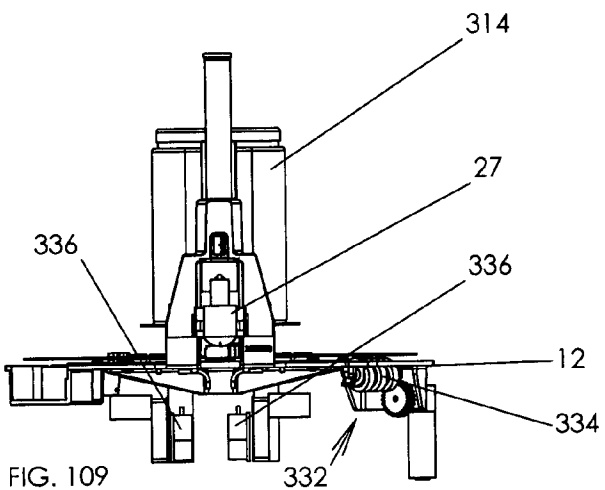
FIG. 109 is a front elevation of the apparatus in FIG. 108.

Referring now to FIG. 106 there is illustrated the turntable 320 mounted on the support plate 12. FIG. 106 illustrates the dispensing station 27 and a single plastic, generally trapezoidal-shaped adapter 318 located in position at the dispensing station 27. Located in the adaptor is a hair dye container 316 having the same general cross section as the adaptor. The adapter is snap fitted into position on the turntable 320 as will be discussed in more detail hereinafter. The turntable is ring shaped and contains a plurality of notched openings 322 around its outer circumference and a plurality of openings 324 adjacent its inner circumference. The openings 322, 324 are designed to receive pins 326, 328 respectively depending from the bottom of the adaptors 318 to locate the adaptor in the proper position on the turntable (see FIG. 116). There are rollers 330 on the support plate 12 that guide turntable 320 as it is rotated relative thereto.

Figure 111:
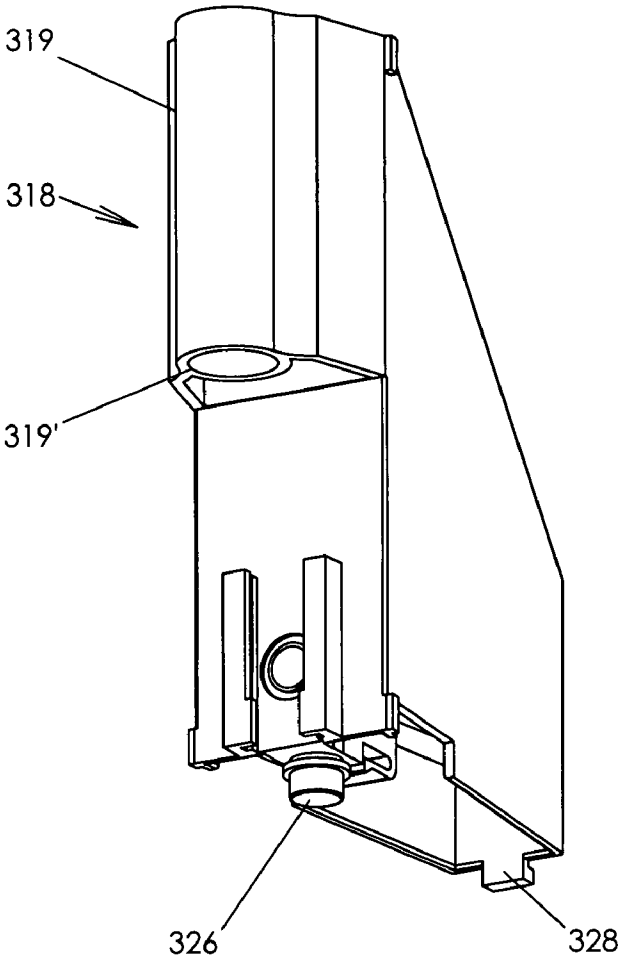
FIG. 111 is a perspective view of the adaptor.
Figure 112:
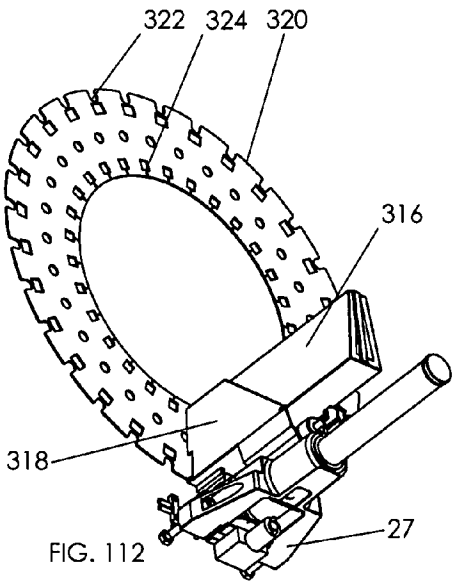
FIG. 112 is a partial perspective view showing the turntable and adaptor/container located at the dispensing station.
Figure 113:
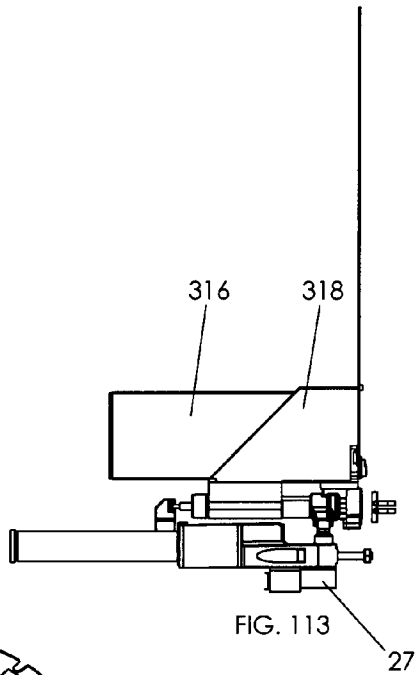
FIG. 113 is a side elevation of the apparatus in FIG. 112.
Figure 114:
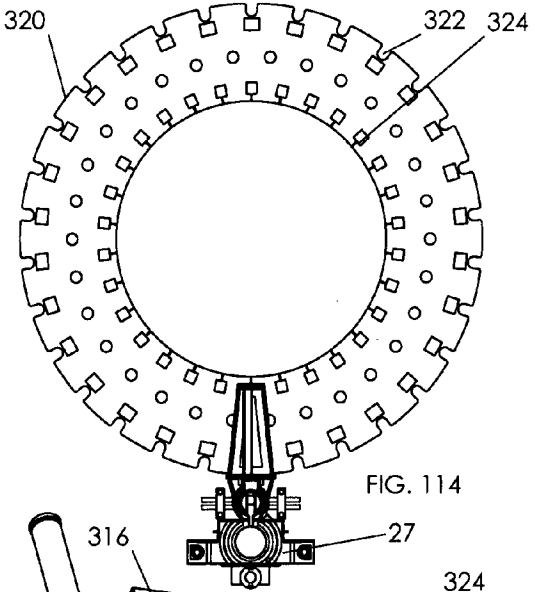
FIG. 114 is a plan view of the apparatus of FIG. 112.
Figure 115:
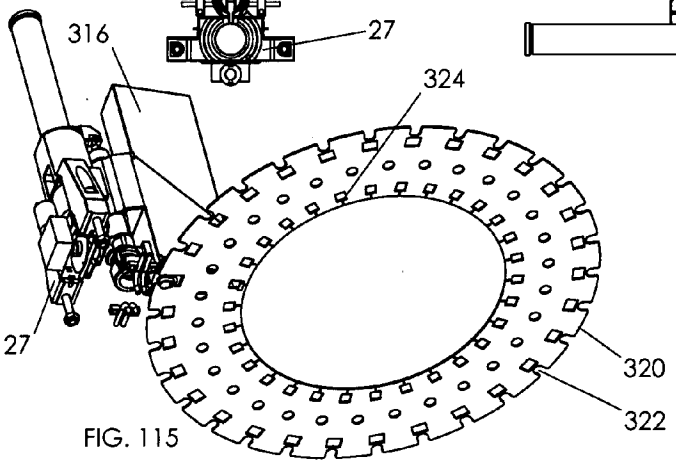
FIG. 115 is a view similar to FIG. 112 looking from the bottom of the turntable.
Figure 116:
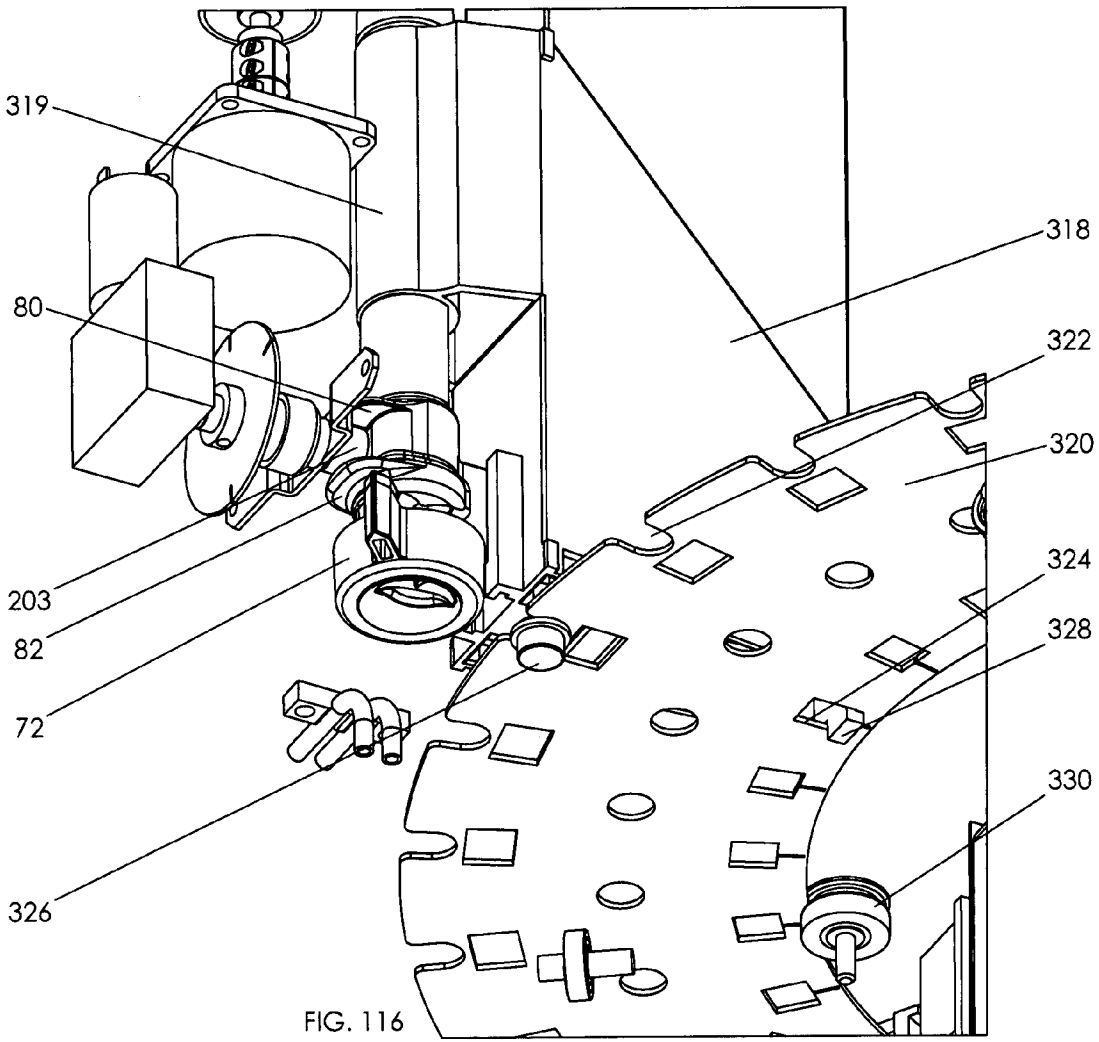
FIG. 116 is a partial perspective showing an adaptor mounted in place on a turntable.
Figure 117:
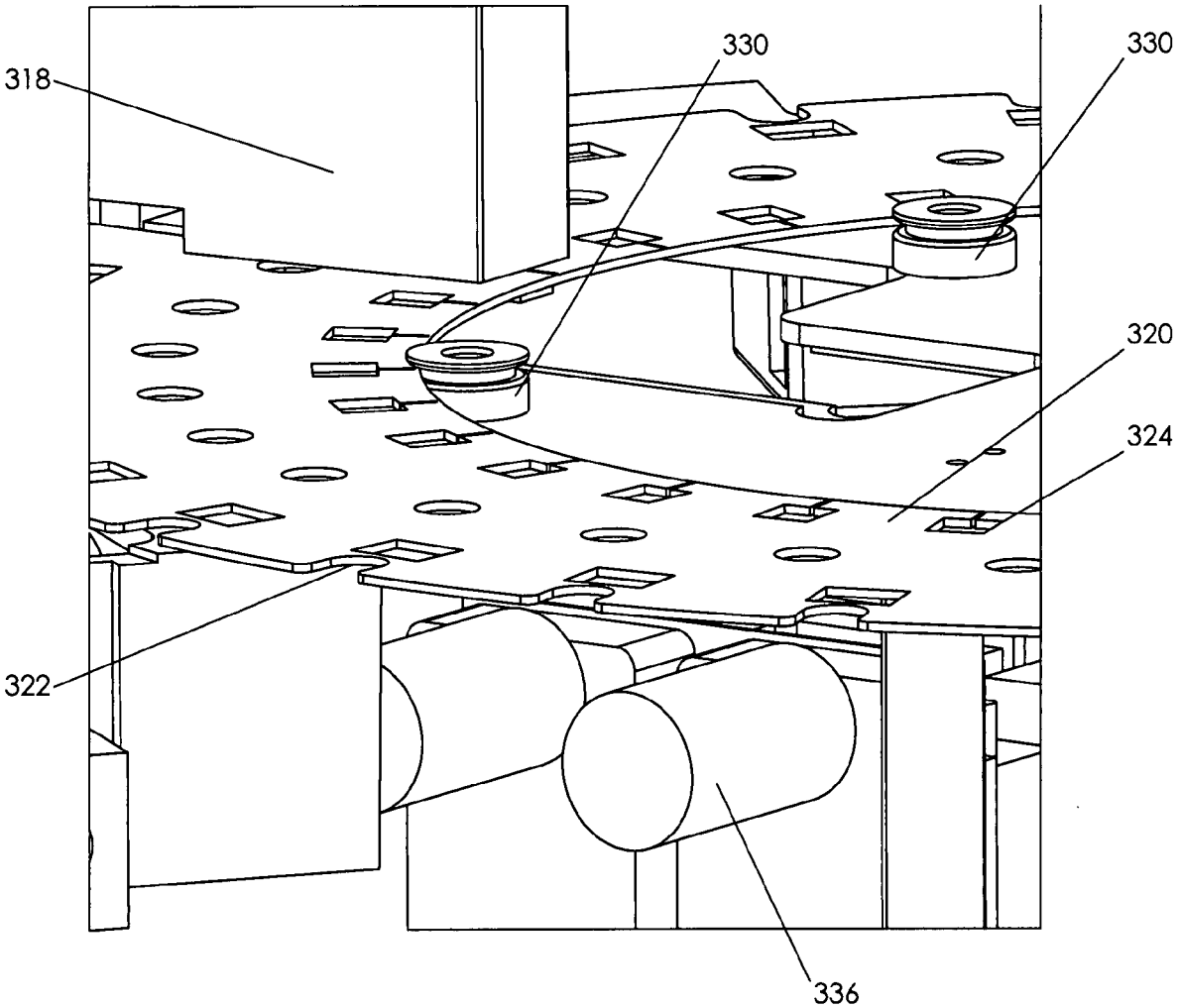
FIG. 117 is a view similar to FIG. 116 showing the roller mounting for the turntable and the peroxide pumps.

Referring to FIG. 111 there is illustrated a perspective view of the adaptor 318. In FIG. 116 there is illustrated the adaptor 318 secured in position on the turntable 320. As was previously noted the adaptor 318 is connected to the turntable 320 by the front and rear depending pins 326, 326 that snap into the spaced outer and inner openings 322, 324 respectively. Thus the adaptor can be readily inserted and replaced relative to the turntable when desired.

Located in the adaptors 318 are the containers 316 filled with the hair dye that is to be dispensed at the dispensing station 27. As illustrated the containers are box-shaped to fit the adaptors and contain dye in vacuum packed bags 329 (see FIG. 119). Holes are located in the top of the boxes to prevent the creation of a vacuum therein.

This is but one type of container that can be used and other arrangements can be used, several of which will be illustrated in detail hereinafter.

Figure 101:
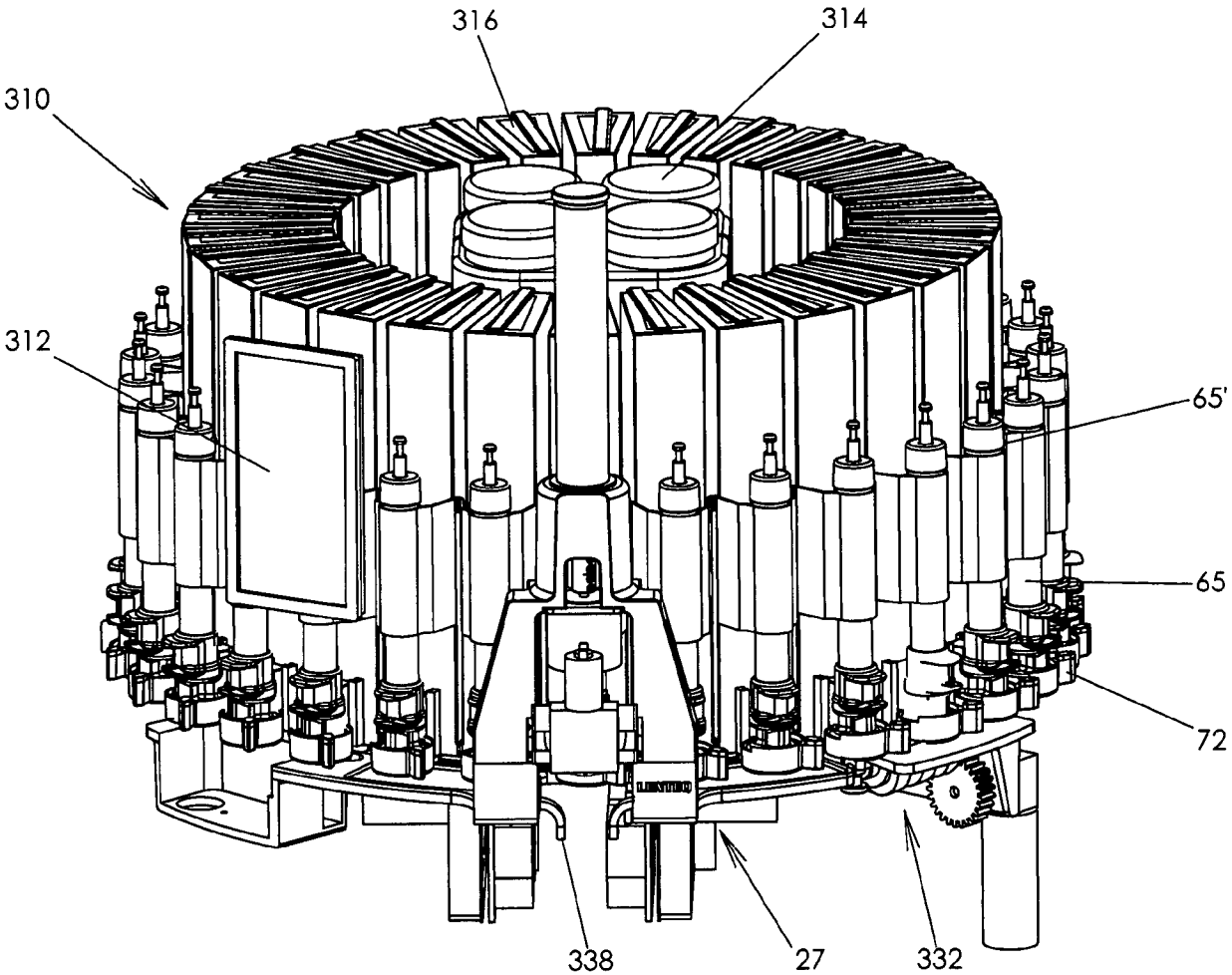
FIG. 101 is a front perspective of an automatic hair dye dispensing machine.
Figure 102:
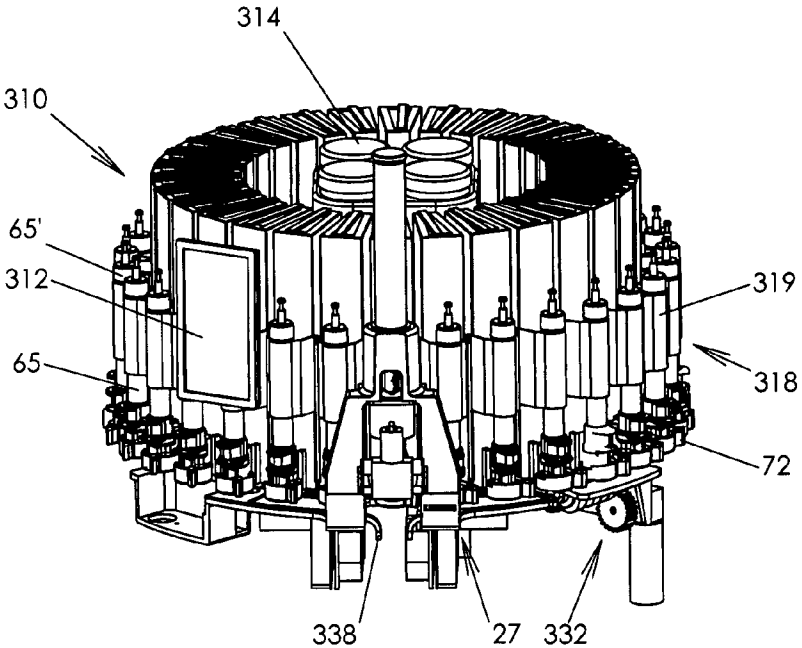
FIG. 102 is a perspective view of an automatic hair dye machine in a slightly tilted position from that shown in FIG. 101.
Figure 104:
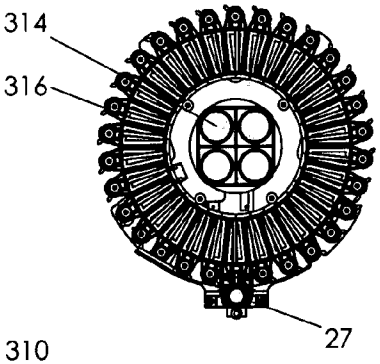
FIG. 104 is a plan view of the dispenser of FIG. 102.
Figure 103:
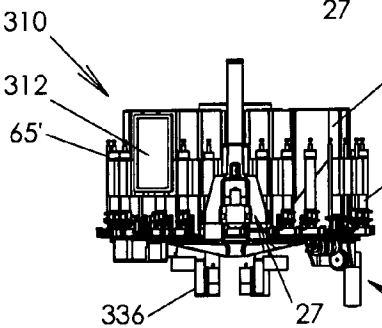
FIG. 103 is a front view of the dispenser of FIG. 102.
Figure 105:
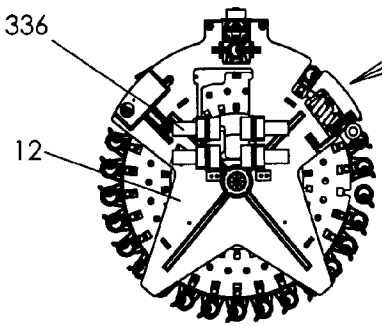
FIG. 105 is a bottom view of the dispenser of FIG. 102.
Figure 107:
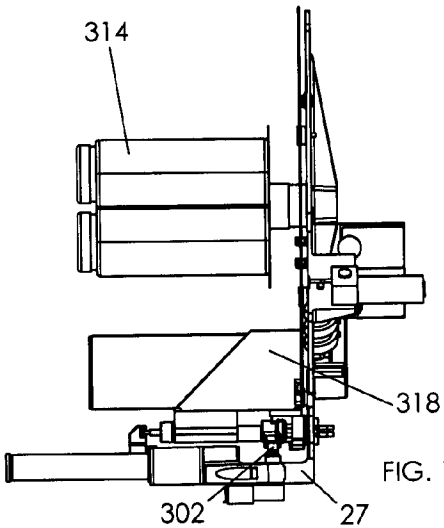
FIG. 107 is a side elevation of the partial perspective view of the apparatus in FIG. 106.

With the dispenser filled as illustrated in FIG. 101 the turntable can be operated to dispense the requisite hair dye at the dispensing station 27.

The adaptors 318 are designed with upper cylindrical front portions 319 having an opening 319' extending the length thereof. Located in these openings 319' are the main cylinder of the piston and valve assembly identical to that illustrated in FIGS. 25–55 of the colorant dispenser. This assembly functions to control the flow of hair dye out of the hair dye containers into the receiving container. The valve actuating mechanism mounted on the bridge at the dispensing station 27 for controlling the piston and valve assembly is identical to that illustrated in FIGS. 68–83 of the paint machine. The piston cylinder 65 is held in position relative to the adaptor 318 by the bearing 203 disposed between the flanges 80, 82 (see FIG. 116) and the lower portion of the valve housing 72 is interlocked to the adaptor in the same general manner that housing 72 is connected to the canister segment of the colorant dispenser. Cylinder cap 65' of the main cylinder contacts the upper cylindrical portion 319 of the adaptor to prevent the cylinder 65 from moving downwardly relative to the adaptor.

Figure 60:
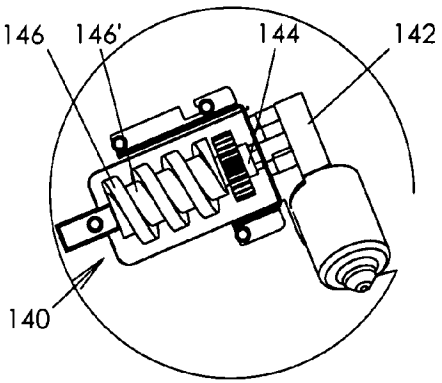
FIG. 60 is a bottom view of the worm drive assembly.
Figure 61:
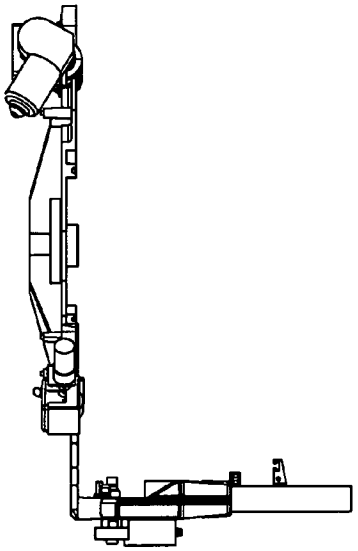
FIG. 61 is a side view of the bottom base plate and the attached pump and valve actuating assembly disposed on its side.
Figure 62:
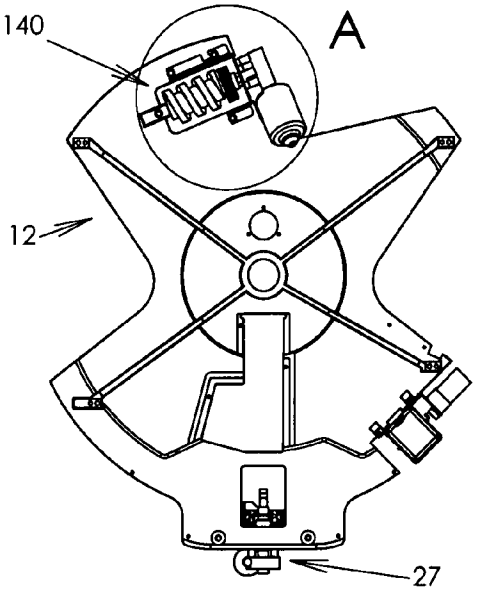
FIG. 62 is a top view of the base plate and associated worm drive and pump and valve actuating assembly.
Figure 63:
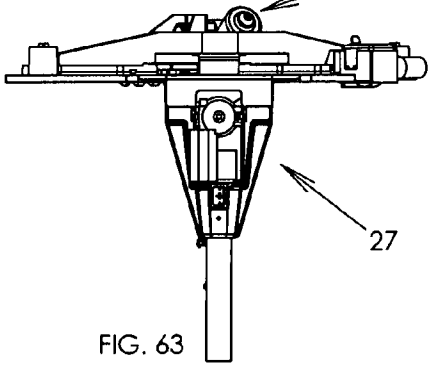
FIG. 63 is an upside-down view of the mechanism illustrated in FIG. 62.
Figure 60A:
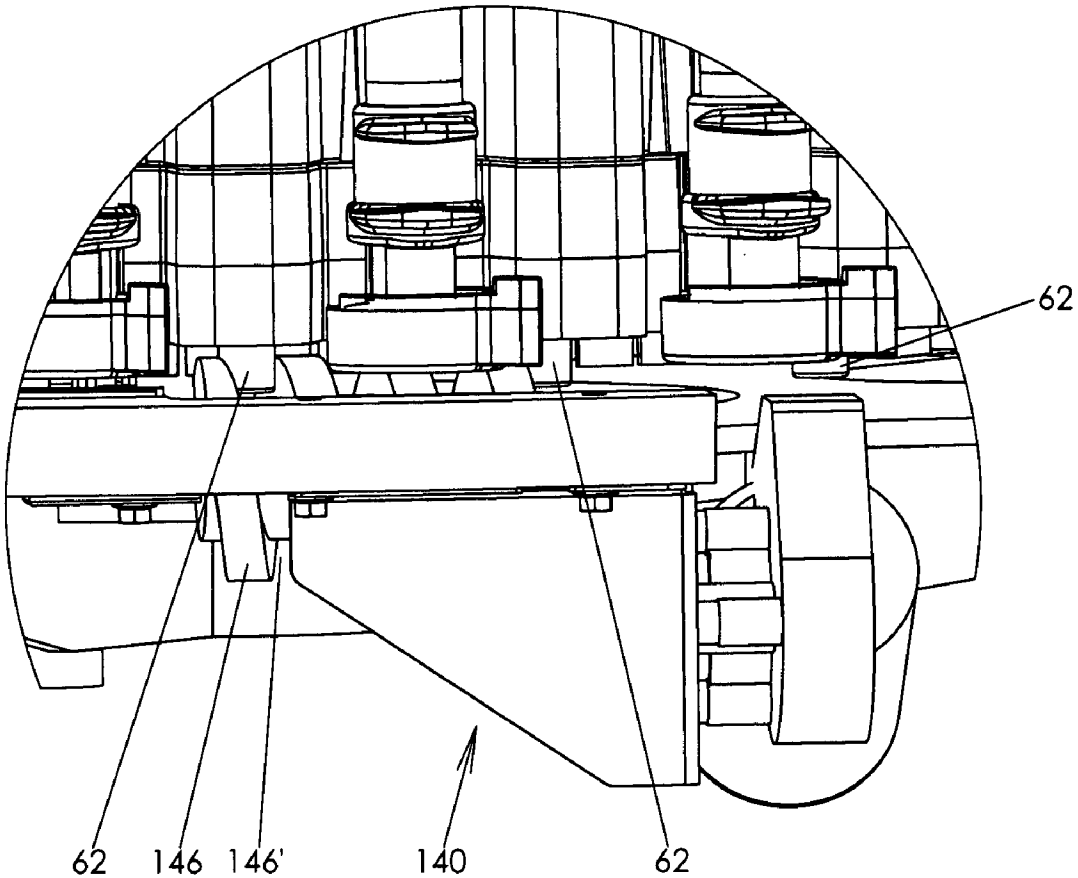
FIG. 60A is a side view of the worm drive assembly.

It remains to note that the turntable is operated by a worm drive 332 connected to the support plate 12 that engages the pins 326 of the adaptor and rotates the adaptors 318 and the turntable relative to the plate 12 (see FIGS. 102–109) and differs from the one in the colorant dispenser only in that the pitch of the worm is set to move the turntable 12° per interval for the individual adaptors. This worm drive is illustrated in FIG. 60 of the colorant dispenser. Thus the power driven worm wheel 334, when indexed by a suitable control system, causes the adaptor to be moved thus causing the turntable connected thereto to rotate the turntable. The 12° rotation places a subsequent adaptor in position at the dispensing station 27 where the valve actuating mechanism is operated to open the valve assembly in the valve piston assembly to dispense hair dyes from the pump cylinder in the same manner as described with respect to the colorant dispenser.

In summation, the hair dye machine in the support and drive areas mainly differs from the colorant dispenser in that the adaptor and the identical piston-valve assemblies are mounted on a turntable 320 and the turntable, when rotated, places an adaptor at a dispensing and valve actuating station identical to the one in the colorant dispenser. The operation of the hair dye machine is suitably controlled by a program controller to accomplish the requisite dispensing in a preselected manner.

Figure 110:
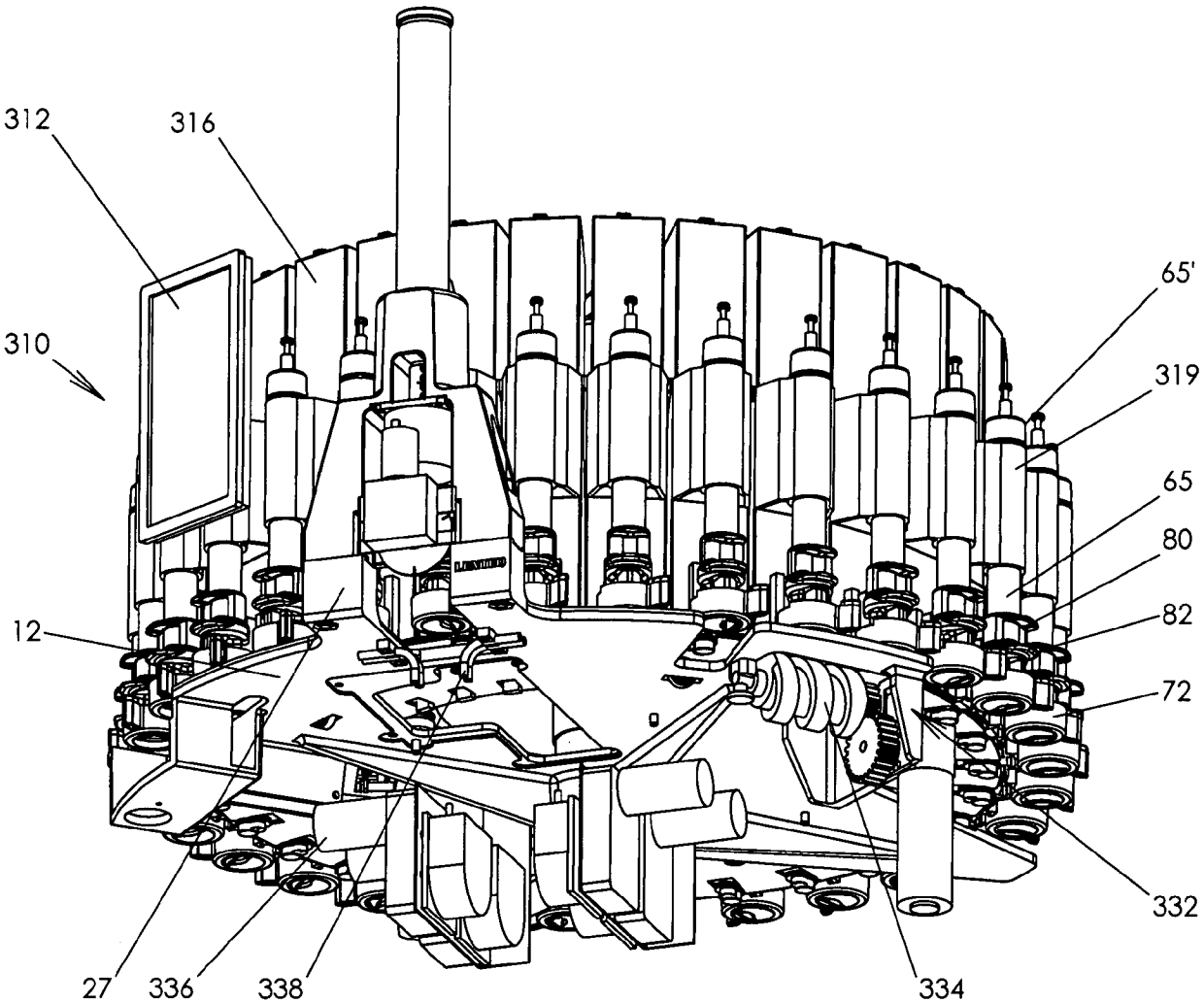
FIG. 110 is a partial perspective view of the automatic hair dye dispenser looking upward from the bottom.

Another main feature of the hair dye machine is the necessity to supply the requisite quantities of peroxide in the receiving container along with the hair dye components. There is illustrated in FIG. 106 four peroxide containers that are connected to the support plate 12 and are dispensed by pumps 336 located under the support plate 12. The pumps are suitably controlled to dispense the requisite amount of peroxide into the receiving container. While four pumps are shown for the 4 containers it is noted that due to the nature of the peroxide regulated valves can be used to control the flow of peroxide. As shown in FIG. 110 four tubes 338 lead from the peroxide containers into a receiving container located at the dispensing station 27. The peroxide containers may be designed as receptacles or another rigid structure in which a flexible bag is placed. When the contents of such flexible bag is nearly depleted, the flexible bag may be refilled through a suitable fill opening or may be exchanged by another flexible bag.

As an alternative embodiment the peroxide may be dispensed on the basis of gravity, whereby the amount dispensed is measured with a weighing device or a scale.

In another embodiment the peroxide may be dispensed from a container which is in principle the same as one of the container embodiments hereinafter described holding a hair dye. Such container may be placed in the dispenser apparatus instead of a container containing hair-dye. In such embodiment the peroxide may be dispensed in the same way as hair-dye as described in this application and the four peroxide containers in the center of the turntable may be left out.

Figure 118:
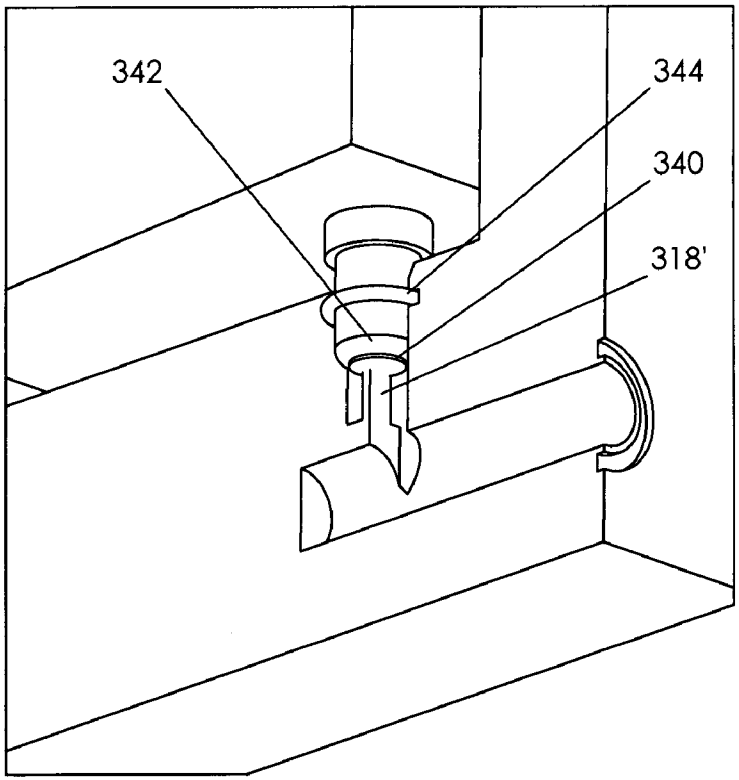
FIG. 118 is a view showing the piercing of a hair dye container when placed in position on the machine.
Figure 119:
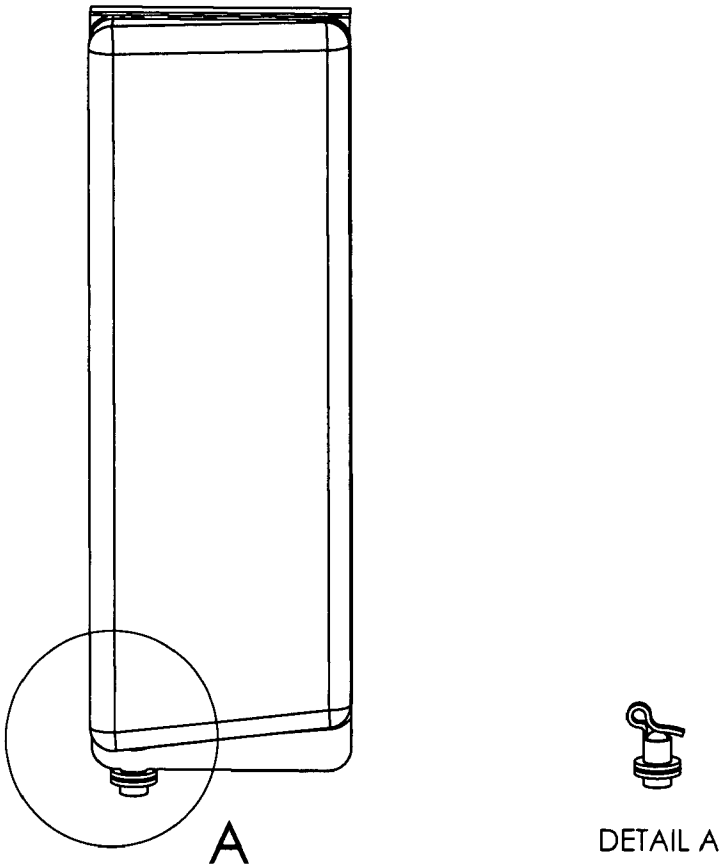
FIG. 119 is a view of a hair dye flexible bag.

As illustrated in the drawings the hair dyes are disposed in generally trapezoidal containers 316 shaped to fit into adaptors 318. The containers in one embodiment are boxes filled with flexible air-permeable bags 329 as shown in FIG. 119. The box 316 will have an opening at the top for preventing the creation of a vacuum therein. In FIG. 118 the adaptor 318 is provided with a sharp surface 318' to pierce the aluminum foil 340 covering the outlet 342 from the container. An O-ring 344 prevents the leakage of air into the system.

Another type of container system for hair dye or other liquids that are degradable by air, in particular oxygen, or may dry out due to evaporation, can be in the form of a generally cylindrical shape filled with hair dye and the adaptor 318 would be suitably designed to accommodate such a container. Two embodiments that can be used are shown in FIGS. 120–125.

The liquid container comprises an air-impermeable outer shell and defines a space for holding said liquid, said liquid container having a liquid outlet for dispensing the liquid and a vent hold for admitting air into the liquid container, the liquid container further comprises an expandable air-receiving element placed within the outer shell and defines an expandable air-receiving space for receiving air entering the liquid container via the vent hold, said air receiving element having an air-impermeable wall, said air-impermeable wall being air-tightly connected to the outer shell and separating the air-receiving space for holding said liquid.

When dispensing liquid from such liquid container the outer shape of the container remains substantially the same, due to the admittance of air into the container. The air entering the container is received in the air-receiving space which is separated by the air-impermeable wall from the space wherein the liquid is container. The air-impermeable wall of the expandable air-receiving element thereby guarantees that the liquid does not come into contact with the air which has entered the container, so that the liquid does not degrade and/or the liquid will be protected against drying out. The air-receiving element will expand upon dispensing of the liquid as a result of the air entering into the liquid container. Preferably, the air receiving element is an expandable air-impermeable bag or an expandable bellows-like element.

Advantageously, the outer shell is substantially made from a rigid material, so that the liquid container is well protected against mechanical impact, in particular of sharp or pointed objects. The outer shell may for example be made of (hard) cardboard with an aluminum layer or a plastics material comprising nylon.

In a preferred embodiment the liquid container comprises a follower piston which is placed between the expandable air-receiving element and the space in which liquid is held in the container. Due to the presence of the follower piston the expandable air-receiving element will not contact the liquid. As a consequence, the choice of the material of the air-receiving element is not influenced by the characteristics of the liquid.

Further, the follower piston has the advantage that liquid which will stick to the inner walls of the outer shell will be scraped off by the follower piston which will move along the walls of the outer shell when liquid is dispensed from the liquid container.

Figure 120:
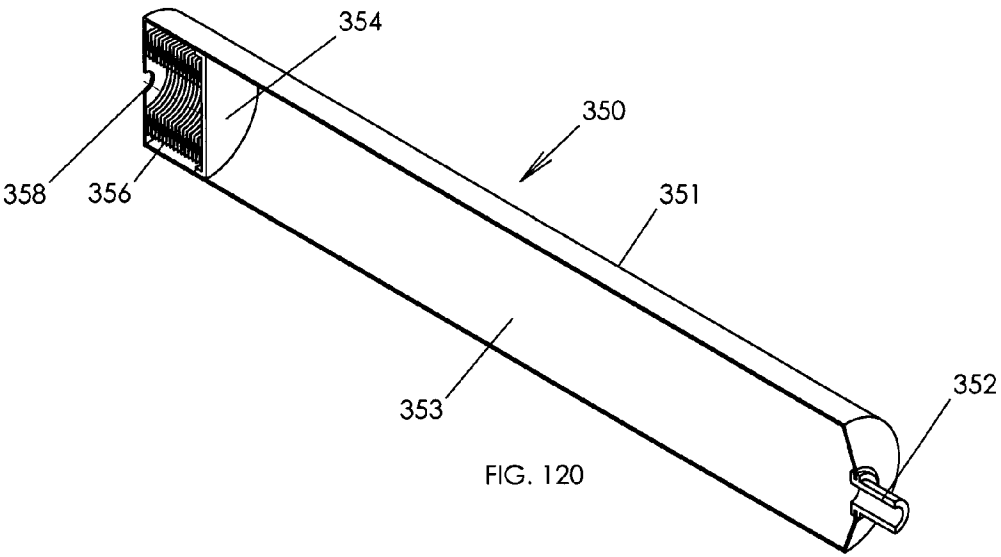
FIG. 120 is a view showing a cross-sectional view of a second embodiment of a hair dye container.
Figure 122:
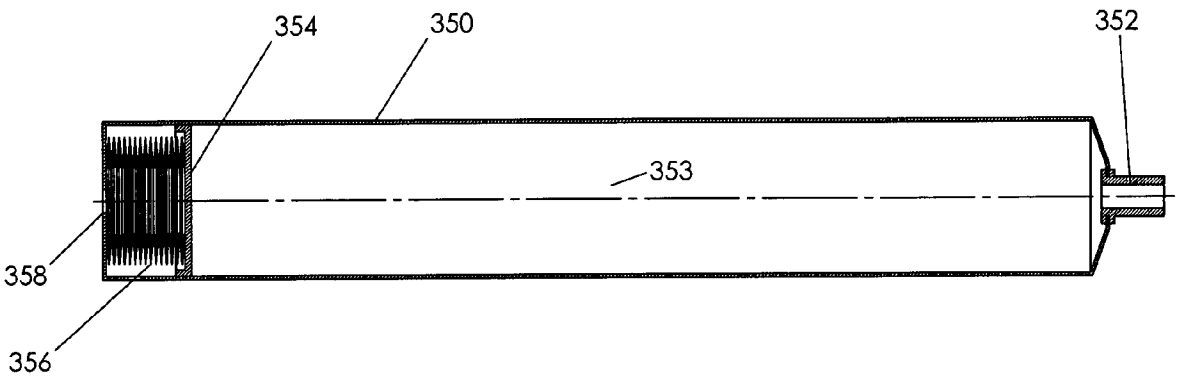
FIG. 122 is a view taken along line A-A of FIG. 121.
Figure 121:
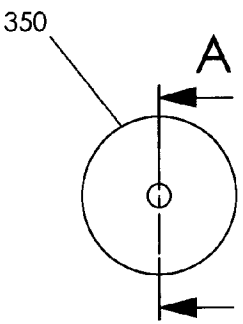
FIG. 121 is an end view of the container in FIG. 120.

FIGS. 120–122 show one embodiment of a liquid container according to an aspect of the invention, which liquid container is generally indicated with the reference number 350. The liquid container comprises a rigid outer shell 351 which is impermeable to air and may in this respect comprise nylon or an impermeable aluminum layer. The rigid outer shell 351 is in the present embodiment formed as a cylinder with closed ends, but may also be formed in a rectangular or any other suitable shape. The rigid outer shell 351 provides a liquid container which is easy to handle and offers adequate protection against mechanical impact, in particular of sharp or pointed objects.

The outer shell 351 comprises a liquid outlet 352 through which the liquid contained in the liquid container can be dispensed. The liquid outlet 352 may have any suitable design, but can preferably be connected to a pump or such in an air-tight manner. Before use the liquid outlet 352 is preferably sealed, for instance by an aluminum foil, which can be removed or punctured in order to open the liquid outlet 352.

In the outer shell a vent hold 358 is present for admitting air into the liquid container 350 to take the place of dispensed liquid. Before use, the vent hole 358 may be sealed, for instance by an aluminum foil layer, which seal can be removed or punctured to open the vent hole 358. It is also possible that the cylindrical end of the rigid outer shell 351, where the vent hold 358 is situated, is not closed but open, whereby this open end is sealed by an air-impermeable foil, for instance an aluminum foil. The vent hole 358 may then be formed by puncturing the circular foil.

The liquid container 350 further comprises an expandable air-receiving element in the form of an air-receiving bag 356 having an air-impermeable wall, which air-receiving bag 356 is placed within the outer shell 351 and air-tightly sealed to the outer shell 351. The vent hold 358 is in communication with the space within the air-receiving bag 356 so that air coming into the container 350 via the vent hold 358 during dispensing of the liquid will enter into the air-receiving bag 356.

In the present embodiment the air-receiving bag is made of a flexible air-impermeable material, which may comprise nylon or an aluminum layer in order to obtain the air-impermeability. The air-receiving bag 356 may also comprise rigid parts. For example, the air-receiving bag 356 may be formed from a flexible sleeve with two open ends, whereby one of the open ends is sealed to the rigid outer shell 351 and the other open end is sealed to a follower piston 354, which will be discussed hereinafter. It is also possible to provide the vent hole 358 in the wall of the air-receiving element, in which case a part of the air-receiving element may also form a part of the outside of the liquid container.

The expandable air-receiving bag 356 comprises folded segments which will be unfolded when the air-receiving bag 356 fills with air. The air-receiving bag 356 is designed in such a way that the bag, when fully expanded, may take in a volume which is at least substantially equal to the internal volume of the liquid container 350. As a consequence, all liquid contained in the container 350 may be dispensed therefrom, whereby the air-receiving bag 356 expands due to entering air to take in the space of the dispensed liquid, without at any time the liquid being in contact with the air that enters the liquid container.

In the liquid container 350 a follower piston 354 is provided which follower piston 354 is placed between the space 353 in which the liquid is contained and the air-receiving bag 356. This follower piston 354 will move during dispensing of the liquid in the space 353 towards the liquid outlet 352. During this movement the follower piston 354 will scrape off any liquid that sticks to the inner walls of the rigid outer shell 351.

Further, the follower piston 354 separates the space 353 wherein the liquid is contained from the air-receiving bag 356 so that the choice of the material of the air-receiving bag 356 is not influenced by the liquid which provides a wider choice of materials. Although not shown, the follower piston may be formed complementary to the end of the cylindrical outer shell 351, i.e., in the present case with a dome, in order to make it possible that all liquid can be dispensed from the liquid container 354.

In order to improve the expanding of the expandable bag 356 a part of the air-receiving bag 356 may be connected to the follower piston 354.

Figure 123:
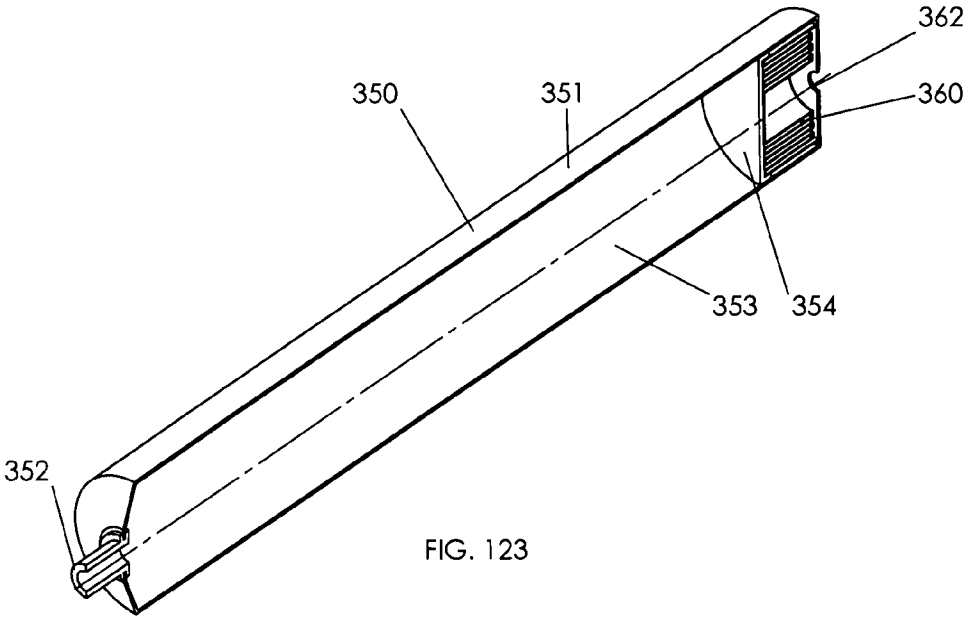
FIG. 123 is a view showing a cross-sectional view of a third embodiment of a hair dye container.
Figure 125:
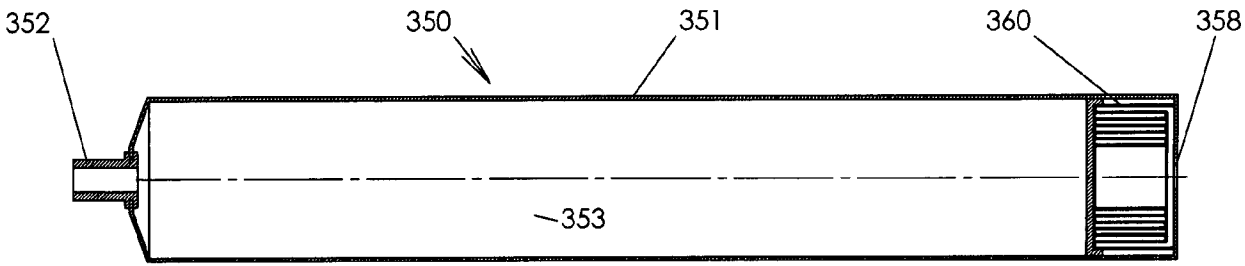
FIG. 125 is a view taken along line A-A of FIG. 124.
Figure 124:
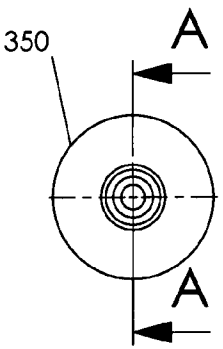
FIG. 124 is an end view of the container in FIG. 123.
Figure 126:
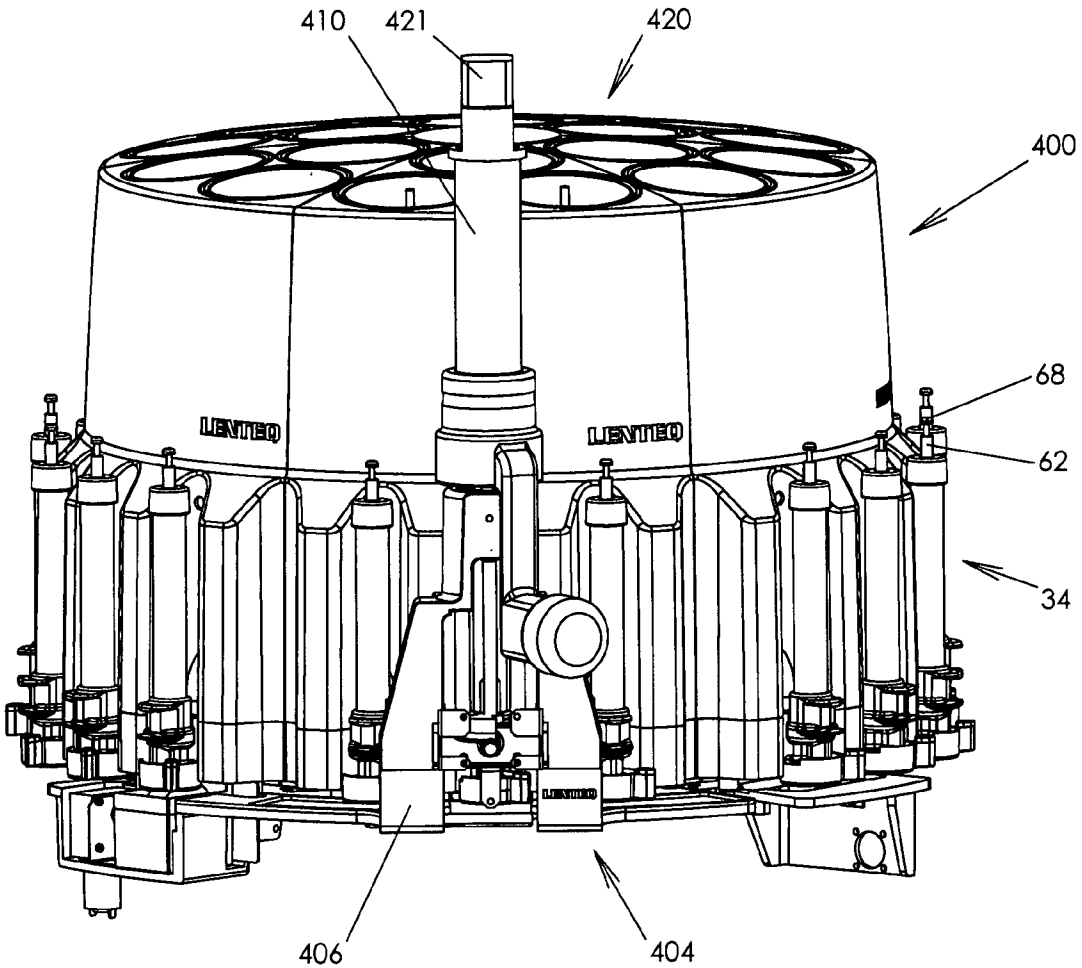
FIG. 126 is a perspective view of a manual deluxe or semi-automatic colorant dispensing machine.
Figure 127:
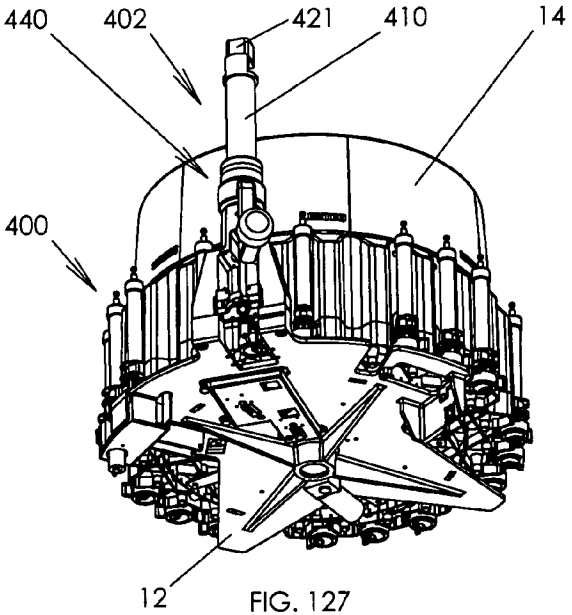
FIG. 127 is a bottom perspective view of the dispenser of FIG. 126.
Figure 128:
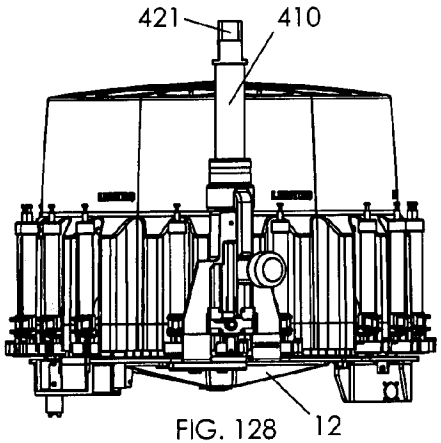
FIG. 128 is a side elevation of the dispenser of FIG. 126.
Figure 129:
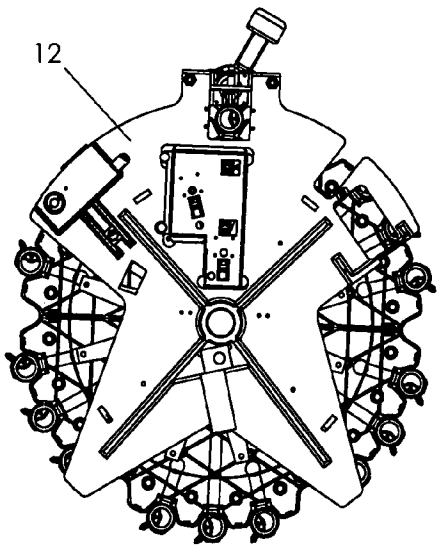
FIG. 129 is a bottom view of the dispenser of FIG. 128.

FIGS. 123–125 show an alternative air-receiving bag 360 whereby folds of the folded segments are provided in a direction parallel to the longitudinal direction of the cylindrical liquid container 350. All other parts of the liquid container in FIGS. 123–125 correspond to the parts of the embodiment of FIGS. 120–122 and are indicated by the same reference numbers.

An advantage of the liquid container shown in FIGS. 123–125 is that the vent hole 362 can be provided at any location in the circular end of the liquid container. This is of particular advantage when this circular end is provided with a sealing foil which has to be punctured to provide the vent hold 358. With the embodiment of the flexible bag no erroneous puncture can be made.

The above described liquid container is suitable to be used for any liquids, pastes or such that are degradable by air, in particular oxygen, such as hair dye, or liquids that may dry out due to evaporation.

Some of the several containers described herein, for paint or hair-dye, may be disconnectable from the dispenser apparatus, in particular the receptacle. For the disconnecting of the container at least one disconnecting device (not shown) is provided. It is possible to provide for each of the disconnectable container a separate disconnecting device which may be mounted on the movable in particular rotatable structure, i.e. the support structure or the canister units.

In a preferred embodiment one stationary disconnecting device is provided for disconnecting, per actuation, one of the containers being coupled to the dispenser apparatus. Such stationary disconnecting device may be designed as a lever which is pivotably mounted on a stationary structure. The stationary disconnecting device may at least be pivoted between a first position wherein the movable/rotatable structure is free to move/rotate about its axis and a second position in which a container coupled to the dispenser apparatus and placed in front of the disconnecting device is disconnected from the dispenser apparatus.

The lever may comprise an actuation end which is actuable by hand or an actuator and a disconnecting end which cooperates with the respective container.

When the dispenser apparatus comprises two or more concentric rings wherein containers may be coupled to the dispenser apparatus, the stationary disconnecting device may be designed to disconnect each container being positioned in front of the stationary disconnecting device independent of in which concentric ring the container to be disconnected is present. For this reason the lever may comprise two disconnecting ends, one for each concentric ring and both being capable of disconnecting a container when positioned in the second position.

As an alternative embodiment the lever may be pivotable in a third position, so that in the second position a container in a first concentric ring is disconnected and in the third position a container in a second concentric ring is disconnected. In such embodiment the second and third position may be on opposite sides of a central first position of the lever. In yet another embodiment a stationary disconnecting device is provided for each concentric ring of containers.

As mentioned above, the apparatus 10 is a fully-automatic colorant dispenser and the apparatus 310 is a fully automatic hair dye dispenser. In these machines all indexing, dispensing and stirring being controlled automatically by a microprocessor controlled by software modules. In this version, the operator of the dispensing machine need only input the desired color to be dispensed and the amount, and the software control logic will perform all of the necessary functions and steps. Also, as discussed above, the software control logic also determines when to stir each canister-receptacle, if at all, for how long, at what rate, whether such rate be constant over the entire stirring cycle, or variable thereover. It is understood that all the software logic functions can be performed by a stand along microprocessor or a computer directly wired or wirelessly controlled to the dispenser or the logic may be hardwired with discrete devices. Display devices may also be provided either coupled directly to or wirelessly coupled to the dispenser to input formulations and other variables required as described herein.

In a modification of the dispenser 10, there is provided what may be termed a semi-automatic or enhanced manual version where all steps, rather than being controlled by control software, all but the piston-actuation metering or measuring steps, are performed manually. Thus, under this modification, rotation or indexing of the carousel of canister-segments 14 is done manually, with the above-described worm-gear drive assembly 140 being obviated and absent from this modification. Moreover, the camming pins 62 associated with each canister-receptacle 15, 16A and 16B that ride in the worm-gear assembly may or may not be included with a canister-segment 14. In this enhanced manual modification, all other parts are identical to those of the above-described automatic dispenser 10 except for the dispensing actuator assembly, as described in detail hereinbelow.

Referring to FIGS. 126–159, there is shown an enhanced manual or semi-automatic paint dispensing apparatus of the invention, which is indicated generally by reference numeral 400. It does not include a worm drive and is manually rotated. The apparatus 400 is otherwise identical to the automatic machine 10, except for the dispensing actuator assembly 402.

Figure 132:
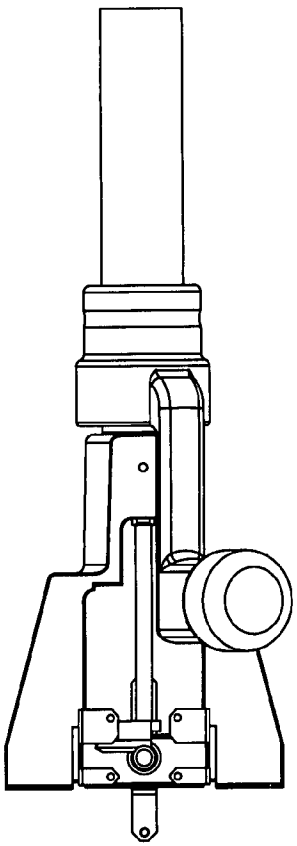
FIG. 132 is a perspective view of the actuating and dispensing assembly used in the manual hair dye dispenser.
Figure 131:
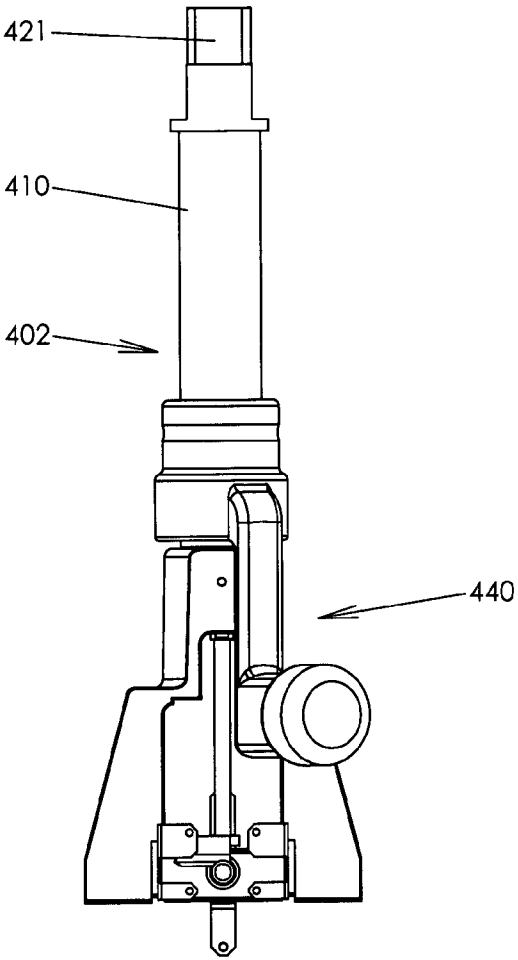
FIG. 131 is a perspective view of the actuating and dispensing assembly used in the deluxe manual/semi-automatic colorant and hair dye dispensers.
Figure 130:
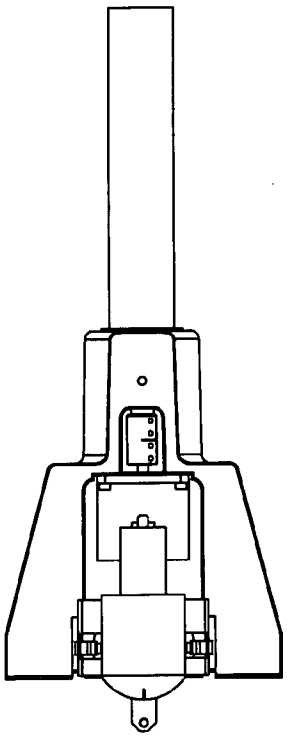
FIG. 130 is a perspective view of the actuating and dispensing assembly used in the automatic colorant and hair dye dispensers.
Figure 133:
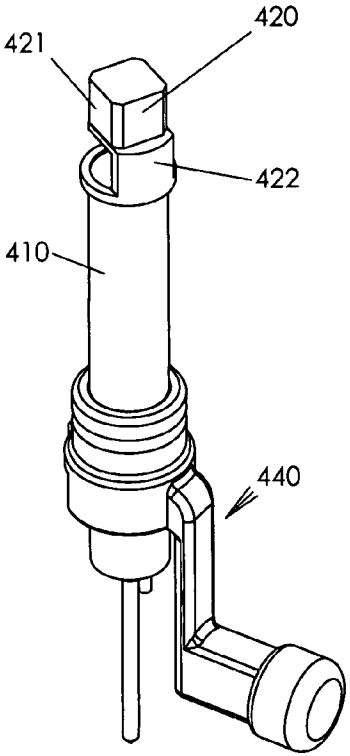
FIG. 133 is a perspective view of the dispensing handle structure.
Figure 134:
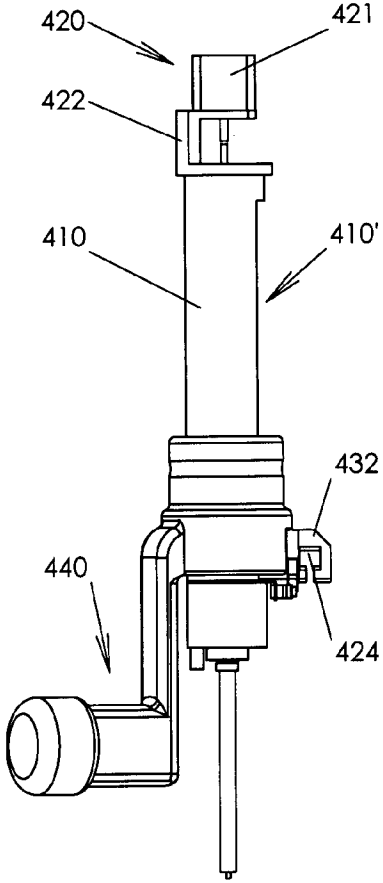
FIG. 134 is a view similar to FIG. 133 but rotated $90^2$.
Figure 135:
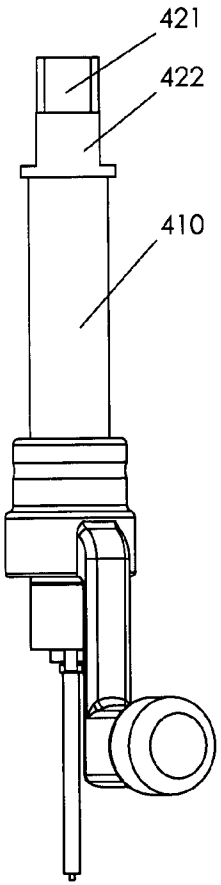
FIG. 135 is a front view of the assembly shown in FIG. 133.
Figure 136:
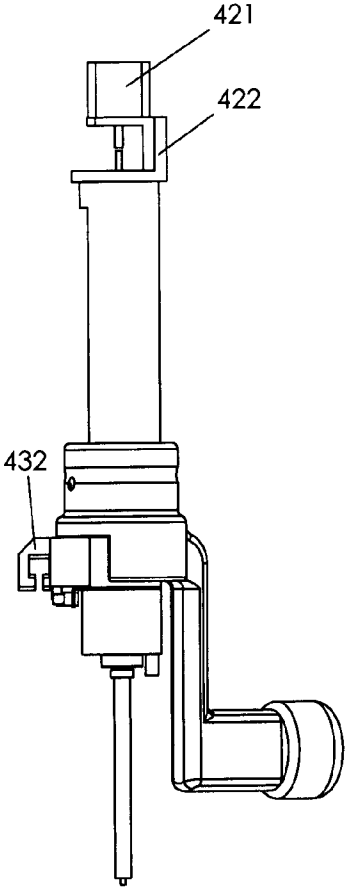
FIG. 136 is a side view of the assembly shown in FIG. 133.
Figure 137:
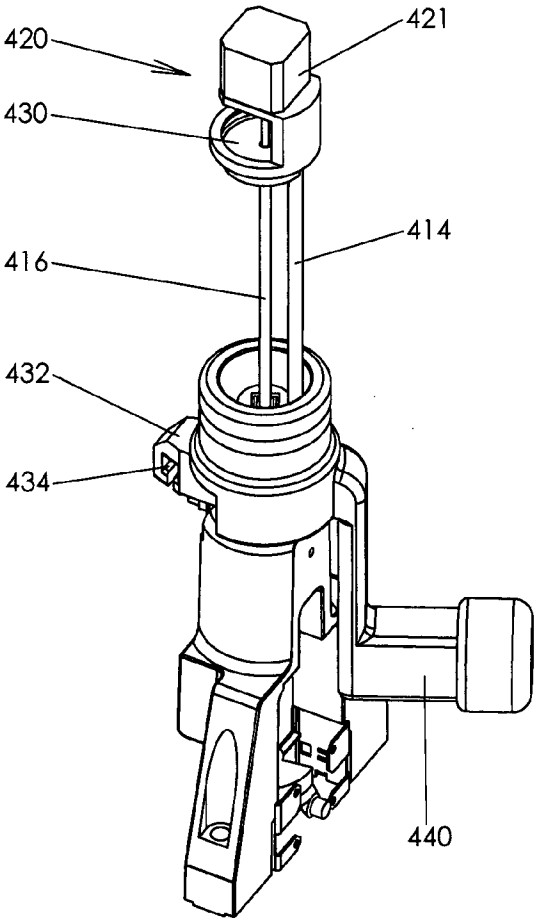
FIG. 137 is perspective view partially broken away of the actuating and dispensing assembly mounted on the bridge at the dispensing station.
Figure 138:
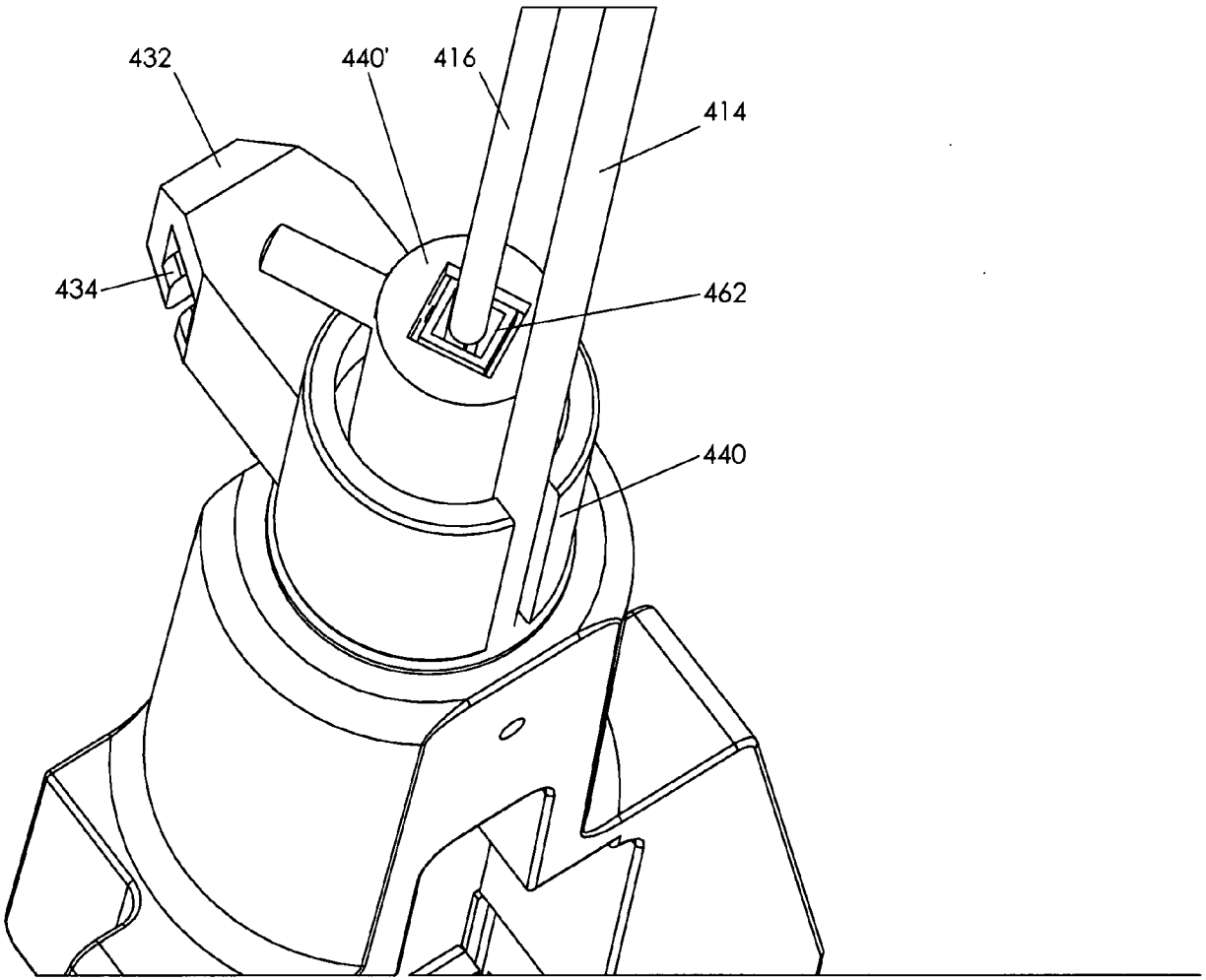
FIG. 138 is a perspective view of the gripper assembly.
Figure 140:
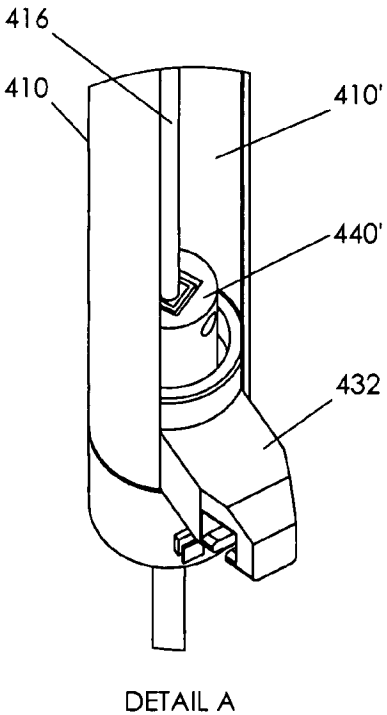
FIG. 140 is an enlarged view of the circled portion of FIG. 139.
Figure 139:
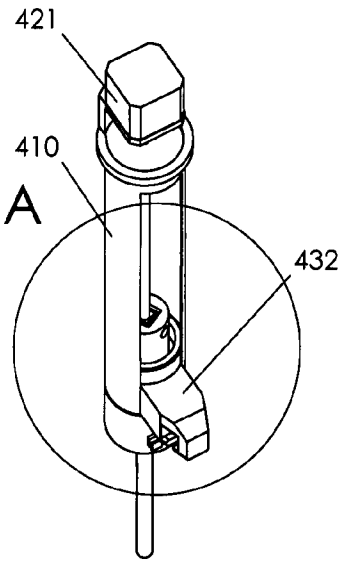
FIG. 139 is a partial perspective view of the upper portion of the actuating and dispensing assembly.
Figure 141:
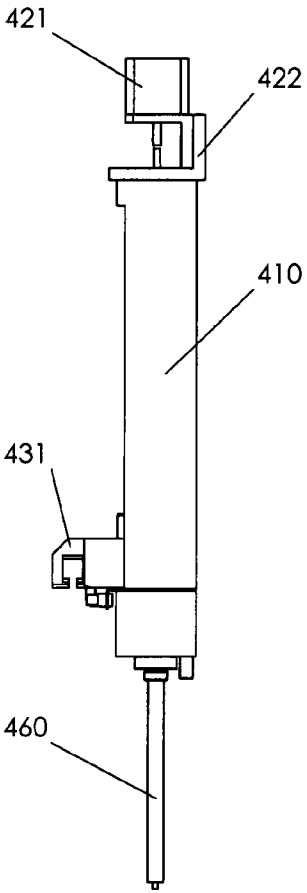
FIG. 141 is a side view of the assembly in FIG. 139.
Figure 142:
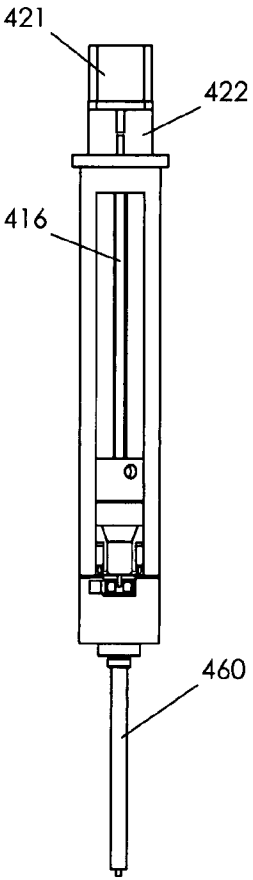
FIG. 142 is a front view of the assembly of FIG. 139.
Figure 143:
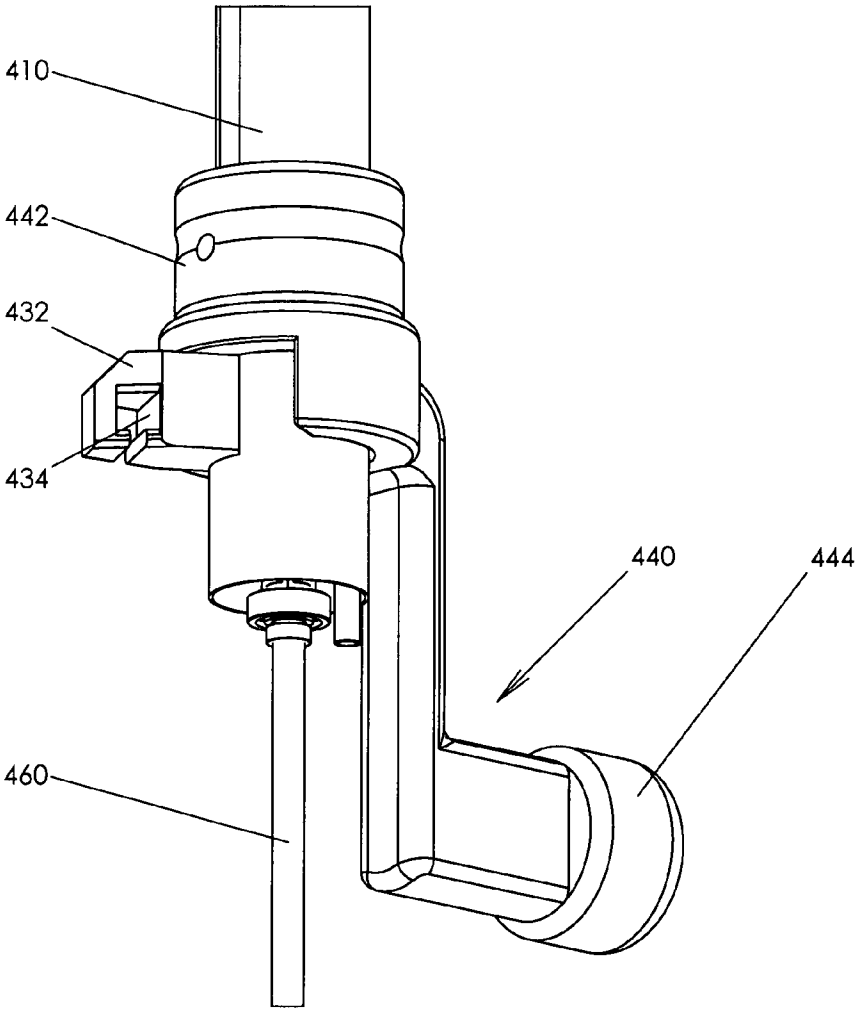
FIG. 143 is a perspective view of the intermediate portion of the actuating and dispensing assembly.
Figure 144:
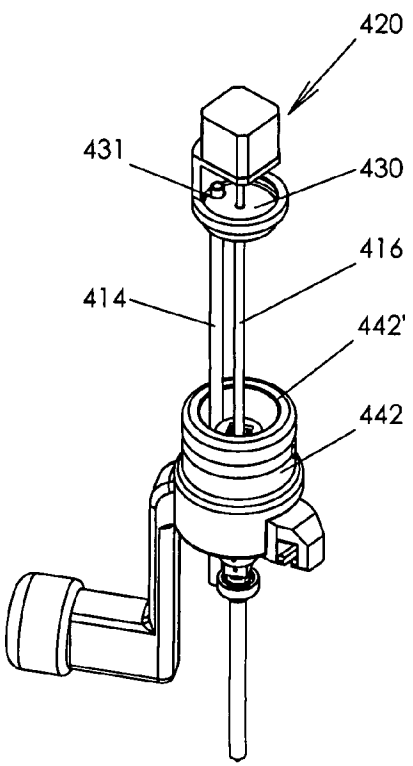
FIG. 144 is a broken away perspective view of the upper portion of the actuating and dispensing assembly.
Figure 145:
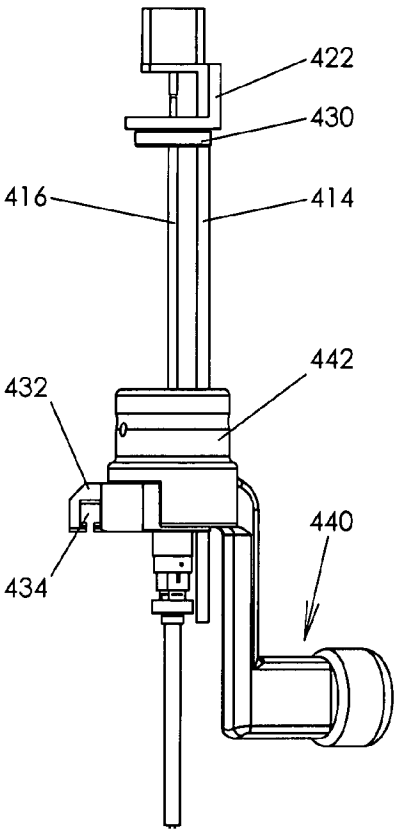
FIG. 145 is a side view of the assembly of FIG. 144.
Figure 146:
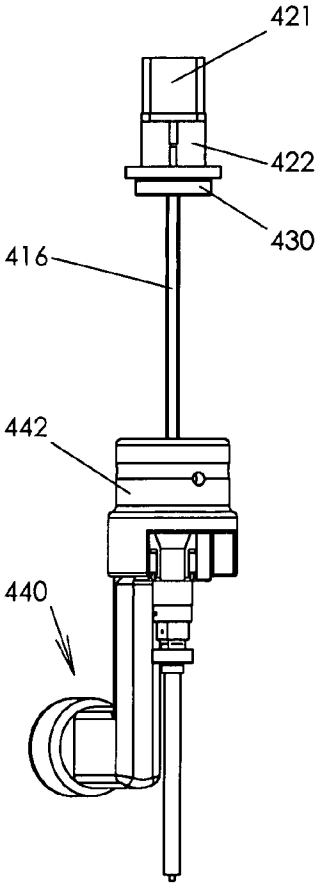
FIG. 146 is a view taken at a different angle than FIG. 145.

In FIGS. 130–132 there is illustrated the three bridge and dispense actuating assembly used in the various versions of the colorant and hair dye dispensers.

FIG. 130 is the fully automatic dispenser actuating assembly used in both the automatic colorant and hair dye dispenser. FIG. 131 is the semi-automatic dispenser actuating assembly used in the manual deluxe or semi-automatic versions of the colorant dispenser and hair dye dispenser which is described and FIG. 132 is the version used in the essentially manual version of the dispenser actuating assembly which will be discussed in conjunction with the manual hair dye dispenser following the description of the version illustrated in FIG. 131.

The dispensing actuator assembly 402 is mounted at the dispensing station 404, to mounting bridge 406 which is substantially identical to the mounting column or bridge 150 of the above-described apparatus 10. The dispensing actuator assembly 402 includes a stationary, vertical, cylindrical tube 410 which is mounted in the upper or top opening of the mounting bridge 406. Mounted within the tube 410 is a stationary guide rod 414, and a rotatably mounted threaded traversing rod 416. The traversing rod 416 is drivingly rotated by drive motor assembly 420 that is mounted on the top or upper portion of the cylindrical tube 410. A bracket 422 connected to the drive motor assembly and housing helps to mount the upper end of the guide rod 414. Threading connected to the threaded traverse rod 416 is a circular plate or member 430, which plate 430 is reciprocal in the vertical direction along traverse rod 416 depending upon the direction of rotation of the traverse rod 416. The circular plate 430 serves as an upper limit stop by which a precise and measured amount of color tint is dispensed from a canister-receptacle that is being dispensed, as described hereinbelow.

The drive motor assembly 420 includes a stepping motor 421 that rotates the traverse rod 416, and which is automatically controlled by software control of the apparatus 400. The software control determines how much of a specific color tint must be dispensed from the canister-receptacle located at the dispensing station 404, and then controls the stepping motor 421 to rotate the traverse rod 416 the desired amount, in order to position the limit stop plate 430 at the desired height with respect to the respective enlarged head 68 of the piston rod 66 of a dispensing piston/cylinder pump arrangements 34 that is to be dispensed, as described above with reference to apparatus 10. The limit stop 430 limits the vertical distance the piston of the dispensing piston/cylinder pump arrangements 34 is lifted up via a gripper 432 similar to the above-described gripper 182 of apparatus 10, and has a notch or catch 434, like notch or catch 184 of apparatus 10, in which is received a respective enlarged head or flange 68 of a respective piston of a respective canister-receptacle positioned at the dispensing station, whereby the preselected amount of color tint is drawn up. The circular plate 430 also has another, radially offset hole or opening 431 in which is received the upper end of the guide rod 414, whereby the limit stop 430 is adequately and firmly mounted for serving as a limit stop. It is also noted that the guide rod 414 is preferably hollow in order to serve as an electrical conduit for the electrical leads for the stepping motor 421 of the drive motor assembly 420 and a stepping motor that drives a rotatable lever actuator or arm similar to above-described lever arm of the rotatable valve actuating mechanism 200 of apparatus 10 illustrated in FIG. 72, and as further described hereinbelow.

The gripper 432 forms part of an overall actuating and dispensing handle structure 440. The actuating and dispensing handle structure 440 includes a tubular sliding mounting sleeve 442 that is vertically slidable along the cylindrical tube 410, and also has a handle portion 444 rotatably mounted to the mounting sleeve 442. The handle portion 444 is positioned diametrically opposite to the gripper 432, and both handle portion 444 and gripper 432 are moved vertically along the cylindrical tube 410 as the tubular sliding mounting sleeve 442 is moved vertically. The entire assembly is moved vertically along the cylindrical tube 410 by manually gripping the handle portion 444, and moving the assembly in the upward direction until the upper, annular rim or lip 442' abuts against the limit stop 430 as previously positioned by the drive motor assembly 420.

It is noted that the stationary, vertical, cylindrical tube 410 is provided with a partial, arcuate, vertical cutout or channel 410' through which outwardly projects the above-mentioned gripper 432 for receiving the enlarged head or flange 68 of a respective piston of a respective canister-receptacle positioned at the dispensing station. On the opposite side of the channel 410' is a partial vertical window through which projects the handle portion 444, and which window section not only allows for the vertical travel of the handle portion 444, but is wide enough so as to allow enough freedom of motion to the handle portion 444 so that the handle structure 440, excluding the gripper 432, may be turned or rotated in a horizontal plane, as described in detail below. Thus, after the respective flange 68 of a respective canister-receptacle to be dispensed is received in the notch or catch 434, and after the limit stop 430 has been appropriately and automatically located via the drive motor assembly 420 and traverse rod 416 to the required height, one then manually lifts the actuating and dispensing handle structure 440 via the handle portion 444 thereof until further movement is prevented by contact with the limit stop 430. Consequently, as the actuating and dispensing handle structure 440 is lifted up until the limit stop 430, the piston rod 62 with piston head of the dispensing piston/cylinder pump arrangements 34 being dispensed is also lifted up to create a vacuum to draw up the desired color tint contained in the associated canister-receptacle. It is noted that the valve plates 94, 96 of the valve mechanism 90, described above in detail, is controlled to first allow drawing in and then to allow dispensing, as above-described, which valve mechanism 90 is controlled or actuated by a rotatable lever actuator or arm similar to above-described lever arm of the rotatable valve actuating mechanism 200 in a manner to be described below. The connection between the gripper 432 and the rest of the handle structure 440 is by a conventional slide connection that allows the gripper 432 to be moved vertically along with the handle section 432, but which also allows the rest of the handle structure to rotate relative to the gripper 432, whereby the gripper 432 does not rotate with the rest of the handle structure 440, which rotation of the handle structure is done in order to actuate the valve mechanism for dispensing, as described below.

As mentioned above, as the actuating and dispensing handle structure 440 is moved upwardly, the gripper pulls up the actuating piston head of the respective dispensing piston/cylinder pump arrangements 34 being dispensed. After the upper limit stop 430 is reached, the desired color tint has been drawn into the dispensing cylinder of the dispensing piston/cylinder pump arrangements 34. At this juncture, it is necessary to actuate the valve mechanism 90 by rotating the lower ceramic disk 96, as described in detail above with reference to the automated colorant dispenser 10. However, in the automated colorant dispenser 10 such actuation is accomplished automatically by using software control logic. In the manual apparatus 400 the valve mechanism 90 is actuated or controlled manually via the actuating and dispensing handle structure 440. Specifically, after the actuating and dispensing handle structure 440 has reached its upper limit of travel by contact with the limit stop 430, the handle structure 440, exclusive of the gripper 432, is rotated in a horizontal plane by means of the handle portion 444 in order to actuate the valve mechanism 90 in the manner described below. After the rotation or turning of the handle structure 440 in the counterclockwise direction when viewing FIG. 133, the entire actuating and dispensing handle structure 440 is moved manually downwardly in order to dispense the color tint.

Figure 147:
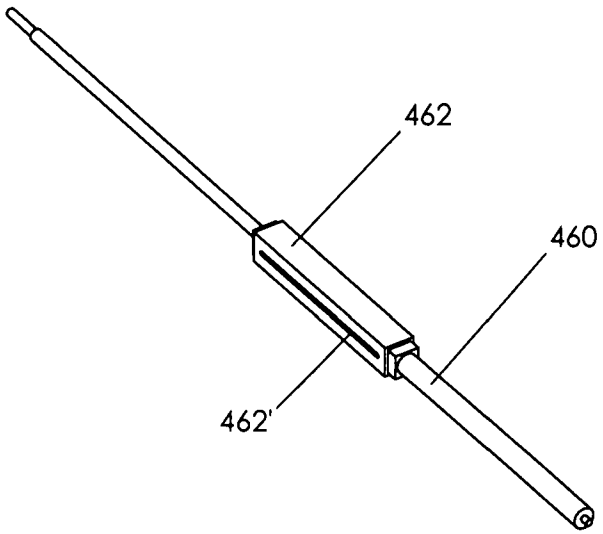
FIG. 147 is a perspective view of the control shaft of the actuating and dispensing assembly.
Figure 148:
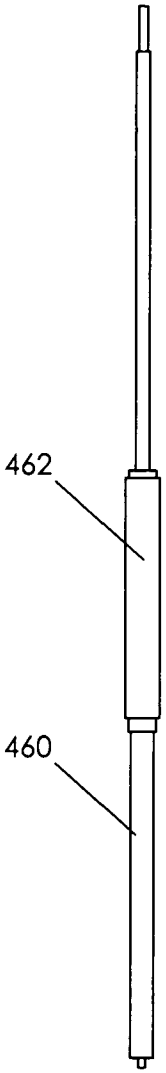
FIG. 148 is a front view of the control shaft of FIG. 147.
Figure 149:
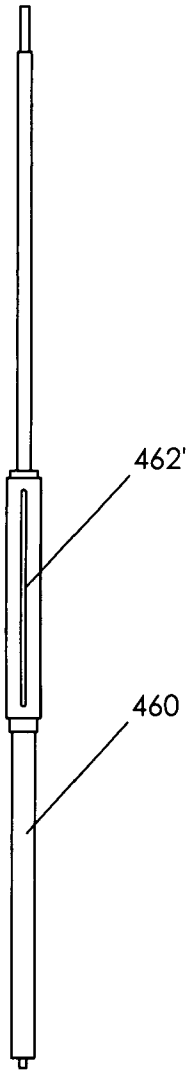
FIG. 149 is a rear view of the control shaft of FIG. 147.
Figure 150:
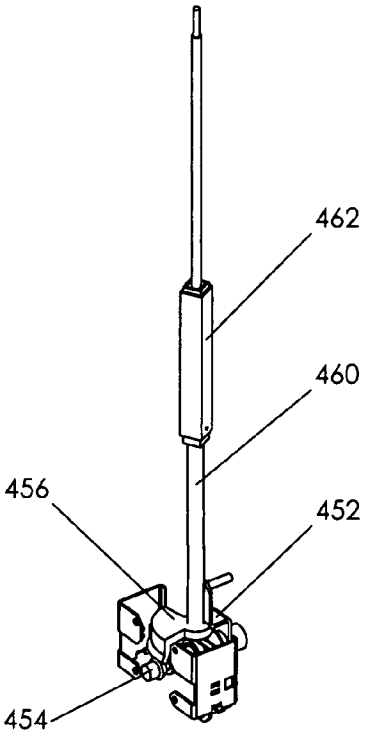
FIG. 150 is a perspective view of the valve control mechanism and control shaft.
Figure 151:
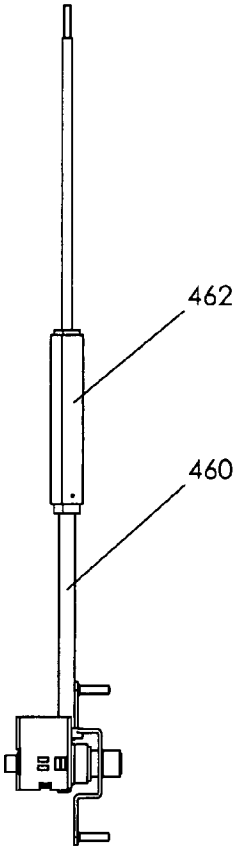
FIG. 151 is a side view of the assembly of FIG. 150.
Figure 152:
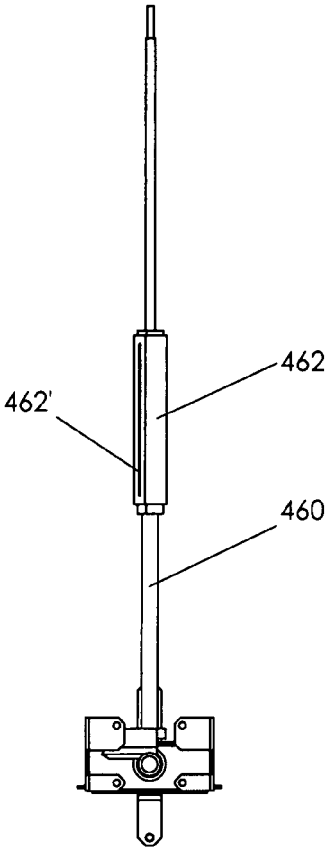
FIG. 152 is a front view of the assembly of FIG. 150.
Figure 153:
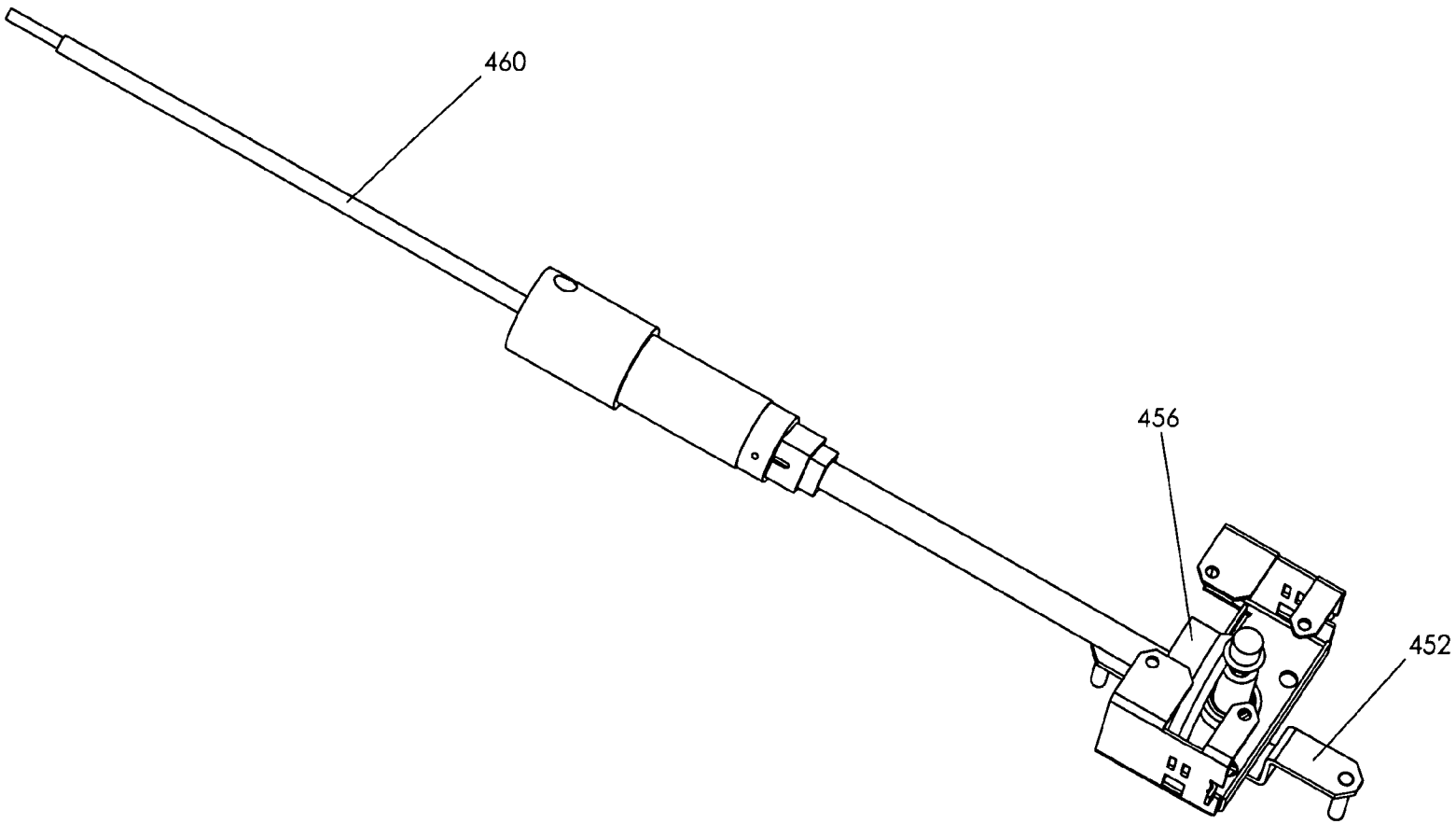
FIG. 153 is a perspective view of the control shaft and valve control mechanism.
Figure 154:
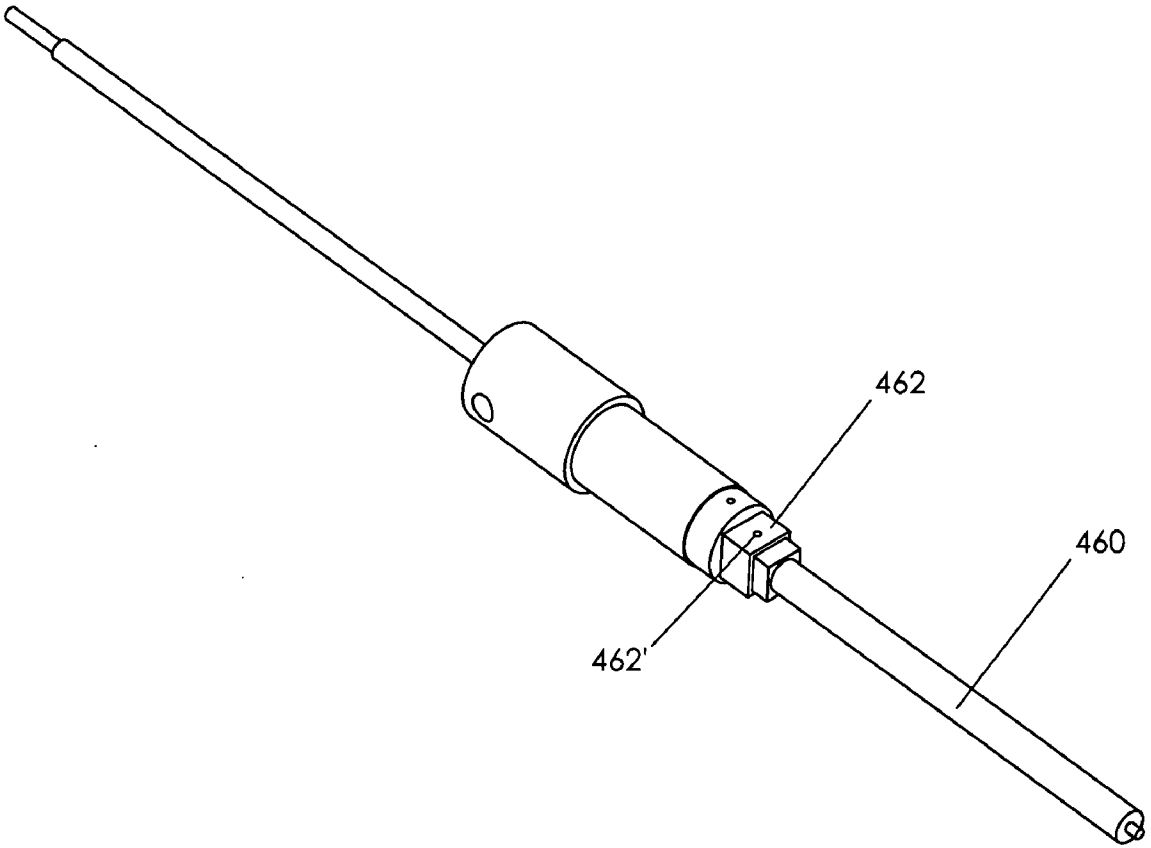
FIG. 154 is a perspective view of the assembly of FIG. 153 without the valve control mechanism.
Figure 155:
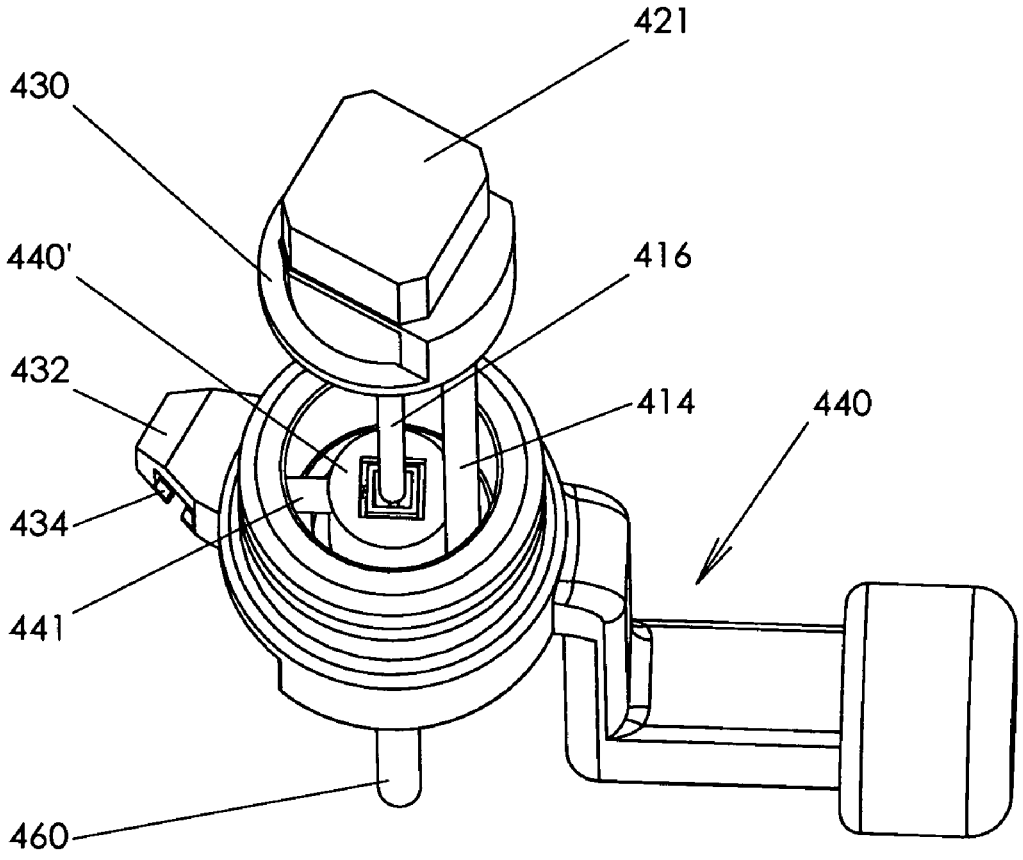
FIG. 155 is a perspective view broken away of the gripper and handle assembly.
Figure 157:
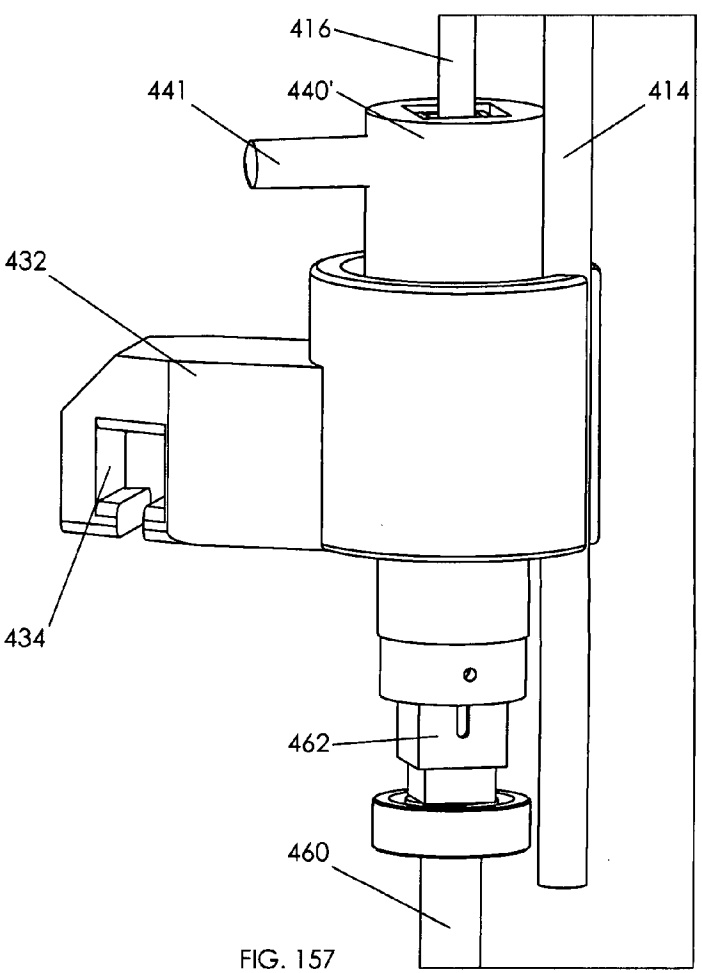
FIG. 157 is a view similar to FIG. 156 but taken from the opposite side.
Figure 156:
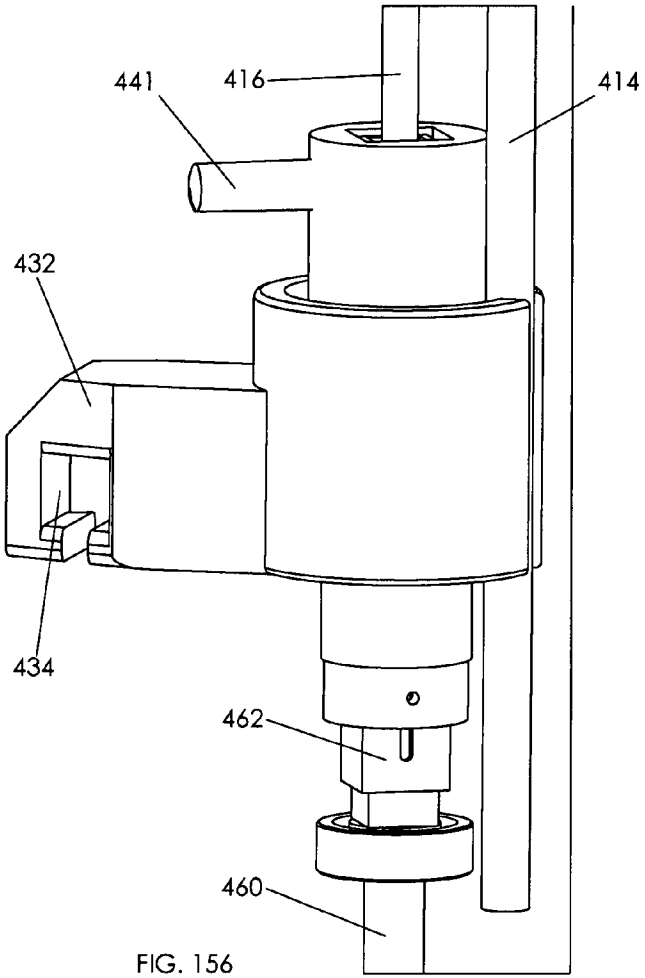
FIG. 156 is a perspective view of the gripper and control shaft assembly.
Figure 158:
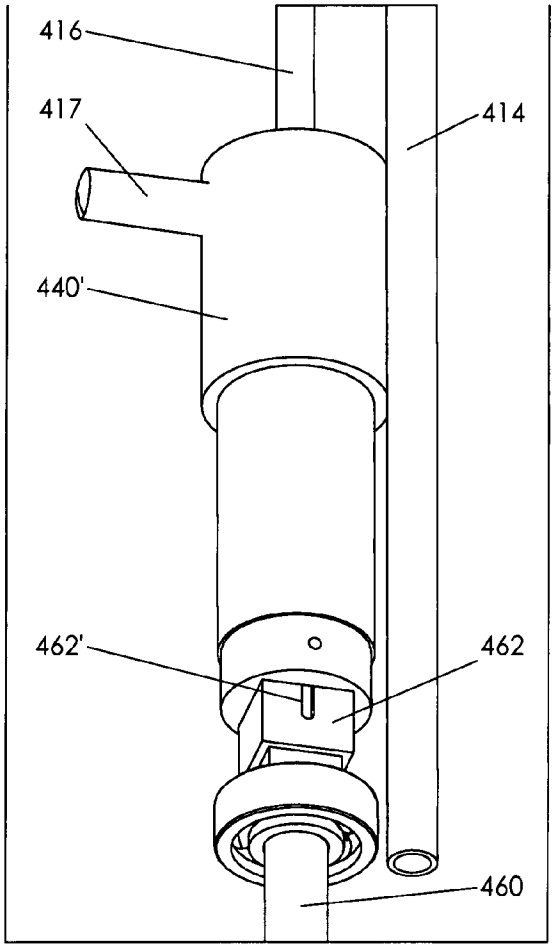
FIG. 158 is a perspective view of the control shaft assembly and associated stationery guide rod.
Figure 159:
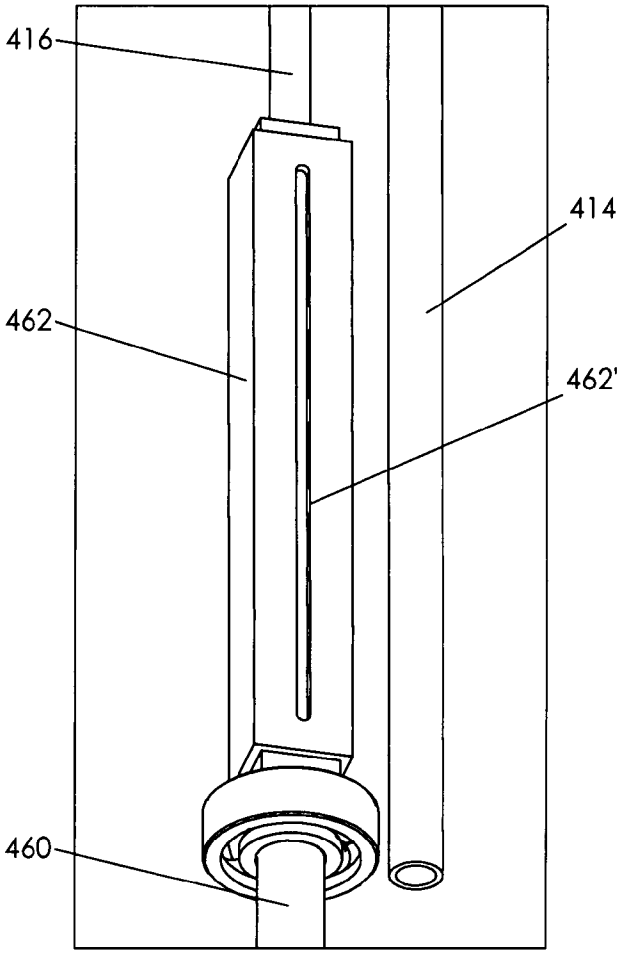
FIG. 159 is a perspective view of the control shaft and associated guide rod.

The mechanism for actuating or controlling the valve mechanism 90 is best seen in FIGS. 147–154, and indicated generally by reference numeral 450, and includes a rotatable lever actuator or arm 452 (see FIGS. 150 and 153) similar to above-described lever arm of the rotatable valve actuating mechanism 200. The pivot shaft that rotatably mounts the rotatable lever actuator or arm 452 drives rotary-converter gearing 454 which includes an arcuate or conical gear 456 which is connected to, or part of, a stationary rotary actuator shaft 460 that extends vertically upwardly into the interior of the stationary, vertical, cylindrical tube 410, and interiorly of a bushing 430' of the actuating and dispensing handle structure 440. The bushing 440' is coupled to the handle structure 440 by means of a pin 441. The rotary actuator shaft 460 has a central square-shaped or rectilinear-cross-sectioned middle section 462 in which is formed a vertical channel or slot 462' (FIG. 147). This central square-shaped or rectilinear-cross-sectioned middle section 462 is received through and in the similarly cross-sectioned interior of the bushing 440'. The vertical slot 462' slidingly received therein a guide pin extending interiorly from the bushing 440', whereby the handle element 440 is allowed vertical movement with respect to the rotary actuator shaft 460 but also rotates the rotary actuator shaft 460 when the handle section 440 is turned or rotated.

After the handle structure 440 has been lowered for dispensing, it is rotated in the opposite direction to its initial position, which also will rotate the rotary actuator shaft 460 in the opposite direction, to thereby rotate the lower ceramic disc of the valve mechanism in the opposite direction, to close the valve mechanism, in the manner described in detail above with respect to the valve mechanism 90 of the automatic colorant dispenser 10.

It is to be understood that other, conventional mechanical converters may be employed for converting the rotation of the handle structure 440 about a vertical axis into the rotation about the horizontal axis of the pivot shaft that rotatably mounts the rotatable lever actuator or arm 452. It will be apparent to one of ordinary skill in the art that other conventional mechanical structures may be used for accomplishing the connection or coupling of the gripper 432 to the rest of the handle structure in order to allow only conjoint vertical movement but which excludes rotation of the gripper 432 with the rest of the handle structure 340, as well as for providing for the coupling of the handle structure 440 to the central square-shaped or rectilinear-cross-sectioned middle section 462 in which is formed vertical channel or slot 462' of the rotary actuator shaft 460 which allows relative vertical movement therebetween but for conjoint rotation.

Figure 160:
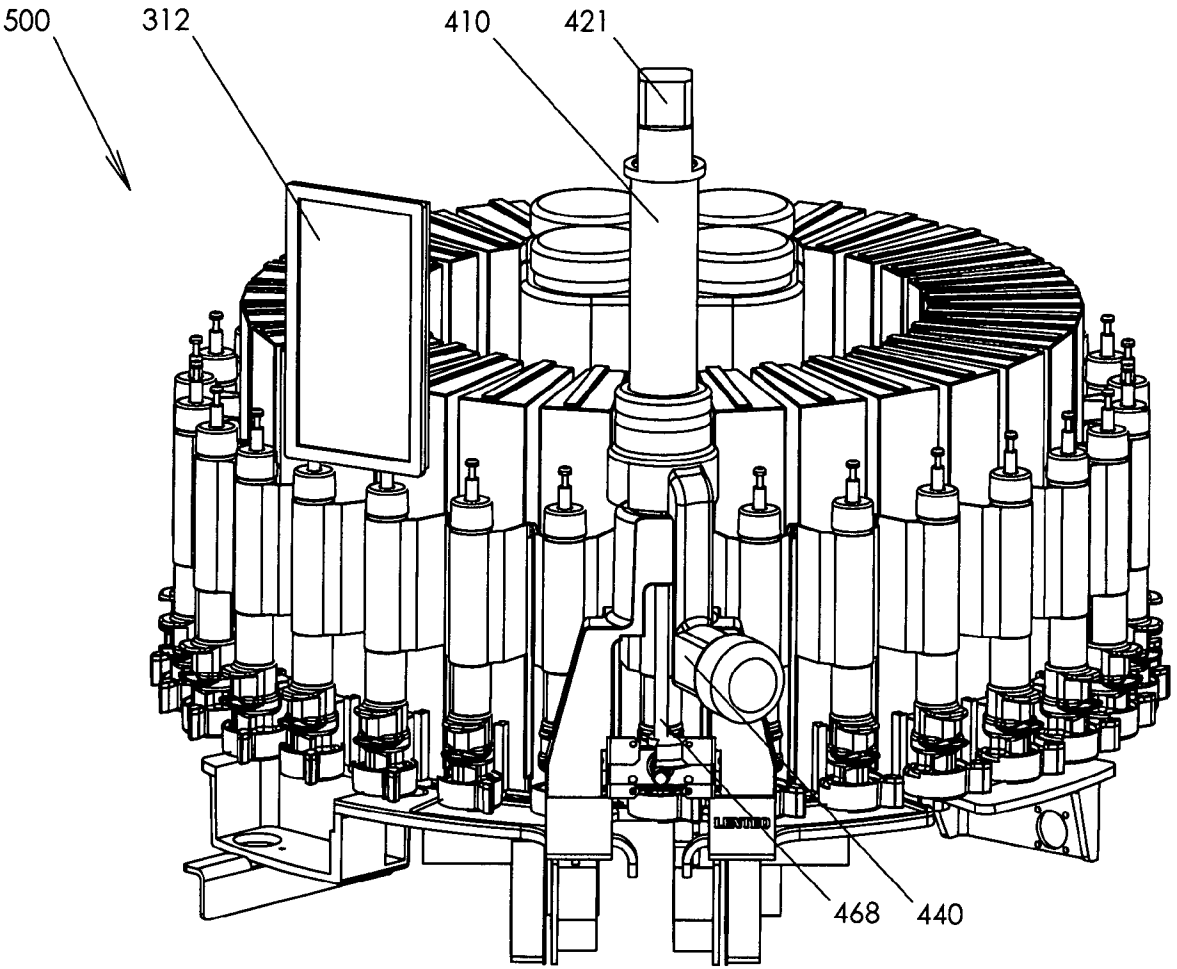
FIG. 160 is a perspective view of the deluxe manual/semi-automatic hair dye dispensing machine.

Consideration will now be given to the enhanced manual or semi-automatic hair dye dispenser. In this modification all steps rather than being controlled by software, all but the piston actuation metering or measuring steps are performed manually. The rotation or indexing of the turntable is done manually and does not use the worm drive. All other parts are identical to those of the above-described automatic hair dye dispenser 310. This semi-automatic or enhanced manual embodiment 500 illustrated in FIG. 160 is otherwise identical to the automatic hair dye dispenser illustrated in FIGS. 101–125 except that in place of the fully automatic version of the dispenser actuating assembly shown in FIG. 130 the dispensing actuator assembly shown in FIG. 131 which is illustrated and described in FIGS. 126–159 is used. This is the same version of the dispenser actuating assembly 402 used with the deluxe manual/semi-automatic colorant dispenser.

Figure 161:
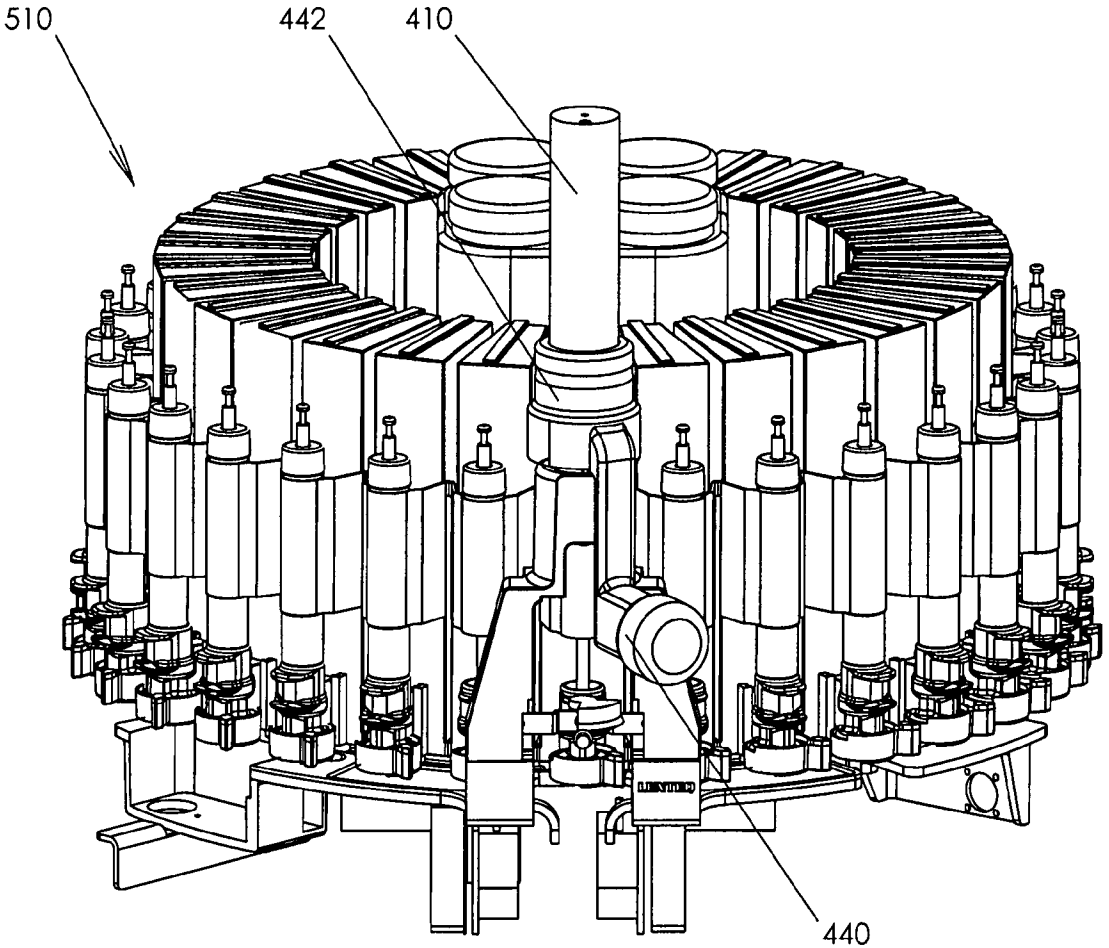
FIG. 161 is a perspective view of the essentially manual hair dye dispensing machine.

There remains to describe a third version of a hair dye dispenser which is similar to the enhanced manual/semi-automatic version illustrated in FIG. 160. This embodiment 510 is shown in FIG. 161 and uses the actuating dispensing assembly shown in FIG. 132 in place of the one shown in FIG. 131. In the manual version of the hair dye dispensing device 510 the actuating dispensing assembly does not include a stepping motor that is to program the amount of dye to be dispensed. In place of the motor the amount of dye to be dispensed is determined by a scale (not shown) located at the dispensing station. A read-out device could be located at the top of the tube 410 to indicate the weight of the dye being dispensed.

There is thus described above novel automatic and enhanced manual/semi-automatic colorant dispensers and automatic enhanced manual/semi-automatic and essentially manual hair dye dispensers.

Figure 162:
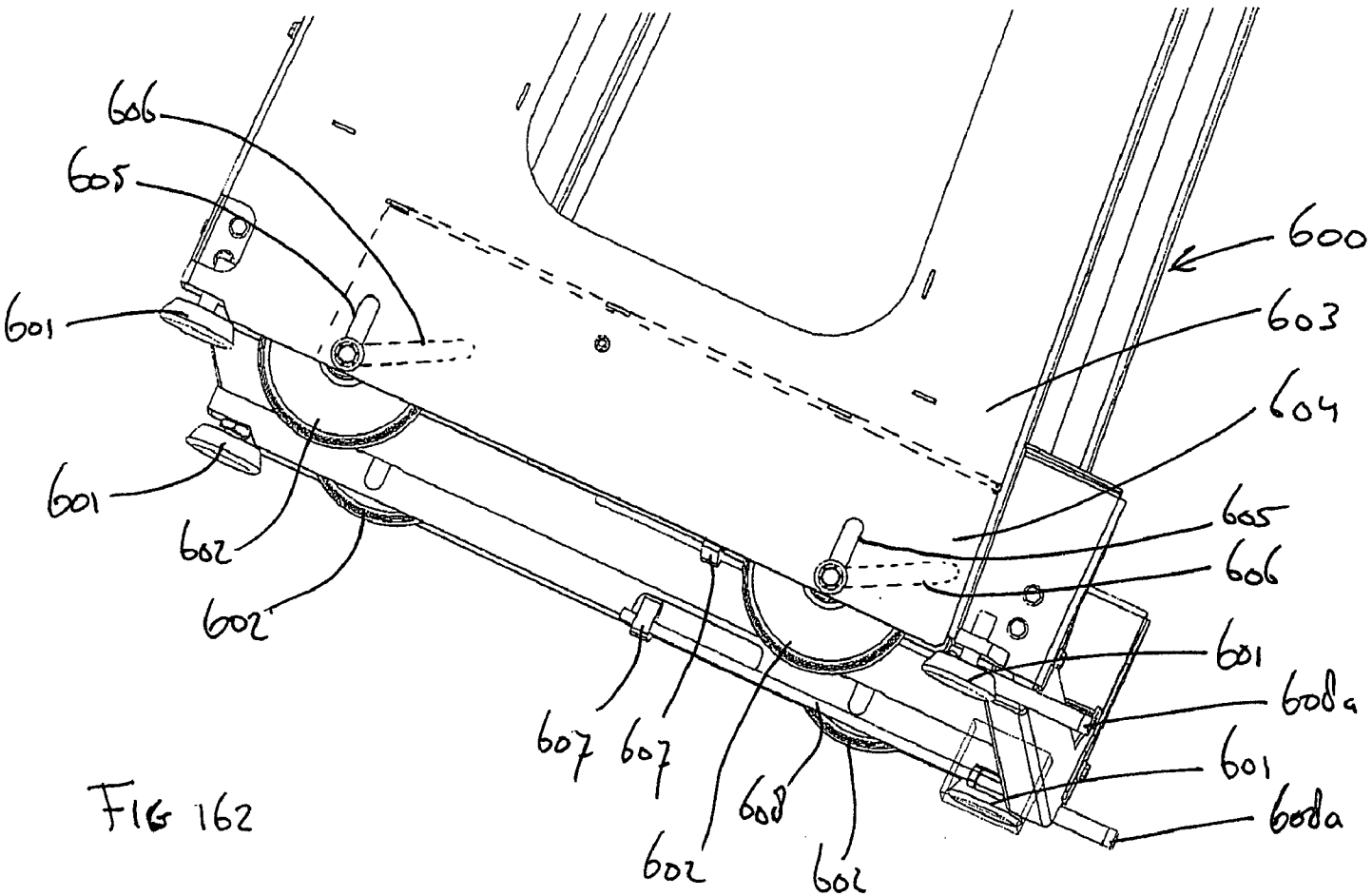
FIG. 162 is a perspective view of a support construction for the automatic and manual colorant and hair dye dispensers with the second frame element shown in hidden line.
Figure 163:
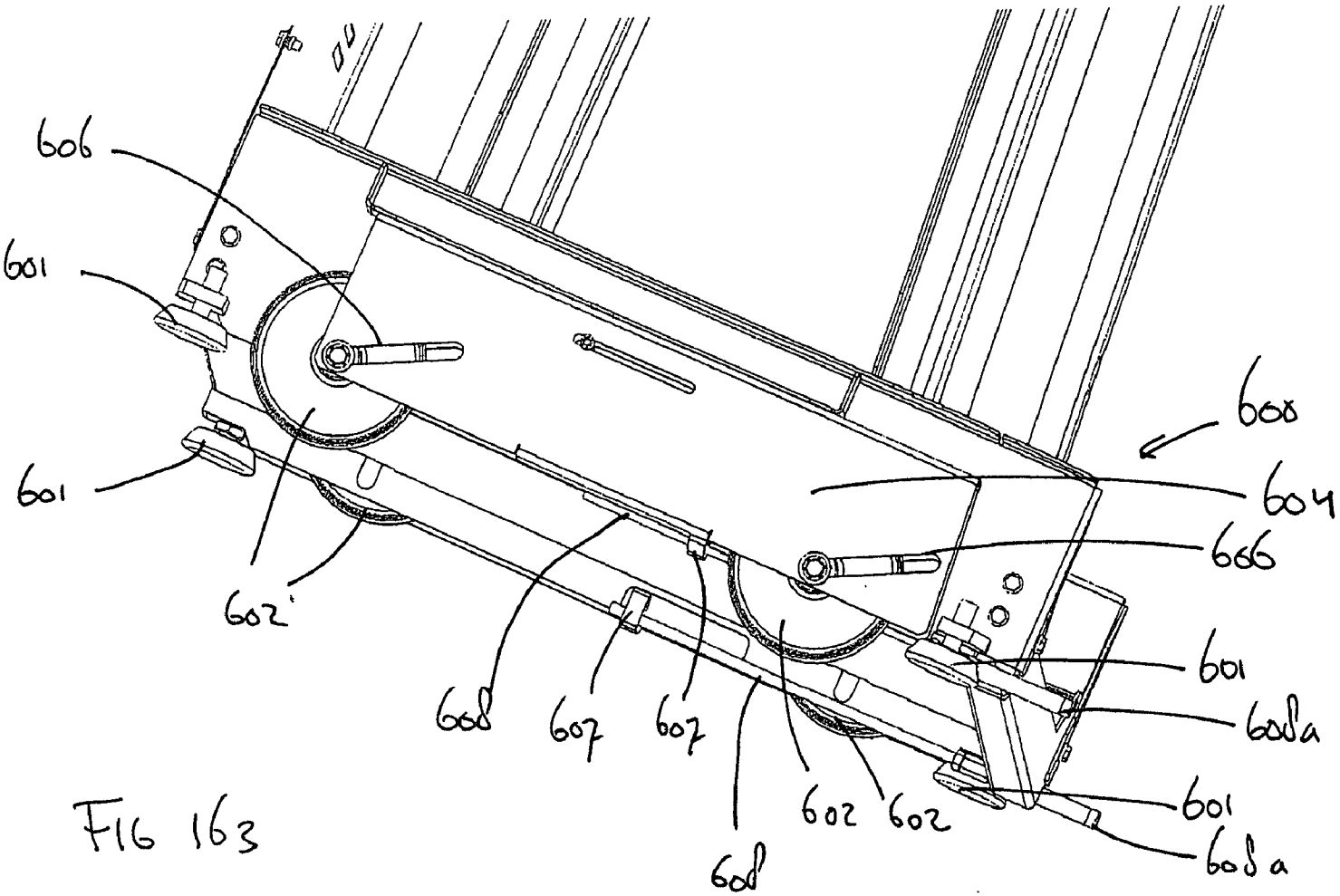
FIG. 163 is a perspective view of a support construction for the automatic and manual colorant and hair dye dispensers without the first frame element.

In FIGS. 162 and 163 a support construction 600 for supporting a colorant dispenser or hair dye dispenser as herein described. The support construction 600 may however be used for any other device for which it is suitable. The support construction 600 is in particular useful for devices which have to be supported firmly on a substantially horizontal floor, but which also regularly have to be displaced, for instance for service or maintenance.

The support construction 600 comprises four stationary supporting means in the form of legs 601. One or more of the legs 601 may be adjustable by a set screw to optimally place the support construction 600 on a supporting surface such as a floor. A support construction with the stationary legs 601 are well-known in prior art.

A disadvantage of these known legs 601 is that when a device has to be accessible on the sides or backside, for instance for servicing or maintenance, the device has to be moved which is due to the stationary supporting legs hard to do. Also the placing back and possibly new adjusting of the set screws of the device is difficult and/or time-consuming, whereby it is a further disadvantage that the set-screws at the backside of the device are difficult to reach.

In contrast, the support construction 600 as disclosed herein comprises four supporting wheels 602 which may be moved in a vertical direction with respect to the legs 601 so that selectively the support construction is supported on the floor or ground by the legs 601 or the wheels 602. For moving the wheels 602 moving means are provided. In general is meant with moving with respect to that the wheels may be movable with respect to the device or that, as an alternative, the stationary supporting means are movable with respect to the device and the wheels are stationary mounted on the frame supported. Also both the stationary supporting means and the wheels may be movable with respect to the device to selectively bring the stationary supporting means or the wheels lower than the other.

The support construction 600 comprises a first frame element 603 on which the supporting legs 601 are mounted, and a second frame element 604. The first and second frame element are movable with respect to each other in the direction indicated in the drawings by an arrow A.

The first frame element 603 comprises two vertical slots 605 and the second frame element 604 comprises two corresponding slanting slots 606 which partially overlap with the vertical slots 605 in the first frame element 603. Through the opening which is provided by an overlapping pair of a vertical slot 605 and a slanting slot 606, an axle of a supporting wheel 602 is placed. When now the first frame element 603 is moved with respect to the second frame element 604 the opening provided by the two slots will move in a vertical direction and, as a consequence, the wheels placed in the slots 605, 606 will be moved in a vertical direction.

The moving means for actuation of the movement between the first and second frame element comprise a bolt-nut assembly comprising a nut 607 being mounted on the second frame element 604 and a bolt 608 which is rotation-free connected with the first frame element 603. By rotating the head 608*a* of the bolt 608 which head 608*a* is easily accessible at the front end of the support construction 600 the nut and therewith the second frame element 604 may be moved in the direction indicated by arrow A. As explained above the movement of the frames with respect to each other will result in a movement of the wheels with respect to the stationary supporting means.

The two wheels 603 in front of the drawing of the FIGS. 162 and 163 are shown in the lowest position wherein, when all four wheels are placed in this lowest position, a device mounted on the support construction 600 can easily be driven to and from a certain position, while the two wheels 603 in the back of the drawings of the FIGS. 162 and 163 are in the highest position so that, when all four wheels are in this highest position, the device will rest on the stationary legs, which provides a stable positioning on a supporting floor. It will be clear for the man skilled in the art that more or less than four stationary supporting means and/or wheels may be provided for a support construction.

We claim:

1. Dispenser apparatus for dispensing fluids such as paint or hair-dye colorants, said dispenser apparatus comprising:

a plurality of dispensing units, each dispensing unit having a receptacle for holding a fluid with a corresponding pump means for dispensing said fluid, a centrally located rotatable support structure for supporting said dispensing units, and wherein said support structure supports a radical inward side of each dispensing unit; and a stationary dispensing station having pump actuating means for selectively actuating said pump means, wherein said pump means comprises a valve mechanism for controlling the flow from said dispensing units.

2. Dispenser apparatus as claimed in claim 1, wherein each dispensing units is detachably attached to the support structure, and wherein each dispensing units comprises two or more receptacles and two or more corresponding pump means.

3. Dispenser apparatus as claimed in claim 1, wherein each dispensing unit is made as a one-piece molded plastic unit.

4. Dispenser apparatus as claimed in claim 1, wherein each dispensing unit is assembled out of a number of molded plastic units that are coupled to each other.

5. Dispenser apparatus as claimed in claim 1, wherein each dispensing unit is a canister unit or an adapter.

6. Dispenser apparatus as claimed in claim 2, wherein said receptacles are arranged in one or more concentric circles.

7. Dispenser apparatus as claimed in claim 1, wherein said pumping means are detachably mounted on a dispensing unit.

8. Dispenser apparatus as claimed in claim 1, wherein said pump means comprises an inlet-outlet valve mechanism comprising a first valve element having a first opening in fluid communication with a fluid inlet of said pump means and a second opening in fluid communication with an interior of said pump means, and a second valve element having a dispensing opening and an inlet channel, said first and second valve elements being rotatable with respect to each other between at least a dispensing position in which said second opening and said dispensing opening are aligned making dispensing of fluid possible and an inlet position in which said inlet channel brings said first opening in fluid communication with said second opening so that said interior of said pump means is in fluid communication with said fluid inlet of said pump means.

9. Dispenser apparatus as claimed in claim 8, wherein said second valve element comprises a second dispensing opening having a different cross section as said dispensing opening, and wherein said valve elements are further rotatable with respect to each other in a second dispensing position in which said second opening and said second dispensing opening are aligned so that dispensing through said second dispensing opening is possible.

10. Dispenser apparatus as claimed in claim 8, wherein said inlet-outlet valve mechanism is mounted in a housing, whereby said first valve element is stationary and said second valve element is rotatable with respect to said housing.

11. Dispenser apparatus as claimed in claim 8, wherein said first and/or second valve elements are valve discs.

12. Dispenser apparatus as claimed in claim 1, wherein said dispenser apparatus comprises a worm drive mechanism for driving said dispensing units.

13. Dispenser apparatus as claimed in claim 12, wherein said worm drive mechanism engages with one or more pin-like elements arranged on each of said one or more dispensing units.

14. Dispenser apparatus as claimed in claim 1, wherein said dispensing apparatus comprises stirring means for stirring fluid held in said one or more receptacles, wherein said stirring means comprises a stirring device which is arranged in at least one receptacles, and wherein said stirring device is actuated by stirring actuation means.

15. Dispenser apparatus as claimed in claim 1, wherein said dispenser apparatus comprises indexing means for determining the position of the dispensing units with respect to the pump actuation means.

16. Dispenser apparatus as claimed in claim 1, wherein said dispenser apparatus comprises a control unit for automatically controlling the dispensing of the fluids.

17. Dispenser apparatus as claimed in claim 2 further comprising:

a discharge opening defined by a receptacle for discharging fluid held therein;

an inlet valve defined by the corresponding pump means in fluid communication with the discharge opening;

a shut off valve positioned between a discharge opening and the inlet valve to prevent leakage of fluid in said receptacle, when said dispensing unit is detached from the support structure.

18. Dispenser apparatus for dispensing fluids such as paint or hair-dye colorants, said dispenser apparatus comprising: one or more dispensing units, at least comprising a receptacle for holding a fluid and a corresponding pump means for dispensing said fluid, a movable, rotatable support structure for supporting said dispensing units, and a stationary dispensing station at least comprising pump actuating means for selectively actuating said pump means, wherein each of said one or more dispensing units is detachably attached to the support structure, and wherein each of said one or more dispensing units comprises two or more receptacles and two or more corresponding pump means.

19. Dispenser apparatus for dispensing fluids such as paint or hair-dye colorants, said dispenser apparatus comprising:

a plurality of dispensing units, each dispensing unit having a receptacle for holding a fluid, each receptacle further having a corresponding pump means for dispensing said fluid;

a movable, rotatable support structure for supporting said dispensing units, and a stationary dispensing station comprising pump actuating means for selectively actuating said pump means, wherein said pump means comprises an inlet-outlet valve mechanism comprising a first valve element having a first opening in fluid communication with a fluid inlet of said pump means and a second opening in fluid communication with an interior of said pump means, and a second valve element having a dispensing opening and an inlet channel, said first and second valve elements being rotatable with respect to each other between at least a dispensing position in which said second opening and said dispensing opening are aligned making dispensing of fluid possible and an inlet position in which said inlet channel brings said first opening in fluid communication with said second opening so that said interior of said pump means is in fluid communication with said fluid inlet of said pump means.

* * * * *

UNITED STATES PATENT AND TRADEMARK OFFICE

CERTIFICATE OF CORRECTION

PATENT NO. : 7,121,430 B2
APPLICATION NO. : 11/065915
DATED : October 17, 2006
INVENTOR(S) : Mink et al.

It is certified that error appears in the above-identified patent and that said Letters Patent is hereby corrected as shown below:

Claim 1, column 30, line 8 of the patent the word "radical" should be spelled --radial--.

Signed and Sealed this

Sixth Day of March, 2007

JON W. DUDAS
*Director of the United States Patent and Trademark Office*